US006014938A

United States Patent [19]

Uto

[11] Patent Number: 6,014,938

[45] Date of Patent: Jan. 18, 2000

[54] OVER EDGING APPARATUS FOR SINGLE CLOTH PIECE PRODUCTS

[75] Inventor: Yoshitsugu Uto, Niwa, Japan

[73] Assignee: Barudan Sewing Machine Co., LTD., Aichi, Japan

[21] Appl. No.: 09/180,983

[22] PCT Filed: May 19, 1997

[86] PCT No.: PCT/JP97/01675

§ 371 Date: Nov. 19, 1998

§ 102(e) Date: Nov. 19, 1998

[87] PCT Pub. No.: WO97/44516

PCT Pub. Date: Nov. 27, 1997

[30] Foreign Application Priority Data

| | | | |
|---|---|---|---|
| May 20, 1996 | [JP] | Japan | 8-124305 |
| Mar. 7, 1997 | [JP] | Japan | 9-053546 |
| May 15, 1997 | [JP] | Japan | 9-125566 |

[51] Int. Cl.[7] ..... D05B 39/00

[52] U.S. Cl. ..... 112/470.18; 112/309

[58] Field of Search ..... 112/2.1, 141, 147, 112/142, 143, 470.14, 470.16, 470.18, 470.17, 308, 309, 148

[56] References Cited

U.S. PATENT DOCUMENTS

| | | | |
|---|---|---|---|
| 5,018,462 | 5/1991 | Brocklehurst | 112/470.18 X |
| 5,400,728 | 3/1995 | Zinssmeister | 112/113 X |
| 5,647,292 | 7/1997 | Morgulis et al. | 112/470.17 |
| 5,778,811 | 7/1998 | Gill et al. | 112/470.18 X |
| 5,809,919 | 9/1998 | Mitchell et al. | 112/470.14 X |

FOREIGN PATENT DOCUMENTS

| | | |
|---|---|---|
| 63-25966 | 2/1988 | Japan . |
| 4-26480 | 1/1992 | Japan . |
| 4-189388 | 7/1992 | Japan . |
| 7-24169 | 1/1995 | Japan . |
| 7-124357 | 5/1995 | Japan . |
| 7-171281 | 7/1995 | Japan . |

*Primary Examiner*—Ismael Izaguirre
*Attorney, Agent, or Firm*—Lorusso & Loud

[57] ABSTRACT

A hemstitching apparatus for single-fabric products such as towels, handkerchiefs, luncheon mats, pillow cases and scarves. The apparatus (100) is simple in structure and safeguarded, which can provide a quick hem treatment. A hemstitching apparatus (100) of the present invention includes: a press plate (30) which presses a fabric piece (W) on a work table (20) held by a machine frame (10); a guide beam (60) which moves a vertical shaft (40) mounting the press plate (30); a drive device (70) which moves the guide beam (60); a turn device (80) provided on the shaft (40); a guide rail (90) which guides guide rollers (81) provided on the turn device (80); and a sewing device (200), the press plate (30) and the turn device (80) being synchronously shifted and turned solely by means of reciprocation of the guide beam (60) as activated by the drive device (70). The hemstitching apparatus (100) can provide both a square corner treatment and a round corner treatment.

10 Claims, 53 Drawing Sheets

(A)

(B)

OVER EDGING APPARATUS FOR SINGLE CLOTH PIECE PRODUCTS

BACKGROUND OF THE INVENTION

1. Field of the Invention

This invention generally relates to a hemming apparatus for fabric products. This invention more particularly relates to a hemming apparatus or hemstitching apparatus for single-fabric products such as towels, handkerchiefs, luncheon mats, pillow cases and scarves.

2. Prior Art

To produce single-fabric products, generally of rectangular configuration, such as towels, handkerchiefs, luncheon mats, pillow cases or scarves, an elongated fabric material is first cut into fabric pieces of appropriate dimensions, then their hems are sewn or lock seamed to prevent fraying. Japanese Laid-Open Patent Publication No. 4-26480 discloses a method for hemming fabrics as shown in the attached FIG. 53C, where the four corners of a fabric piece are locked squarely. Japanese Laid-Open Patent Publication No. 7-24169 discloses another method for hemstitching fabrics, where the four corners of a fabric piece are locked or sewn roundly.

Straight side portions (edges) of fabric pieces (fabrics) are sewn or lock seamed as the fabrics advance relative to a sewing device. The corner portions of fabrics are sewn or lock seamed as or after the corners turn 90 degrees relative to the sewing device for "round" or "square" corner treatments respectively. Such a square corner treatment is provided when a 90-degree turning of fabrics is made while the needle of the sewing device is idling. On the other hand, such a round corner treatment is provided when a 90-degree turning is made while the needle is functioning.

Japanese Laid-Open Patent Publication No. 4-189388 discloses a hemming apparatus for rectangular fabric products, which comprises, as shown in the attached FIG. 53A:

- a work table having a fabric holder stand;
- a sewing device having a needle and feeder teeth, mounted on the work table;
- a threaded rail turnably mounted on the holder stand, extending in the direction of fabric feeding;
- a rail driver to turn the threaded rail;
- a nut device engaged on the threaded rail;
- a horizontal swing arm turnably attached on the nut device;
- an arm driver to horizontally swing or turn the swing arm;
- a fabric absorber device having absorbers, vertically movably mounted on the swing arm; and
- an elevator device to vertically move the absorber device.

The attached FIG. 53C-1 shows a square fabric piece generally defined by "C" which is fed close to the needle of the sewing device 2 shown in FIG. 53(A), "P" indicating where the needle contacts the fabric C.

The elevator device 10 lowers the fabric absorber device 9, whose absorbers 11 absorb the fabric C placed on the work table 1 after the rail driver 5 turns the threaded rail 4, sending the nut device 6 in the fabric feeding direction, and then the nut device 6 stops over the fabric C. The fabric C is advanced toward the needle point P (direction A) with the feeder teeth of the sewing device 2 (synchronized with the nut movement), and sewn along an edge (see FIG. 53C-2). Then the fabric C attached to the absorbers 11 is swung 90 degrees in the direction B around the needle point P by means of the swing arm 7 driven by the arm driver 8. Next, the nut device 6 is retreated on the threaded rail 4 by means of the rail driver 5 such that the fabric C is placed before the needle point P as shown in FIG. 53C-4. The foregoing sewing process is repeated in the direction D to treat another edge of the fabric C as the fabric C advances in the direction A shown in FIG. 53C-5. The remaining two edges of the fabric C are sewn or locked in the same manners. Practically all these steps are performed automatically.

The hemming apparatus described above provides the following advantages: a) reduction in manpower; and b) homogeneous quality of edge treatment as the feeding of fabrics is provided automatically.

However, this hemming apparatus is not without a shortcoming:

(1) fabrics need be retreated at every corner after turning or swinging before another sewing takes place so as to provide a gap between the needle point P and the fabrics, which generate "time loss"; and (2) "round" corner treatments are not provided.

Japanese Laid-Open Patent Publication No. 7-24169 discloses an edge locking or sewing apparatus, which automatically provides "round" corner seaming, comprising, as shown in FIG. 52:

- a sewing device 2;
- a work table 20;
- a fabric holder plate 30 mounted on the work table 20, whose corners are round;
- a plurality of pins 33 attached on the holder plate 30;
- a fabric feeder 60 having a block device and a press device to advance the holder plate 30 toward the sewing device 2;
- a holder device 80 having a block device to hold a corner pin 33; and
- a rotary device 90 having a hook to swing the holder plate 30 around that corner pin 33 for a predetermined angle.

A fabric placed on the work table 20 is pressed and held by the holder plate 30, which is sent toward the sewing device 2 by means of the fabric feeder 60. The holder device 80 holds a corner pin 33 and the rotary device 90 turns or swings the holder plate 30 for a predetermined angle. The fabric is overlooked and at the same time cut along edges with the sewing device 2 having a cutter while the fabric moves relative to the sewing device 2.

Accordingly, the edge locking apparatus of Japanese Laid-Open Patent Publication No. 7-24169 provides a "round" corner treatment for fabric products. However, this apparatus is not without a shortcoming:

(3) the block device of the holder device 80 is lowered to engage with a corner pin 30, and while the block device of the fabric feeder 60 is lifted, a pad of the press device is lowered in order to prevent the holder plate 30 from rising, and then the hook of the rotary device 90 is advanced to engage with that pin 30 and then retreated, during all which the sewing operation is at a halt, generating "time loss"; and (4) a great many components and members are used, complicating the overall apparatus arrangement.

Japanese Laid-Open Patent Publication No. 7-124357 discloses another hemstitching apparatus which automatically stitches corner portions and edges of fabrics including winding edges, comprising (not shown: described here using the drawings accompanying said patent documents):

- a work table 2;
- a sewing device M;

a mobile stand 3 which moves in Y direction above the work table 2;

a mobile mounting table mounted on the mobile stand 3, which moves in X direction;

an elevator device which moves in Z direction and is capable of turning about Z axis; and a press plate 6 attached to the elevator device.

A fabric is lock seamed with the sewing device M along its edges while the fabric is pressed on the work table 2 with the press plate 6 with the orientation of the fabric under control of the mobile stand 3 and the elevator.

The hemstitching apparatus according to Japanese Laid-Open Patent Publication No. 7-124357 provides computer controlled X-Y as well as angular orientations of the press plate 6, virtually eliminating use of other members for adjusting to each configuration of fabric products. However, the overall operational speed is much restricted. In addition, while the apparatus is capable of providing precise and neat stitching or locking, the apparatus requires adjustment of computer data and accessory devices each time designs of fabric products are changed, pushing up production cost considerably.

Single-fabric products such as towels, handkerchiefs, luncheon mats and pillowcases are "low price" products. They need to be produced at very low costs by means of mass production, eliminating "time loss" to a maximum degree. Accordingly, it is not advantageous to use a complicated, thus expensive, stitching machine or apparatus to produce such "cheap" products. Equally, even those fabric products whose corners are hemmed in a round configuration need be provided at low costs.

Single-fabric products can take a variety of shapes, such as shown in FIGS. 50A, 50B, 50C and 50D. Corner stitching may be square ones as shown in FIGS. 50A and 50C, or round ones as shown in FIGS. 50B and 50D. Further, shapes of fabric products may be hexagonal as shown in FIG. 51B or even triangular as shown in FIG. 51C. It is necessary to make as many apparatus settings as there are shapes of fabric products, for both manual and computer controlled operations.

Use of the aforementioned prior art apparatuses to produce a smaller number of fabric products is therefore not very advantageous as far as production efficiency and cost are concerned. Use of those apparatuses may be advantageous only for mass producing identical products or rather expensive products. Accordingly, it is desired to provide a hemstitching apparatus which can be easily adjusted to a practically any given shape and dimensions of single-fabric products.

Equally desirable is providing "safeguard" to operations. No doubt, any apparatus is subject to malfunctioning. When a high-speed machine malfunctions, it may lead to total destruction of the machine. To avoid such damages, an apparatus should be provided with a certain degree of safety measure or "leeway."

The present inventor has made great efforts to find ways to cope with all the foregoing shortcomings which accompany the prior art hemstitching apparatuses.

Accordingly, it is an object of the present invention to provide a very simple and reliable hemstitching apparatus which can efficiently hem stitch and hem cut fabrics.

It is another object of the present invention to provide a hemstitching apparatus which can be easily adjusted to varied configurations of fabric products, shortening overall manufacturing time.

It is still another object of the present invention to provide a hemstitching apparatus which is capable of automatically cutting and feeding an elongated fabric material.

These and other objects will be fully understood from the following description of the invention.

DESCRIPTION OF THE INVENTION

In the following, the present invention is described using the accompanying drawings for clarity. A hemstitching apparatus 100 of the present invention generally comprises:

a machine frame 10;

a work table 20 mounted on the frame 10;

a press plate 30 to press a fabric W;

a shaft 40 vertically provided on the press plate 30;

a guide beam 60 to guide the shaft 40;

a drive device 70 to move the guide beam 60;

a turn device 80 provided at an upper portion of the shaft 40;

a plurality of guide rollers 81 mounted on the turn device 80;

a guide rail 90 to movably and selectively receive the guide rollers 81; and a sewing device 200 having cutter means to hem stitch and hem cut the fabric W as pressed with the press plate 30, the linear and angular shifting of the press plate 30 and the turn device 80 synchronously provided by the guide beam 60 as controlled by the drive device 70.

In an embodiment, a fabric W fed on the work table 20 by means of a fabric feeder such as a cutter device 300 and a transport plate 350 is pressed with the press plate 30 on the work table 20. The orientation and position of the fabric W pressed with the press plate 30 are altered under control and fed under the sewing device 200 by means of the guide rollers 81 which run on the guide rail 90. The fabric feeding method of the present invention may be substantially similar to those shown in FIGS. 52 and 53. However, a hemstitching apparatus 100 of the present invention provides a totally different method for shifting and orienting the press plate 30, thus the fabric W.

The press plate 30 is shifted and oriented by the shaft 40 and the turn device 80 provided at the upper end of the shaft 40 with attachment means. The press plate 30 is given dimensions and configuration such that the fabric piece W projects on all edges from the press plate 30 so that the projected portions of the fabric piece W can be sewn and cut with the sewing device 200 concurrently, as shown in FIGS. 14, 23, 24, 48 and 51.

The turn device 80 is provided with a plurality of arms 80*a* as shown in FIG. 51, for example. The arms 80*a* each having a guide roller 81 correspond to the corners of the fabric piece W on the work table 20 as shown in FIGS. 14, 23, 24, 46 and 48.

Since single-fabric products such as towels or handkerchiefs are generally rectangular or square as shown in FIGS. 50 and 51A, the press plate 30 is generally rectangular or square and thus the turn device 80 has four arms 80*a* each with a guide roller 81. However, the present invention provides hemstitching of other configurations of fabrics such as a hexagonal shape (FIG. 51B) and a triangular shape (FIG. 51C), in which cases the press plate 30 and the turn device 80 are respectively given shapes as shown in FIGS. 51B and 51C in phantom.

The turn device 80 is provided and held on the top end of the vertical shaft 40 with a cylinder member 53 as shown in FIG. 9 (Embodiment 1), FIG. 17 (Embodiment 2), and FIGS. 31 and 37–39 (Embodiment 3). The turn device 80 is provided on the cylinder member 53 which is a portion of a support device 50 mounted over the shaft 40. The cylinder member 53 is mounted on the shaft 50 by means of engaging guide columns 56 and a coupling guide 43 (shown in FIG. 9). Such an arrangement is provided to inhibit communication between the vertical motion of the shaft 40 relative to the support device 50 and the turn device 80, as the fabric W is fed under the press plate 30 when the press plate 30 is lifted by the upward motion of the shaft 40.

At least one of the guide rollers 81 provided on the arms 80*a* as shown in FIGS. 1, 18, 28 and 39 is received at a time in a guide channel 90*b* provided in the guide rail 90 as shown in FIGS. 4, 18 and 29. The shaft 40 slidably held in the support device 50 is guided by a guide beam 60 movably held in a driver rail 61 which extends perpendicular to the fabric feeding direction as shown in FIGS. 6, 17, 38 and 39. The guide beam 60 is driven by a drive device 70 mounted on the machine frame 10.

The motion of the turn device 80 provided by the drive device 70 is respectively described in the following relative to embodiments representatively shown in FIGS. 7, 18, 27, 45 and 46.

A hemstitching apparatus 100 according to an embodiment is described in reference to FIGS. 7 and 10–13. When a fabric W is fed on a work table 20 with a feeder (not shown), a turn device 80 will be oriented as shown in FIG. 11-1. FIGS. 11–13 show relative orientations of the fabric W and the turn device 80. A press plate 30 which moves synchronously with the turn device 80 is omitted from those figures. A guide roller 81 of the turn device 80 is held by a stopper 91 provided in a guide channel 90*b* of a guide rail 90. The roller 81 held by the stopper 91 is indicated by "B" in FIG. 10.

When a fabric W is fed, a drive motor 71 of a drive device 70 is powered and moves the guide beam 60 as shown in FIG. 4 such that the turn device 80 is given a leftward motion, which swings the turn device 80 leftward as shown in FIG. 11-2, since the guide roller 81(B) held in the guide channel 90*b* of the guide rail 90 is restricted of its shifting by the stopper 91. The shaft 40 supporting the turn device 80 moves leftward together with the turn device 80.

When the guide beam 60 starts moving backward by means of the drive device 70, the turn device 80 starts its turn as shown in FIG. 10 about the guide roller 81(B). A guide roller 81 indicated by "A" comes off the guide channel 90*b* from an outlet 92 formed in the guide rail 90, setting the guide roller 81 (A) free. The turn device 80 turns or swings counter clockwise as shown in FIG. 10.

A guide roller 81 indicated by "C" enters the guide channel 90*b* of the guide rail 90 from an inlet 93 formed in the guide rail 90, guided by a guide member 94 provided on the guide rail 90. The guide member 94 returns to its original state after the insertion of the guide roller C and prevents the guide roller C from coming off the guide channel 90*b* (see FIG. 11-3).

The press plate 30 will be positioned above the fabric W as shown in FIG. 11-3, where the press plate 30 is lowered onto the fabric W on the work table 20 by means of a support device 50 including the shaft 40. The turn device 80 remains at its level and is not lowered when the shaft 40 is lowered.

A forward movement of the guide beam 60 shifts the press plate 30 and the fabric W forward and feeds the fabric W under a sewing device 200 with two guide rollers 81 engaged in the guide channel 90*b* of the guide rail 90. As the fabric W advances relative to a needle 210 of the sewing device 200, an edge of the fabric W is treated (locked or stitched and cut). In embodiments of the present invention, there is provided a scissors device 211 in the vicinity of the needle 210 to cut edges of the fabric W.

When this operation (one edge treatment) is completed, the turn device 80 takes another position shown in FIG. 12-5. The guide roller C will then engage with the stopper 91. The guide beam 60 is positioned at the forward end and is then subjected to backward movement by means of the drive device 70. The turn device 80 is subjected to swinging as described relative to FIGS. 10 and 11-2, and as shown in FIG. 12-6.

Whether it is a square corner stitching or a round corner stitching depends on the stitching operation shown in FIGS. 12-5 and 12-6. When a square corner stitching is desired, the sewing device 200 remains idle until the fabric W turns 90 degrees from the orientation shown in FIGS. 12-6. A round stitching is provided when the sewing device keeps functioning as the fabric W makes a 90-degree turn as described in detail relative to another embodiment.

When a round corner stitching is desired, the sewing device 200 continues to function during the step shown in FIG. 12-6. The turn device 80 turns around a guide roller 81 in the guide channel 90*b* as shown in FIG. 10, during which the needle 210 of the sewing device 200 "roundly" stitches or locks the corner portion immediately outside of that guide roller 81 (as seen from above) as shown in FIG. 15A.

A hemstitching apparatus 100 according to another embodiment is shown in FIGS. 15–24. When a drive motor 71 of a drive device 70 functions and a borescrew 72 (clearly shown in FIGS. 1 and 2) turns "reversely", a guide beam 60 "retreats". A turn plate 80 starts swinging as shown in FIGS. 10 and 18 in the same manner as described previously relative to the foregoing embodiment.

A guide roller 81 indicated by "C" in FIG. 10 enters a guide channel 90*b* of a guide rail 90 through an inlet 93 guided by a guide member 94 provided on the guide rail 90. The inlet 93 is otherwise closed as shown in FIG. 10 by a front portion 94*a* of the guide member 94. When a guide roller 81 forcibly opens the front portion 94*a* as shown in FIG. 22B, that is, when the bottom of an incoming guide roller 81 touches and pushes a slant face 94*b* of the guide member 94, the guide member 94 turns about an arbor 94*c* and presses a spring 98 to let the guide roller 81 in.

The center turn device 80 shown in FIG. 18 turns 90 degrees in the same manners. In FIG. 18, two orbital motion lines are shown for that turn device 80, showing that this turn device 80 can cope with changes in dimension of fabric products. In this hemstitching apparatus 100, a gate member 95*a* of a gate device 95 and the guide member 94 respectively closing the outlet 92 and the inlet 93 are respectively provided with an elongation along the guide rail 90, facilitating adjustment for dimensional differences of edges of fabric products. The width between those two orbital lines indicates a possible size adjustment range, which can be made even greater, if desired.

Motions of the center turn device 80 shown in FIG. 18 are further shown in FIG. 23C as well as in FIGS. 24C and 24D. FIG. 23 shows a round corner stitching. For a round corner stitching, the needle 210 of the sewing device 200 is positioned as indicated by a triangle above a portion which is immediately outside of the center of the guide roller 81 held by the stopper 91 (as seen from above). FIG. 24 shows a square corner stitching. A square corner stitching is provided as shown in FIG. 24E when the turn device 80 turns about the guide roller 81 to set the stitch start point of a second edge of the fabric W positioned at a point to the left from the needle 210 of the sewing device 200 as shown in FIG. 24D.

FIG. 47 is an enlarged drawing showing the motion of the press plate 30 and the fabric W as guided by the turn device 80. After a first edge of the fabric W is treated (right), the fabric W and the press plate 30 are positioned (left) as shown in FIG. 47. The needle 210 is positioned at a spot indicated by a triangle. In an embodiment, the sewing device 200 is fixed to the machine frame 10, in which the position of the needle 210 is unchanged. The start point of the second edge of the fabric W comes on the left side of the needle 210 as the turn device 80 turns left. The second edge is then stitched and cut in the following manners along a line which is square to the first edge.

The drive device 70 shifts the guide beam 60 forward. The turn device 80 with two guide rollers 81 engaged in the guide channel 90*b* of the guide rail 90 shifts its position in the fabric feeding direction, continuously feeding the fabric W under the needle 210 as pressed with the press plate 30.

After this fabric edge treatment, the guide roller 81 indicated by C in FIG. 10 comes off the stopper 91. The third and fourth edges of the fabric W will be treated in the described manners.

A hemstitching apparatus 100 according to another embodiment is shown in FIGS. 25–49. When a fabric W is carried onto a work table 20 with a cutter device 300 having a transport plate 350 as shown in FIG. 27, the function of the transport plate 350 is taken over by a press plate 30. Then a support device 50 lowers a shaft 40. The press plate 30 presses the fabric W as shown in FIG. 38. A turn device 80 is positioned above the press plate 30 as shown in FIG. 29, and two guide rollers 81 of the turn device 80 are engaged in a guide channel 90*b* of a guide rail 90 as shown in FIG. 45.

A drive device 70 turns a borescrew 72, shifting a guide beam 60 mounted on the borescrew 72 to the right in FIG. 32. Then the turn device 80 is shifted to the position shown in FIG. 29 by means of the two guide rollers 81 engaged in the guide channel 90*b* of the guide rail 90. The fabric W pressed with the press plate 30 on the work table 20 moves synchronously.

The hemstitching apparatus 100 according to an embodiment has a label device 360 between a cutter device 300 and a sewing device 200. The label device 360 provides labels between fabrics W and a press plate 30 as shown in FIGS. 26 and 31, which will be attached to the fabric products.

The straight movement of the fabric W and the press plate 30 relative to the needle 210 of the sewing device 200 facilitates a straight stitching and trimming of the fabric W concurrently.

Before treating another edge of the fabric W, the corner between the relevant edges need be treated, with either a round corner treatment or a square corner treatment. The following description is directed to a square corner treatment such as shown in FIGS. 50A and 50C. The press plate 30 has right angular corners as shown in FIG. 47, which are to be positioned relative to the needle 210 as shown in FIG. 39 by means of a rail driver 400.

As shown in FIGS. 32 and 33, the rail driver 400 holds the guide rail 90 such that the guide rail 90 can shift in the fabric feeding direction. To treat a corner of a fabric W squarely, an axial handle 417 provided on the rail driver 400 is turned under control so that rail bases 411 shift the guide rail 90 to the right in FIG. 33. The guide channel 90*b* of the guide rail 90 supported on the rail bases 411 is shifted together to the right in FIG. 33. The press plate 30 is positioned such that the orientation and position of the press plate 30 are properly adjusted relative to the needle 210 as shown in FIGS. 46A and 47.

After that adjustment, the press plate 30 is turned so that the fabric W can be treated with the sewing device 200 on an edge as shown in FIG. 46B.

When the first edge has been treated, the turn device 80 takes the position shadowed in FIG. 45. The right roller A of the two guide rollers 81 received in the guide channel 90*b* faces the outlet 92 and the left roller B contacts the right end of the stopper 91 in the guide channel 90*b*. As the borescrew 72 turns "reversely" by means of the drive device 70, a piston 97*a* turns the gate device 95 as shown in FIG. 35, opening the outlet 92.

The guide beam 60 retreats when the borescrew 72 turns reversely by means of a drive motor 71 of the drive device 70. This driving force pulls the center of the turn device 80 leftward in FIG. 45. However, as a guide roller 81 of the turn device 80 is held by the stopper 91 in the guide channel 90*b*, the turn device 80 is actually turned as shown in FIG. 45 on the guide roller 81. Since the turn device 80 is attached to the guide beam 60 via the shaft 40 and the support device 50, the shaft 40 is synchronously shifted with the turn device 80.

As described, the turn device 80 starts to move and turn as shown in FIG. 45 when the guide beam 60 starts moving by means of the drive device 70. The turn device 80 turns about the guide roller B held in the guide channel 90*b* and the guide roller A comes off the outlet 92, which facilitates counter clockwise turning of the turn device 80 as shown in FIG. 45.

The guide roller C enters the guide channel 90*b* from the inlet 93 guided by the guide member 94. The inlet 93 is otherwise closed by the front portion 94*a* of the guide member 94 as shown in FIG. 36B. The inlet 93 is opened as a guide roller 81 pushes the front portion 94*a* downward as shown in FIG. 36A. That is, a guide roller 81 touches the slant face 94*b* of the guide member 94, pushing the guide member 94 against the pull spring 98, and the guide roller 81 enters the guide channel 90*b*.

In the hemstitching apparatus 100 of the present invention, the gate device 95 and the guide member 94 on the guide rail 90 are both provided with a substantial length to provide an adjustment capability for different dimensions of fabric products. Even a rectangular fabric W as shown in FIG. 50C can be treated, as the outlet 92 and the inlet 93 are made long enough to adjust to the difference in length of the edges.

Each of the hemstitching apparatuses 100 includes in common, as shown in FIGS. 9, 37 and 38:

- a support cylinder 51 to shift a support device 50 which slidably holds a shaft 40 by means of a guide beam 60;
- a cylinder member 53 to shift the shaft 40 vertically within the support cylinder 51;
- a first chamber 54 and a second chamber 55 formed between the cylinder member 53 and the shaft 40; and
- two fluid ports 51*a* and two port paths 53*a* respectively provided on the fluid ports 51*a* so as to respectively control pressures in the first chamber 54 and the second chamber 55.

Hemstitching apparatuses in general must be adjusted to each fabric product by changing their press plate equivalents and turn device equivalents. A hemstitching apparatus 100 of the present invention provides easy changing of such members. The shaft 40 detachably supporting the press plate 30 and the turn device 80 is movably or slidably held in the support device 50, the fact of which provides easy changing of the press plate 30 and the turn device 80 with others as required.

Conventionally, such a shaft is movably held by means of a cylinder from above as shown in FIG. 54, making it very troublesome to remove and set a turn device. In order to supply electricity or fluid pressure to move the shaft vertically, a cable or hose is conventionally attached, which adds trouble to removing and setting a turn device. In the present invention, such a hose or cable is provided from a side of the support device 50 at a body portion of the support device 50, additionally providing easy removal and setting of both the turn device 80 and the press plate 30.

The shaft 40 is held in the support device 50 such that it can slide vertically within the support member 50. The support device 50 is associated with the guide beam 60 via a horizontally elongated guide block 52 provided on the support cylinder 51. The guide block 52 is provided with a guide recess 52*a* as shown in FIGS. 6 and 9. The guide block 52 receives a guide rail 61 of the guide beam 60 in a guide recess 52*a*. The support device 50 can move freely along the guide rail 61 of the guide beam 60.

The cylinder member 53 is installed within the support cylinder 51 and can freely turn. A void is formed in the inner wall of the cylinder member 53 such that the first pressure chamber 54 and the second pressure chamber 55 can be provided therein between the cylinder member 53 and the shaft 40 as shown in FIG. 9. A piston portion 42 is formed on the shaft 40 between the first chamber 54 and the second chamber 55. Two fluid ports 51*a* and two port paths 53*a* respectively leading to the fluid ports 51*a* are formed respectively on the support cylinder 51 and the cylinder member 53 as shown in FIG. 9, which respectively correspond to the first chamber 54 and the second chamber 55. By controlling the pressures of the first chamber 54 and the second chamber 55, the shaft 40 functions as a piston within the support device 50.

A coupling guide 43 having a plurality of grooves 43*a* is provided on the upper end of the shaft 40. Each groove 43*a* engages with each guide column 56 (in this case 4 in all). Assisted by the guide columns 56 and the grooves 53*a*, the shaft 40 moves vertically relative to the cylinder member 53 of the support device 50. The orientation-position shifting force provided to the cylinder member 53 from the turn device 80 is transferred to the shaft 40 by means of engagement between the guide columns 56 and the coupling guide 43.

The present invention also provides a safeguard (damage prevention) measure to protect an apparatus 100, which includes supporting the guide rail 90 retreatably relative to the frame 10 by connecting both ends of the guide rail 90 by means of safety devices 10*a* provided on the frame 10.

When the turn device 80 and the press plate 30 move from the fabric feeding position to the waiting position, the right end of the guide rail 90 is drawn upward as shown in phantom in FIG. 18 by a piston device 96, avoiding accidental contact between the press plate 30 and the needle 210 of the sewing device 200, though the press plate 30 will not contact the needle 210 in ordinary situations.

Particularly, when a stopper piston 99 malfunctions and does not draw the stopper 91 under the guide rail 90 (FIG. 20), a guide roller 81 may collide with the stopper 91 when the turn device 80 abruptly returns to its waiting position. And if the drive device 70 keeps functioning, the hemstitching apparatus 100 may be badly damaged. In order to avoid such an accident, the ends of the guide rail 90 are respectively connected to the frame 10 with the safety devices 10*a*. The safety devices 10*a* completely stop the apparatus 100 before substantial shocking forces are applied onto the turn device 80 and other members.

Regarding the gate device 95 which closes the outlet 92, a push spring 97*b* is provided to press the gate member 95*a*. When the stopper 91 malfunctions and the turn device 80 returns to the waiting position at a high speed, the turn device 80 and other members may be damaged if the stopper 91 remains protruding into the guide chamber 90*b*. At such a time, since a guide roller 81 engaging with the stopper 91 and the shaft 40 exerting a force to move the turn device 80 are rather widely apart, a large moment is generated therebetween and applied onto the turn device 80 so as to turn the turn device 80 counter clockwise, and a guide roller 81 facing the outlet 92 will attempt to disengage with the guide rail 90. The retaining spring power of the outlet 92 is so controlled as to allow that guide roller 81 to overcome the spring force at such an occasion. As a result, that guide roller 81 will escape from the outlet 92 without damaging the apparatus 100.

The guide rail 90 has two "large" openings, outlet 92 and inlet 93, which are closed with a gate device 95 and a guide member 94 respectively. Guide rollers 81 can be smoothly introduced into the guide rail 90 through the inlet 93 and smoothly expelled from the guide rail 90 through the outlet 92. Regarding the guide member 94, as shown in FIGS. 21 and 22, a support spindle 95*b* which supports the guide member 94 on the frame 10 is provided at the same level with the front portion 94*a* of the guide member 94, preventing opening of the front portion 94*a* of the guide member 94 while a guide roller 81 is being guided into the guide channel 90*b*. There is no force to be generated to push the guide roller 81 shown in FIG. 22 rightward.

FIG. 47 shows an orbital motion of the press plate 30 and the fabric W. When the treatment of a first edge of the fabric W is provided, the fabric W and the press plate 30 are positioned on the right in FIG. 47. The needle 210 is positioned as shown by a triangle, which does not shift its position since the sewing device 200 in this embodiment is fixed to the frame 10. The turn device 80 swings and the corner to the second edge of the fabric W is positioned to the left of the needle 210 as shown in FIG. 47. The second edge will be treated (sewn and cut) while the fabric W advances straight below the needle 210 as indicated by an arrow, providing a square corner treatment.

To describe it further, the drive device 70 shifts the guide beam 60 and the turn device 80 moves in the fabric feeding direction as two guide rollers 81 are engaged in the guide channel 90*b* of the guide rail 90. The fabric W pressed with the press plate 30 advances under the needle 210 of the sewing device 200 and the second edge is treated. After the second edge treatment, the roller C in FIG. 45 engages with the stopper 91. Those steps are repeated for the third and fourth edge treatments.

After all edges of the fabric W are treated, the press plate 30 finally frees the fabric product W, which is carried out on a product carrier 500 onto a product receiver 514 as shown in FIGS. 43 and 44. The press plate 30 and the turn device 80 return to their respective initial positions as shown in FIG. 29 to treat another fabric piece.

The rail driver 400 shown in FIG. 31 provides the following functions when the press plate 30 returns to its original position. The rail driver 400 facilitates a thread end treatment as well as prevents the press plate 30 from accidentally contacting the sewing device 200.

As shown in FIGS. 32 and 33, the rail driver 400 includes thread cylinders 413 which independently draw rail bases 411 supporting the ends of the guide rail 90 on rail members 410 mounted on the frame 10, and also retreat cylinders 414. The thread cylinders 413 provide the thread end treatment at the end of a fabric treatment operation and the retreat cylinders 414 prevent contact between the press plate 30 and the sewing device 200.

A round corner treatment is described in the following using FIGS. 48 and 49. The needle 210 is positioned off the guide channel 90*b* of the guide rail 90 (as seen from above) as shown in FIG. 48A. Square-round control shafts 415 of the rail driver 400 are turned by means of an axial handle 417 to appropriately arrange the position of each rail base 411 off the guide channel 90*b*. A press plate 30 "larger" than the turn device 80 is used as shown in FIG. 48A.

A first edge of a fabric W is treated after that arrangement as shown in FIGS. 48A and 48B. Just before this straight edge treatment is over, the turn device 80 starts to turn as shown in FIG. 48C, while the needle 210 and the cutter device 300 are working. Then, the fabric W will be round corner treated as shown in FIGS. 48C, 48D and 49. When the round corner treatment is over, the second edge treatment starts.

The turning of the turn device 80 for this treatment is identical with that described relative to FIG. 45. Such a round corner treatment is provided only by adjusting the position of the guide rail 90 and by using a press plate 30 prepared for that operation. Removing and setting press members 30 and turn devices 80 can both be done very easily.

The present invention provides production of various fabric products such as shown in FIG. 51, for example, very quickly and at a low cost. The hemstitching apparatus 100 of the present invention facilitates very simple positioning and orientation of a fabric piece W by means of reciprocated movement of the guide beam 60 as driven by the drive device 70. Thus, errors in adjustment will not be accumulated. The overall structure can be very simple. The overall production speed of the hemstitching apparatus 100 of the present invention is about 5 to 10 times as fast as that of a conventional hemstitching apparatus.

"Safety" measures are taken in hemstitching apparatuses 100 of the present invention, therefore, they will seldom malfunction or be damaged.

The choice between a round corner treatment and a square corner treatment is made practically only by adjusting the position of the guide rail 90 relative to the needle 210.

When a hemstitching device 100 of the present invention is arranged including:

detachably attaching a press plate 30 to the lower end of a shaft 40;

providing a turn device support 44 on the shaft 40 with attachment means;

providing an attachment opening 82 at a center portion of a turn device 80;

inserting the turn device support 44 into the attachment opening 82; and fixing the turn device 80 on the turn device support 44, then, removing and setting a press plate 30 and a turn device 80 can be carried out very easily.

To change a press plate 30 with another, a stopper controller 46*a* provided at the lower end of the shaft 40 is lifted as shown by an arrow in FIG. 37. A stopper member 46 comes off a receiver hole 32*b*, setting a coupling member 32 and a press plate connector 45 free from each other. The press plate 30 is drawn to the left in FIG. 37 and proximally in FIG. 38 to be separated from the shaft 40. Setting of another press plate 30 is facilitated in the reverse order of this removal.

The press plate connector 45 is rectangular and fixed to the shaft 40. The receiver hole 32*a* is so dimensioned as to receive the press plate connector 45. The press plate 30 when set is stationary relative to the shaft 40. Accordingly, the motions of the press plate 30 and the turn device 80 are synchronized as shown in FIGS. 46 and 48.

A turn device 80 is changed with another as shown in FIGS. 41 and 42. An attachment opening 82 is formed in a center portion of the turn device 80 as shown in FIG. 40 to receive a turn device support 44 provided at the upper end of the shaft 40 as shown in FIGS. 37 and 38. The turn device 80 when set takes the position relative to the shaft 40 as shown in FIG. 41. A plurality of press legs 47 are provided on the upper face of the turn device 80 in the vicinity of the attachment opening 82, pressing the turn device 80 against the turn device support 44.

When the turn device 80 is held on the shaft 40, the turn device 80 is held tightly between the turn device support 44 and the press legs 47 as shown in FIG. 41A. The turn device support 44 is received in the attachment opening 82 as shown in FIG. 41B.

The turn device 80 is removed by turning a press controller 48 shown in FIG. 42, bringing the lower ends of the press legs 47 onto the turn device support 44 and releasing pressure from the turn device 80. The turn device 80 is merely placed on the turn device support 44. By releasing the press legs 47 as shown in FIG. 42B, the turn device 80 can be easily removed from the upper end of the shaft 40 through the press legs 47. A replacing turn device 80 can be set in position on the upper end of the shaft 40 in the reverse steps.

As described, a hemstitching apparatus 100 of the present invention provides synchronous motion to the press plate 30 and the turn device 80 relative to the shaft 40, and provides easy changing of these members with others.

A label device 360 can be additionally installed between a cutter device 300 and a sewing device 200 as shown in FIGS. 15 and 31. The label device 360 automatically provides labels to be attached on the fabric products.

BRIEF DESCRIPTION OF THE DRAWINGS

FIG. 1 to FIG. 14 show an embodiment (Embodiment 1) of the present invention, in which:

FIG. 1 is a perspective view of a hemstitching apparatus;

FIG. 2 is another perspective view of the hemstitching apparatus of FIG. 1;

FIG. 3 is a side elevational view of the hemstitching apparatus;

FIG. 4 is a plan view of the hemstitching apparatus;

FIG. 5 is a front view of the hemstitching apparatus;

FIG. 6 is a schematic side elevational view of the hemstitching apparatus, showing a positional relationship between a press plate on a work table and a turn device provided on the upper end of a shaft;

FIG. 7 is a partial plan view of the hemstitching apparatus, showing an engagement of the turn device and a guide rail;

FIG. 8 is a partial front view, showing the engagement shown in FIG. 7;

FIG. 9 is a partial sectional view of the hemstitching apparatus, showing a positional relationship of the shaft, a support device and a drive device;

FIG. 10 is a partial plan view, showing a movement of the turn device relative to the guide rail;

FIG. 11 is a partial schematic plan view, showing a motion of the turn device from its initial position to a position over a fabric on the work table;

FIG. 12 is a partial schematic plan view, showing a motion of the turn device from its initial treatment position to a fabric turn position;

FIG. 13 is a partial schematic plan view, showing a motion of the turn device from an end treatment position back to an initial position; and FIG. 14 is a schematic plan view, showing a movement of a fabric as pressed by the press plate on the work table.

FIG. 15 to FIG. 25 show another embodiment (Embodiment 2) of the present invention, in which:

FIG. 15 is a front view of a hemstitching apparatus;

FIG. 16 is a plan view of the hemstitching apparatus of FIG. 15 as seen from line 1—1 of FIG. 15;

FIG. 17 is a partial sectional side elevational view of the hemstitching apparatus;

FIG. 18 a plan view of the hemstitching apparatus;

FIG. 19 is a partial front view of a guide rail of the hemstitching apparatus;

FIG. 20 is a partial front view, showing an arrangement of a stopper provided in the guide rail;

FIG. 21 is a partial enlarged view as seen from line 2—2 of FIG. 18;

FIG. 22 is a partial enlarged view as seen from line 3—3 of FIG. 18, (A) showing closure of an inlet of the guide rail with a guide member, and (B) showing opening of the inlet of the guide rail;

FIG. 23 is a schematic plan view, showing a movement of a fabric as pressed by a press plate on a work table;

FIG. 24 is a schematic plan view, showing a relative positioning of a stopper piston, press plate, turn device and fabric; and FIG. 25 is a partial schematic view, showing an arrangement of the hemstitching apparatus.

FIG. 26 to FIG. 51 show another embodiment (Embodiment 3) of the present invention, in which:

FIG. 26 is a front view of a hemstitching apparatus;

FIG. 27 is a schematic plan view of the hemstitching apparatus of FIG. 26;

FIG. 28 is a right side elevational view of the hemstitching apparatus;

FIG. 29 is a schematic plan view, showing a positional relationship of a turn device, guide beam, drive device and bar cylinder for a transport plate;

FIG. 30 is a schematic side elevational view, showing a relationship between the transport plate and a plate elevator;

FIG. 31 is a partial front view, showing a state of the guide rail;

FIG. 32 is a plan view, showing a relationship between the guide rail and a rail driver;

FIG. 33 is a right side elevational view of the hemstitching apparatus;

FIG. 34 is a partial enlarged sectional view seen from line 4—4 of FIG. 31;

FIG. 35 is a partial enlarged sectional view, showing an arrangement of an outlet provided on the guide rail;

FIG. 36 is a partial enlarged sectional view, showing an inlet provided on the guide rail, (A) showing entry of a guide roller and (B) showing the guide roller introduced on a guide channel;

FIG. 37 is a partially sectioned front view, showing mounting arrangements of a press plate and a turn device on a shaft;

FIG. 38 is a partially sectioned side elevational view, showing an arrangement of a shaft system;

FIG. 39 is a schematic side elevational view, showing a positional relationship between the guide channel of the guide rail and a needle;

FIG. 40 is a plan view of the turn device, showing a positional relationship between a fabric and the turn plate;

FIG. 41 shows press legs and the turn device held by the press legs, (A) being a partially sectioned side elevational view and (B) being a plan view;

FIG. 42 shows the turn device as freed from the press legs, (A) being a partially sectioned side elevational view and (B) being a partial plan view;

FIG. 43 is a partial front view, showing a product carrier;

FIG. 44 is a partial plan view, showing a positional relationship between the product carrier and a machine frame;

FIG. 45 is a schematic plan view, showing a movement of the turn device relative to the guide rail;

FIG. 46 is a plan view, showing a positional relationship between the turn device and a fabric;

FIG. 47 is a partial plan view, showing how a fabric is positioned for a corner treatment by means of the press plate;

FIG. 48 is a partial plan view, showing a positional relationship between the turn device and a fabric for a round corner treatment;

FIG. 49 is a partial plan view, showing a movement of the press plate with a fabric under the press plate;

FIG. 50 shows examples of square corner treatments and round corner treatments; and FIG. 51 shows other exemplary fabric product configurations.

FIGS. 52 and 53 show prior art, in which:

FIG. 52 is a plan view of a prior art hemstitching apparatus; and

FIG. 53 shows another prior art hemstitching apparatus, (A) being a front view of the hemstitching apparatus, (B) being an enlarged plan view of a cam member, and (C) being a plan view, showing a fabric edge treatment.

DESCRIPTION OF THE PREFERRED EMBODIMENTS

Embodiments 1, 2 and 3

Embodiments 1, 2 and 3 are described in the following. FIGS. 1–14 correspond Embodiment 1, FIGS. 15–25 correspond Embodiment 2, and FIGS. 26–49 correspond Embodiment 3.

Embodiment 1

Figure 1:
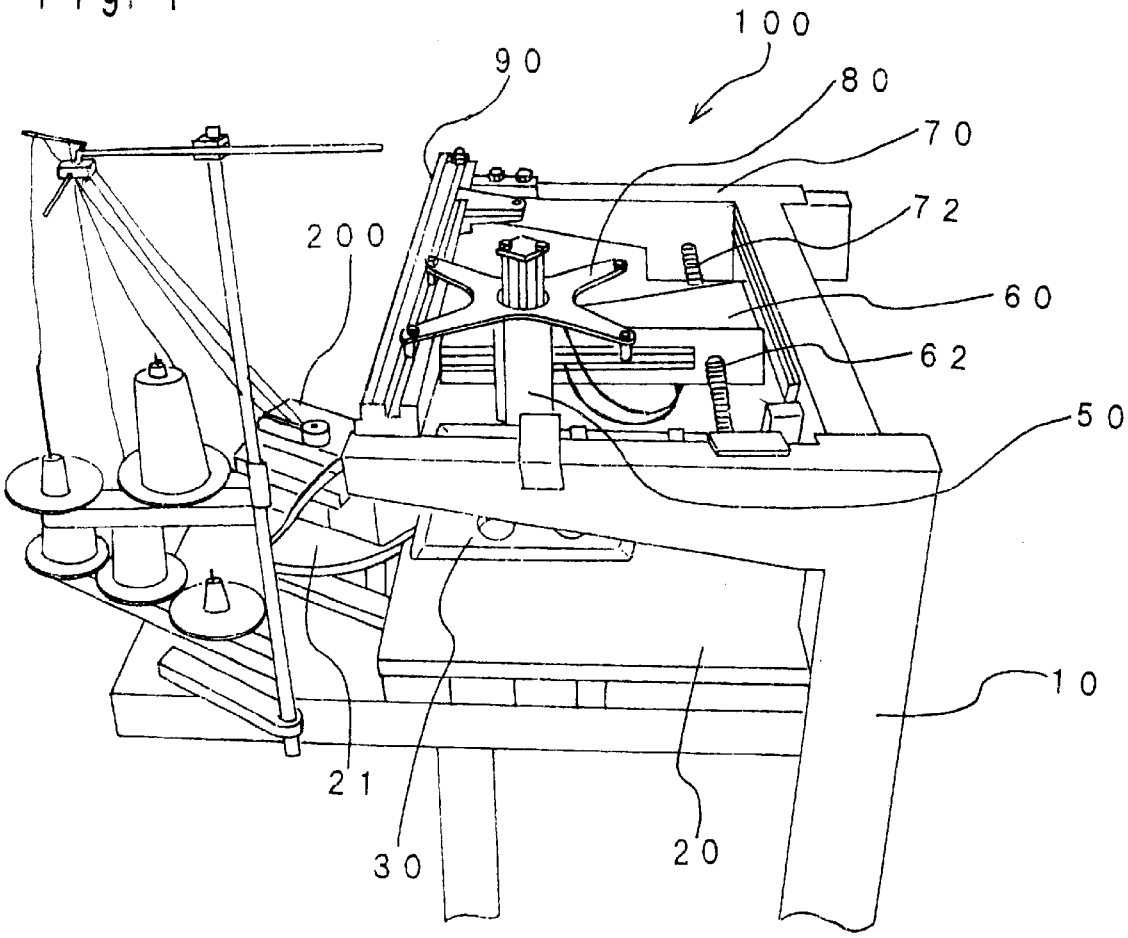
Figure 2:
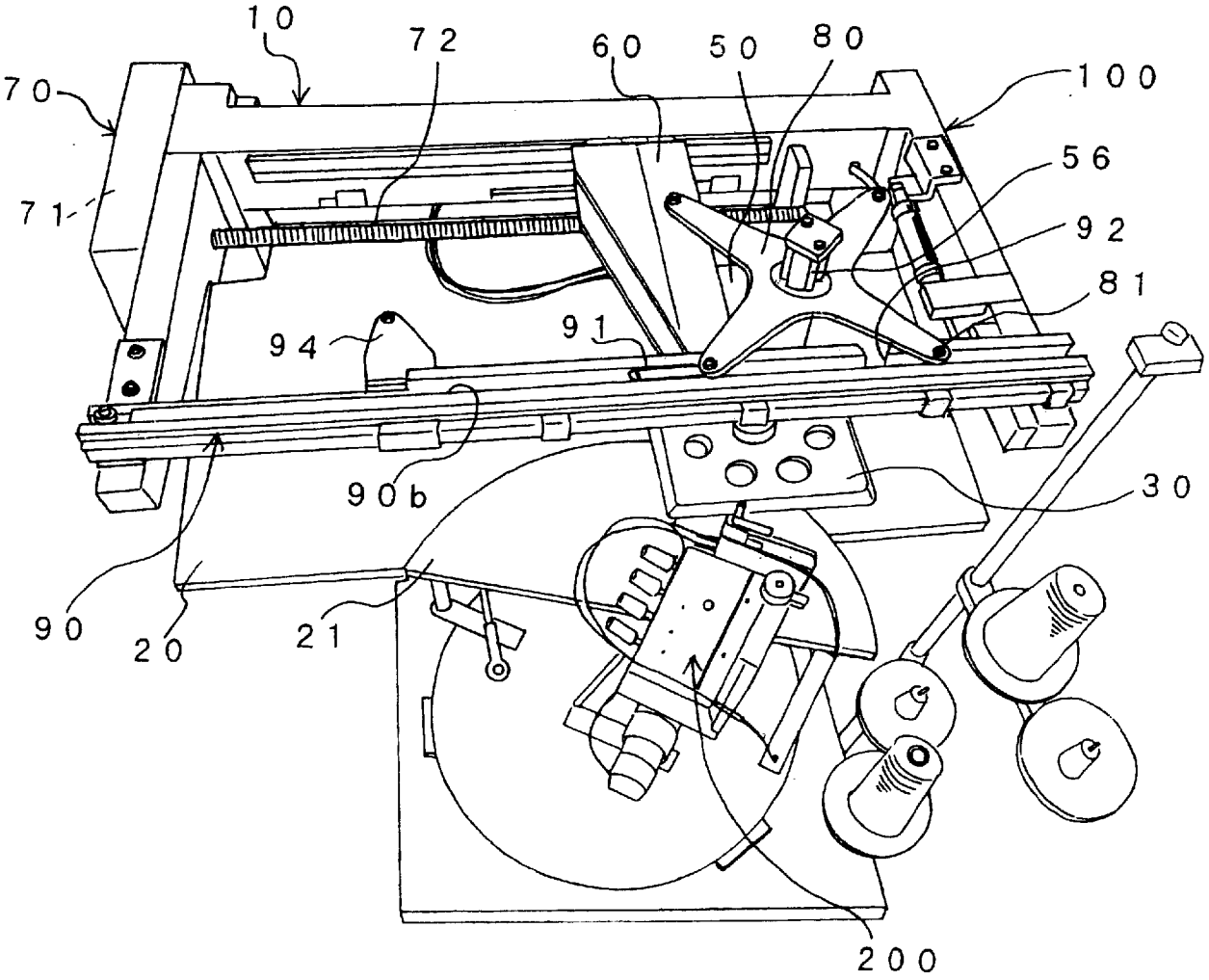

A hemstitching apparatus 100 according to an embodiment of the present invention is shown in FIGS. 1 and 2. FIG. 1 is a perspective view of the apparatus 100 seen from the fabric product take-out side, and FIG. 2 is a perspective view of the apparatus 100 seen from above a sewing device 200. This apparatus 100 is provided with a work table 20 held by a machine frame 10 for mounting a fabric material W, a press plate 30 which presses the fabric W on the work table 20 and is configured substantially similar to a fabric product, and a sewing device 200 to treat edges of the fabric W as pressed with the press plate 30. The fabric W enters the apparatus 100 from the left side of the apparatus 100 onto the work table 20 (FIG. 2). The fabric product W comes out of the apparatus 100 from the right side after edge and corner treatments (sewing and cutting) with the sewing device 200 having a needle 210 and a scissors device 211.

Figure 3:
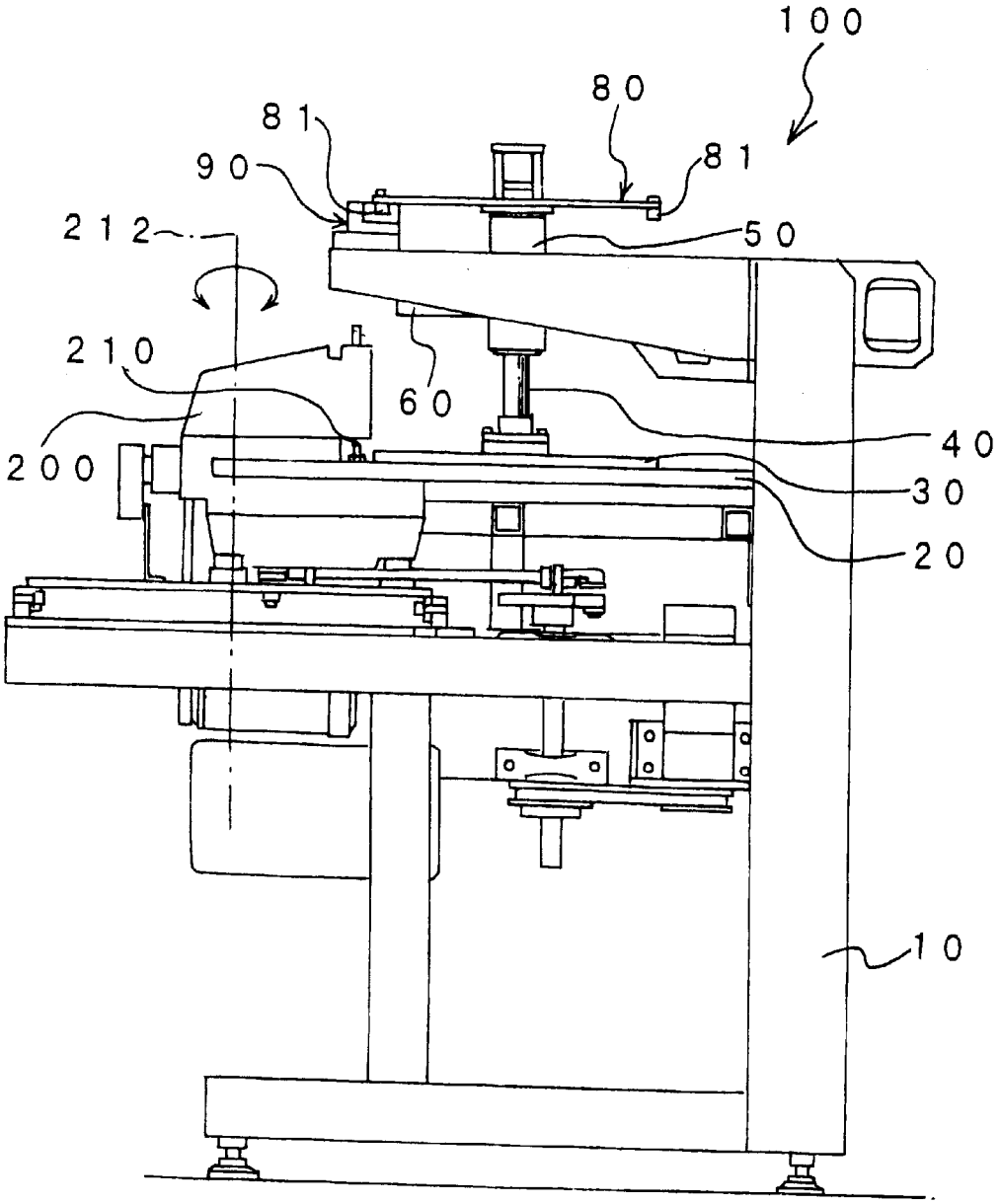

The work table 20 is held horizontally on the frame 10 which forms an overall framework of the apparatus 100. A sewing table 21 mounting the sewing device 200 is provided such that the sewing table 21 can turn horizontally as shown in FIG. 2. The turn center 212 of the sewing table 21 is positioned as shown in FIG. 3 and the needle 210 turns as shown by a triangle in FIG. 14(B).

Figure 6:
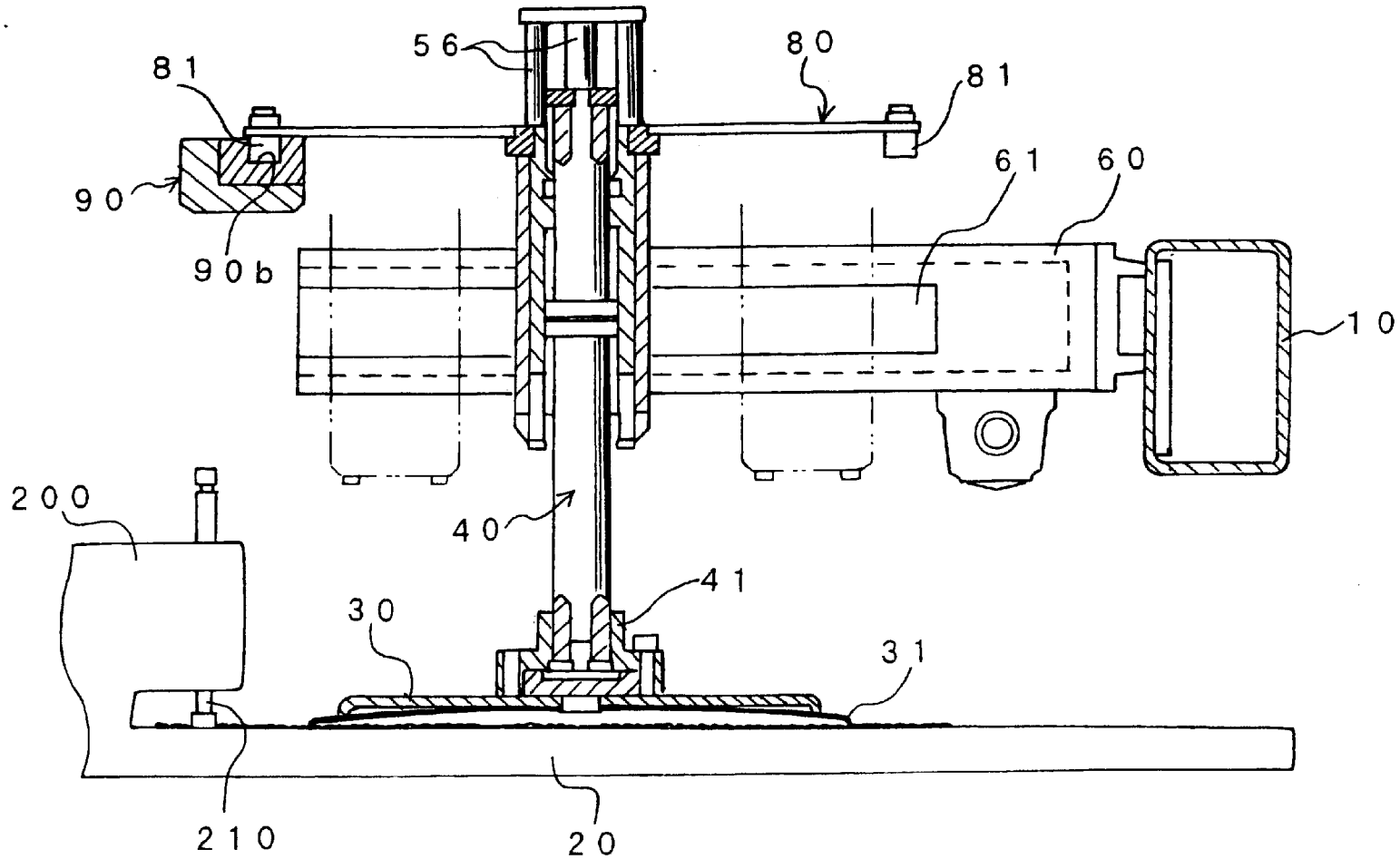
Figure 9:
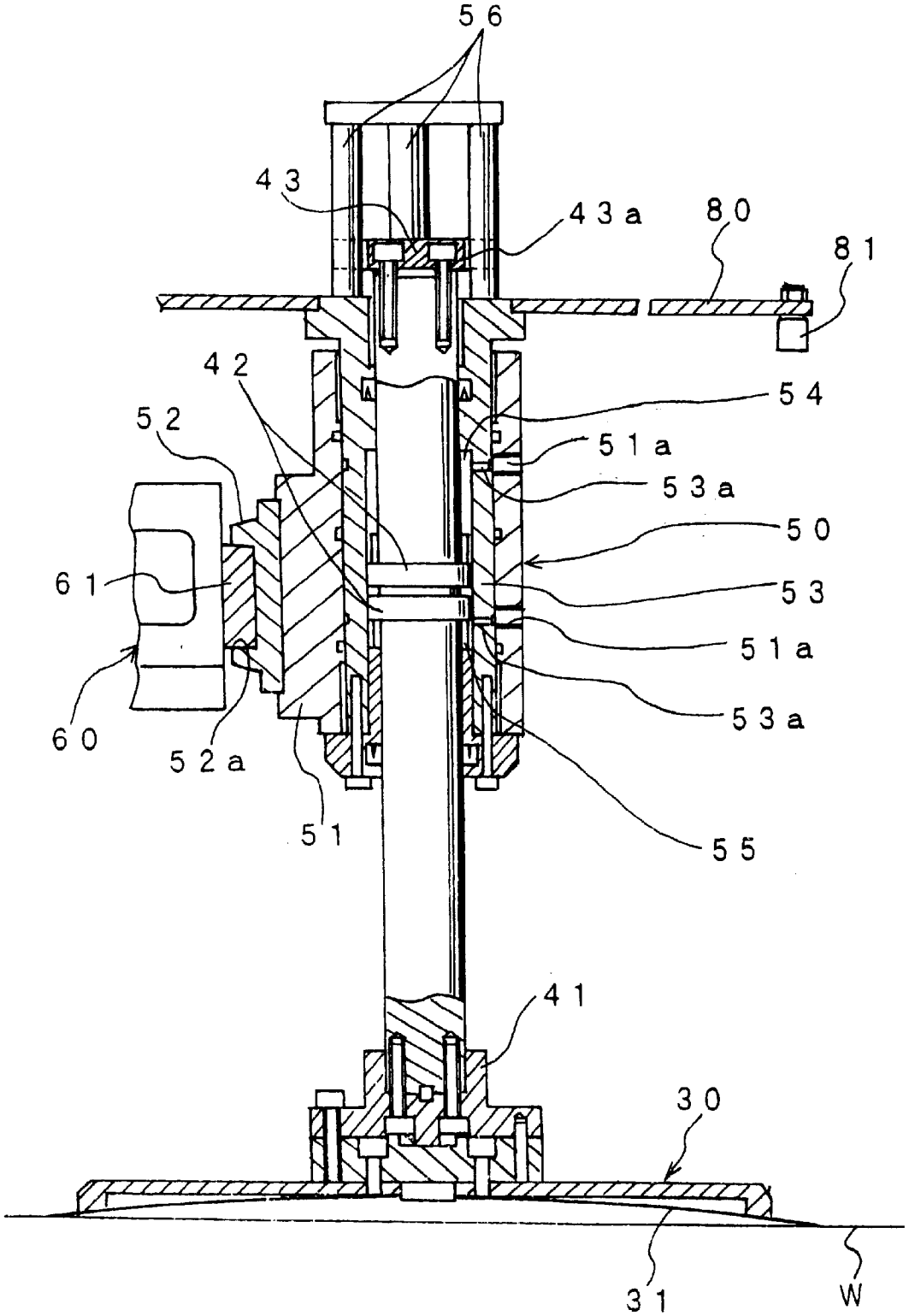
Figure 51:
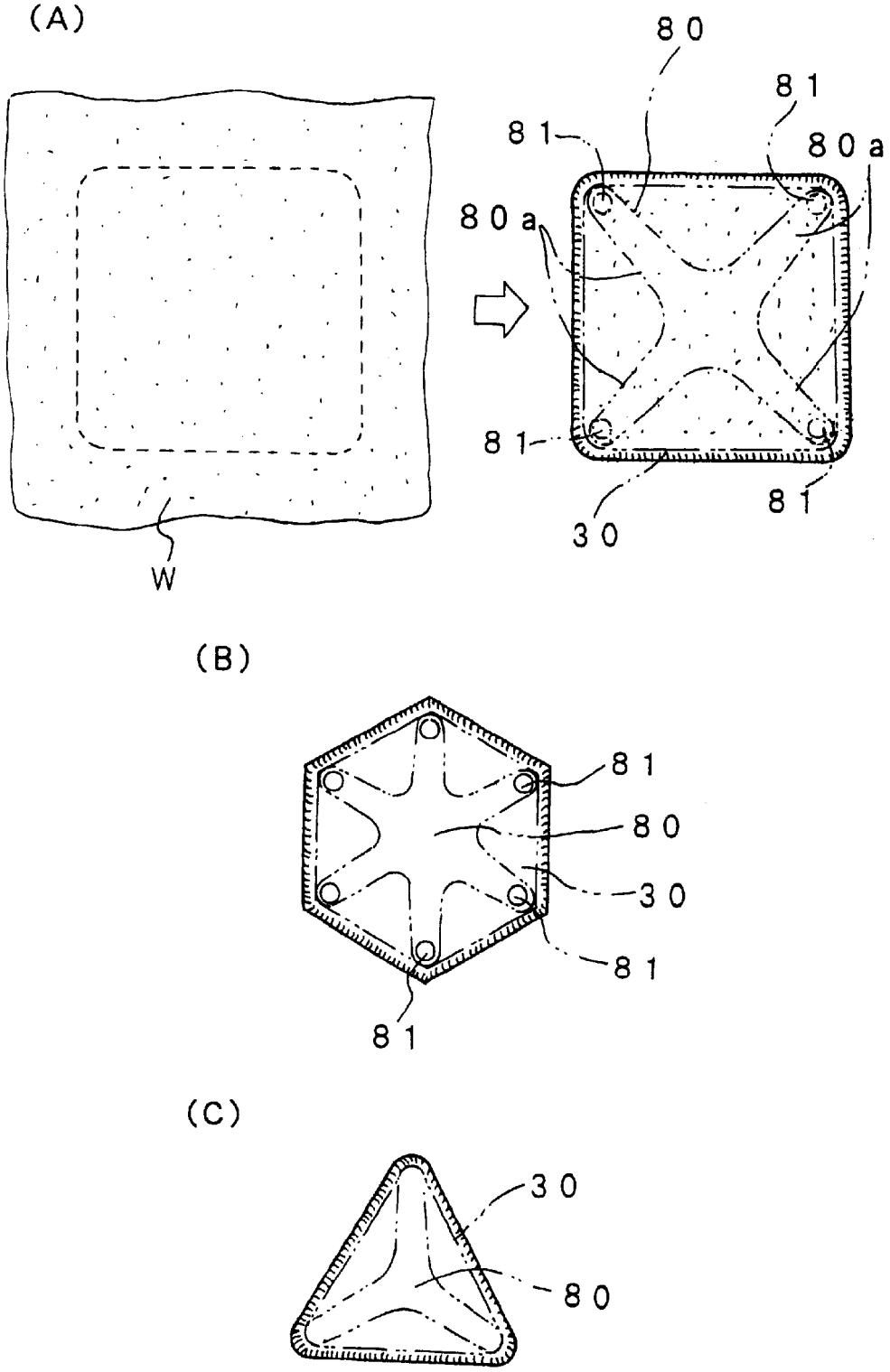
Figure 52:
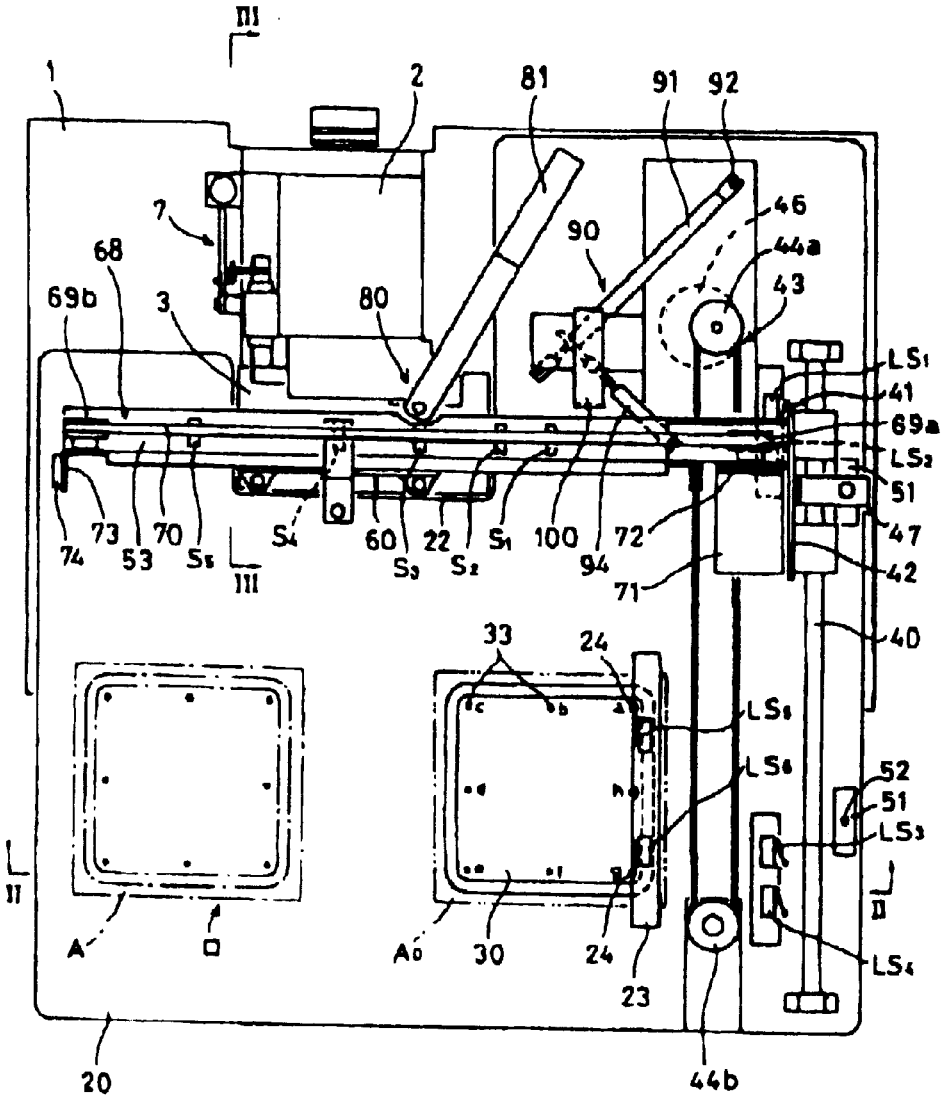
Figure 53:
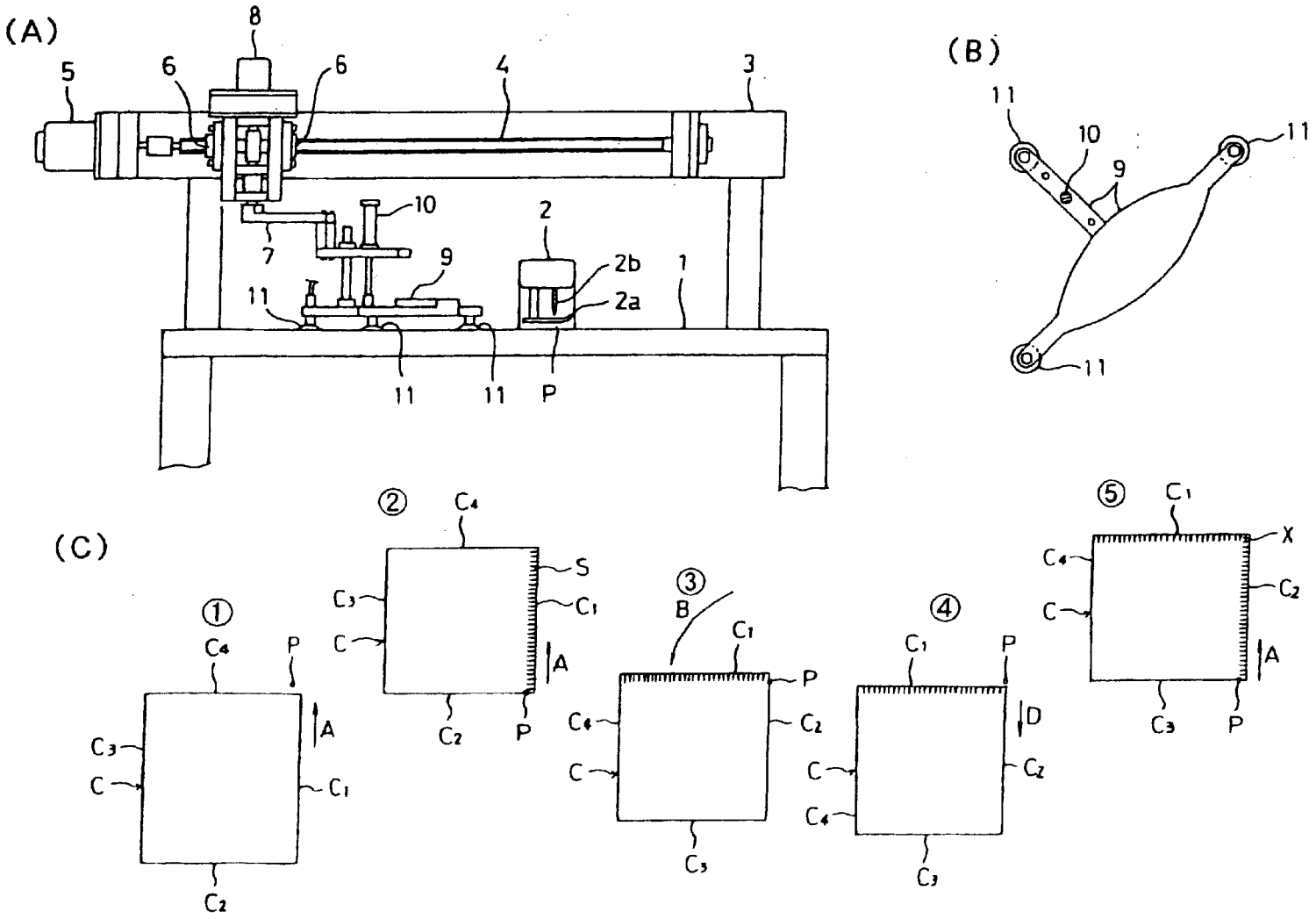

The press plate 30 which presses the fabric W on the work table 20 is configured as sectionally shown in FIGS. 6 and 9. The press plate 30 is dimensioned and presses the fabric W such that the edge portions of the fabric W protrude from the edges of the press plate 30 to be treated (locked and cut) by the sewing device 200. The press plate 30 takes a configuration which is slightly "smaller" than and similar in configuration to fabric products to be produced as shown in FIG. 51.

The configuration of the press plate 30 may be those shown in FIG. 51(A), 51(B) and 51(C). As described earlier, the press plate 30 takes a shape of subject fabric products but slightly smaller.

Figure 5:
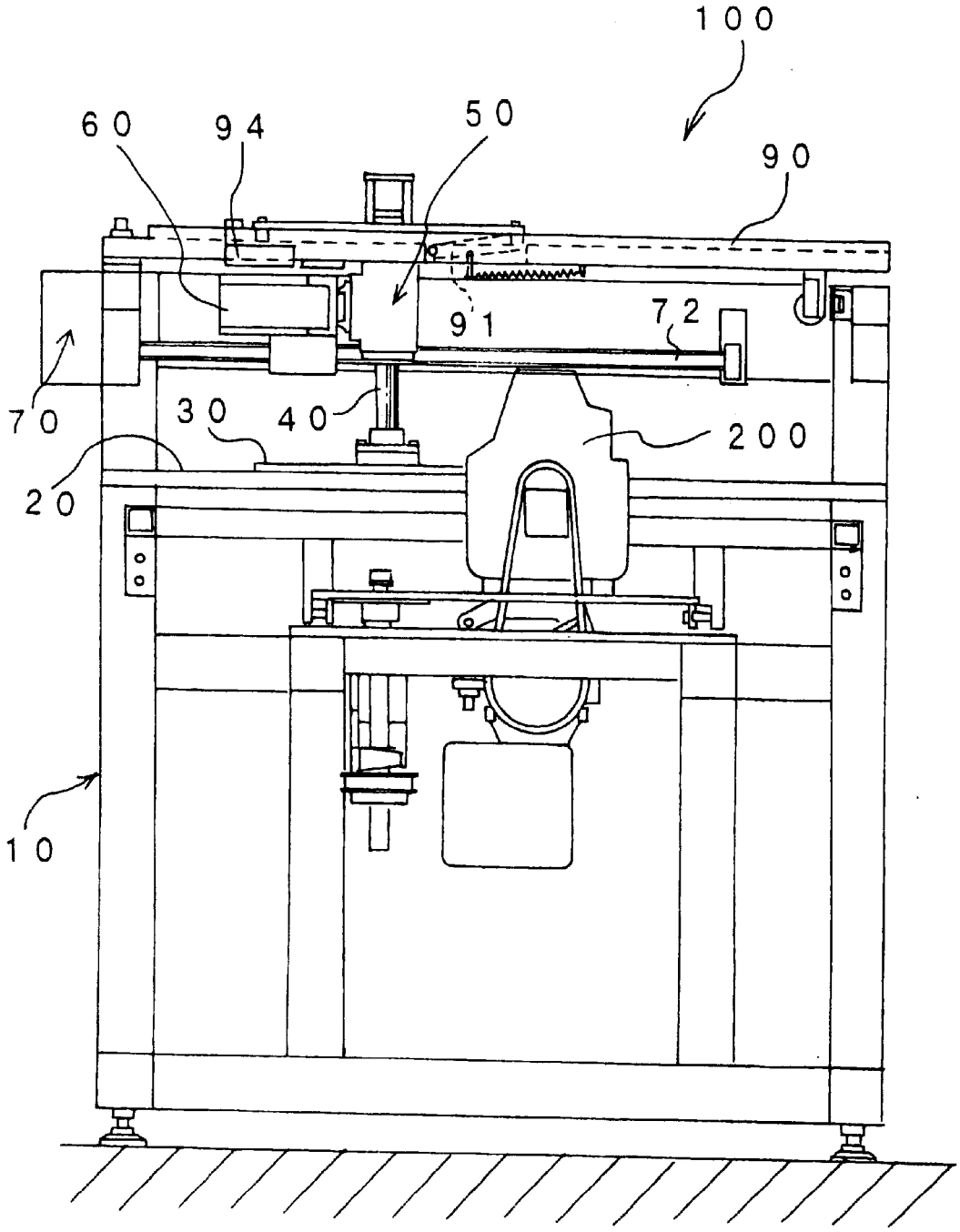

The press plate 30 is attached at the lower end of a shaft 40 as shown in FIGS. 5, 6 and 9. The shaft 40 is mounted on a guide beam 60 by means of a support device 50. The shaft 40 is provided with a press plate attachment 41 which detachably holds the press plate 30. The shaft 40 has on its upper end a coupling guide 43 having four grooves 43*a* in this embodiment on its side wall. The shaft 40 is provided with a piston portion 42 on its center portion as shown in FIG. 9. The shaft 40 functions as a piston within the support device 50.

The support device 50 includes a support cylinder 51 to be shifted horizontally by means of the guide beam 60, a cylinder member 53 which is turnably mounted within the support cylinder 51 and slidably holds the shaft 40 therein, pressure chambers 54 and 55 provided between the cylinder member 53 and the shaft 40, and fluid ports 51*a* and 53*a* to control the pressure of the chambers 54 and 55.

The support device 50 is horizontally shiftably held on the guide beam 60 by means of a guide block 52 which is provided as part of the support cylinder 51 as shown in FIG. 9. The horizontally elongated guide block 52 is provided with a horizontally elongated guide recess 52*a* on the guide block 52. A driver rail 61 is slidably mounted on the guide recess 52*a*. The support device 50 is shiftable relative to the driver rail 61 of the guide beam 60 as shown in FIG. 6.

Two fluid ports 51*a* and two corresponding port paths 53*a* are provided in the support cylinder 51 and the cylinder member 53, respectively as shown in FIG. 9. The fluid ports 51*a* and the port paths 53*a* are respectively paired in communication as shown in FIG. 9. The port paths 53*a* communicate with the first chamber 54 and the second chamber 55 respectively. Each fluid port 51*a* is connected with a fluid hose (not shown) for pressure supply.

A turn device 80 is horizontally provided on the upper end of the cylinder member 53 as shown in FIGS. 6 and 9. The upper end of the cylinder member 53 is also provided with a plurality of guide columns 56 which engage with the grooves 43*a* provided on the coupling guide 43. The guide columns 56 hold the shaft 40 such that the shaft 40 cannot turn relative to the cylinder member 53 but can slide vertically relative to the cylinder member 53.

Figure 4:
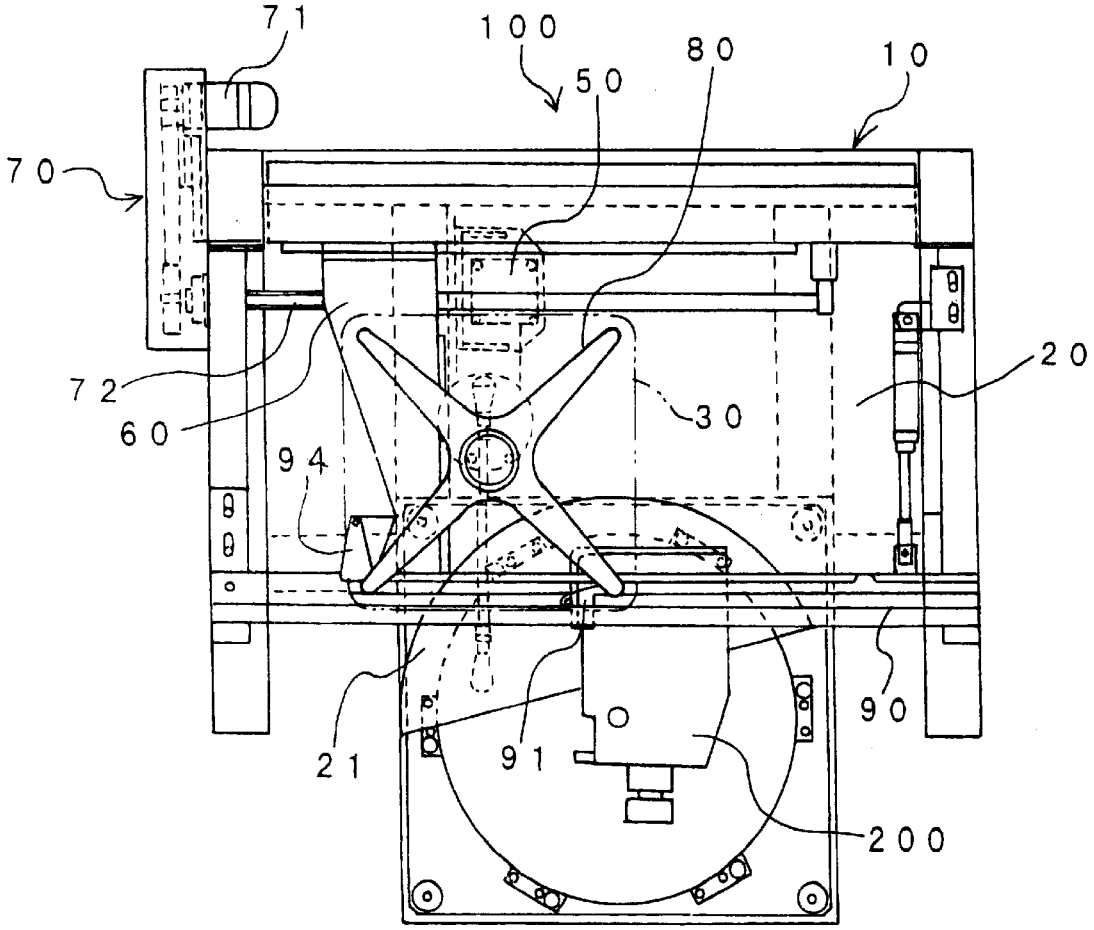

The guide beam 60 is mounted on the frame 10 as shown in FIGS. 2 and 4. The guide beam 60 can move in the fabric feeding direction by means of the driver rail 61 which extends in the cross-machine direction. The driving power of the guide beam 60 is provided by a drive device 70 installed on the frame 10.

The drive device 70 is powered by a drive motor 71. The power provided by the drive motor 71 is transmitted to a borescrew 72 by means of a gear device (not shown). The borescrew 72 is engaged with a borescrew receiver 62 formed on the guide beam 60. The turning of the borescrew 72 shifts the guide beam 60 forward and backward.

The drive device 70 may be an NC device. However, as explained earlier, it takes a considerable time to properly set such a drive device for each fabric product. Therefore, it is more advantageous to control the drive device 70 using appropriate cams. In an embodiment of the present invention, the drive device 70 includes an elongated guide rail 90 mounting a plurality of turn devices 80 thereon, and a single drive motor 71 to control all these turn devices 80.

Figure 7:
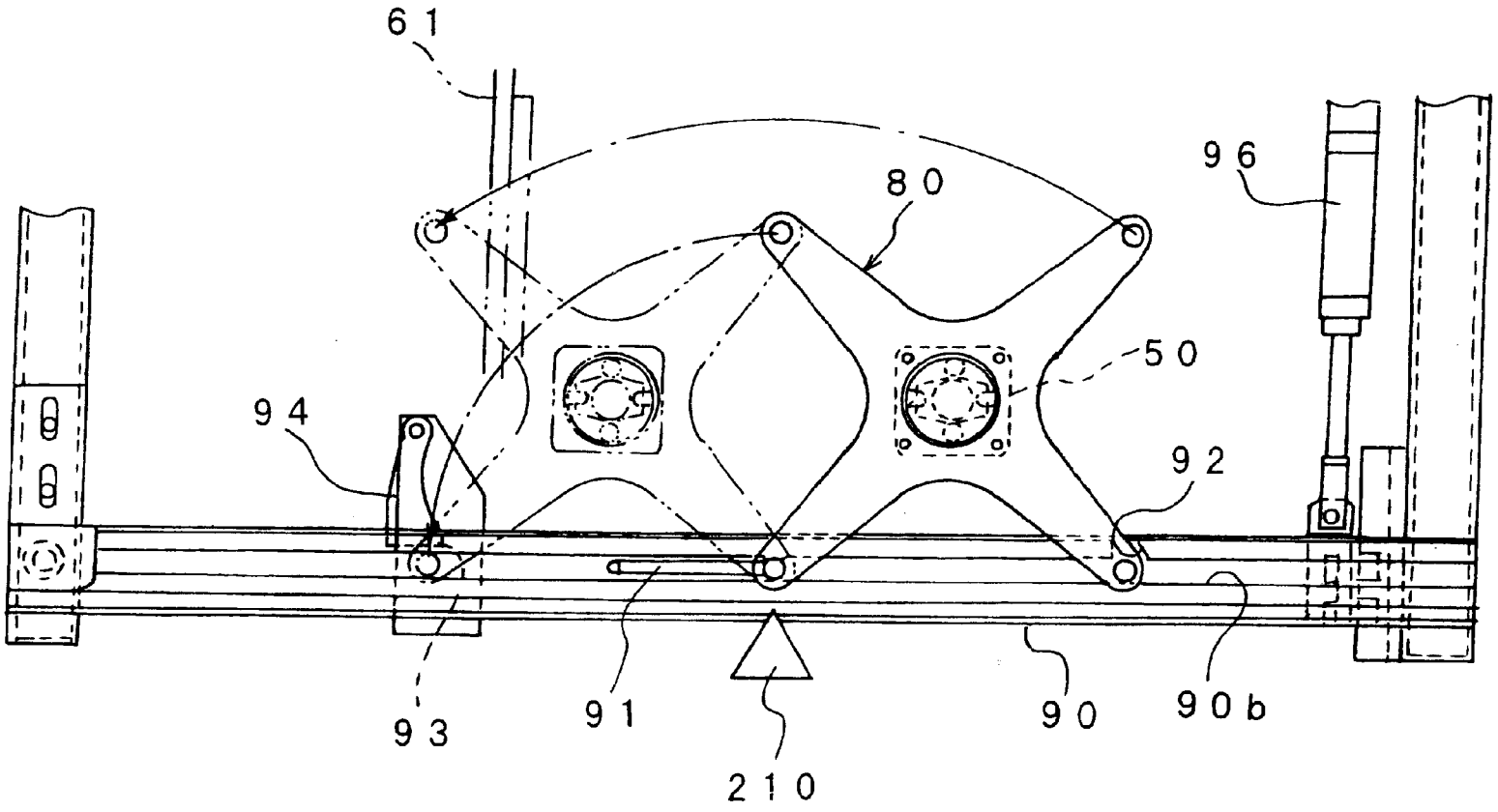
Figure 10:
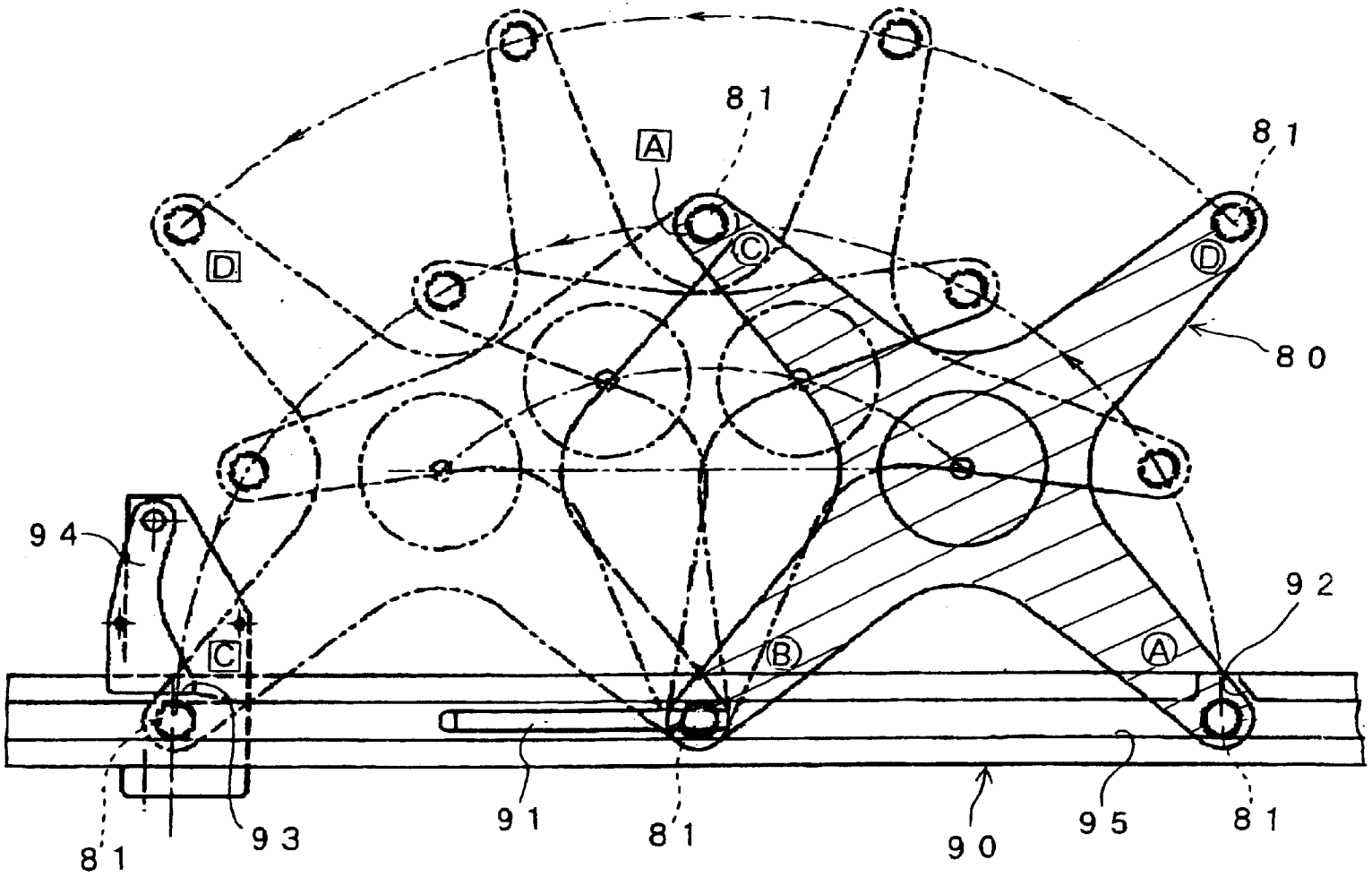
Figure 11:
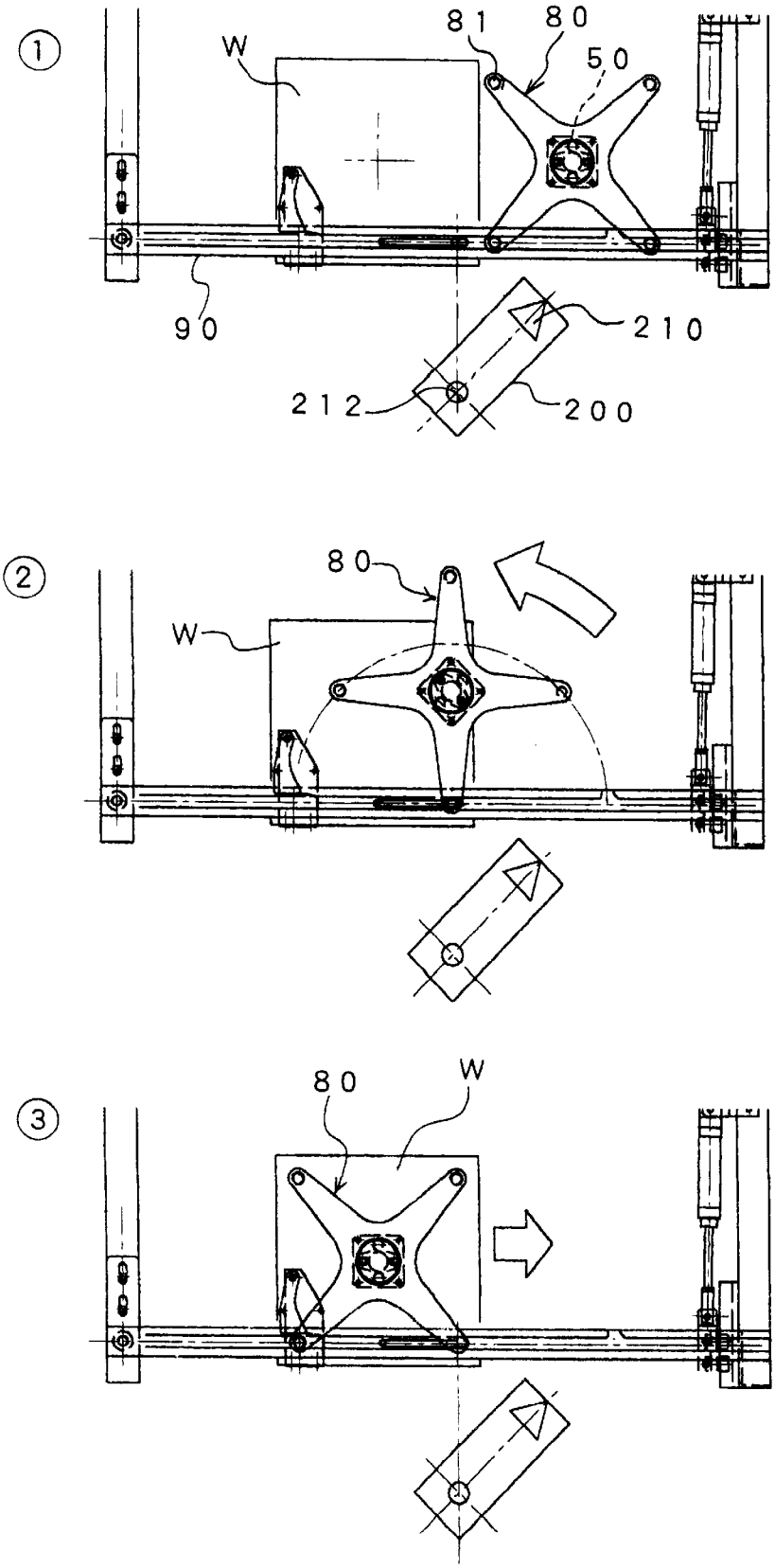
Figure 12:
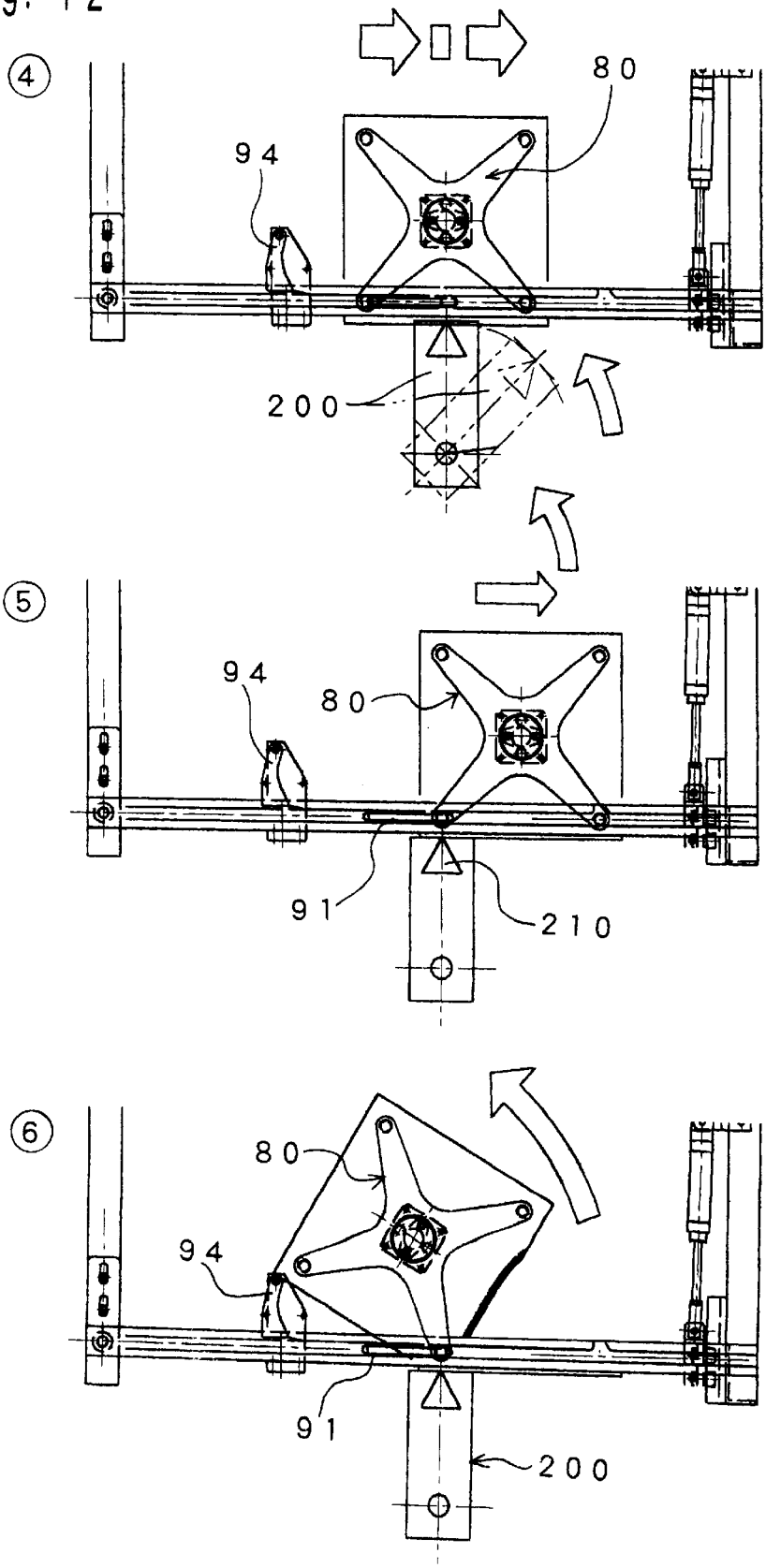

The turn device 80 detachably mounted on the cylinder member 53 has arms 80*a* corresponding to the corners of a fabric product as shown in FIGS. 7 and 10. Each arm 80*a* has a guide roller 81 on its end portion. These guide rollers 81 are respectively introduced into a guide channel 90*b* of a guide rail 90. As mentioned earlier, the overall configuration of the turn device 80 corresponds to the configuration of fabric products.

Figure 8:
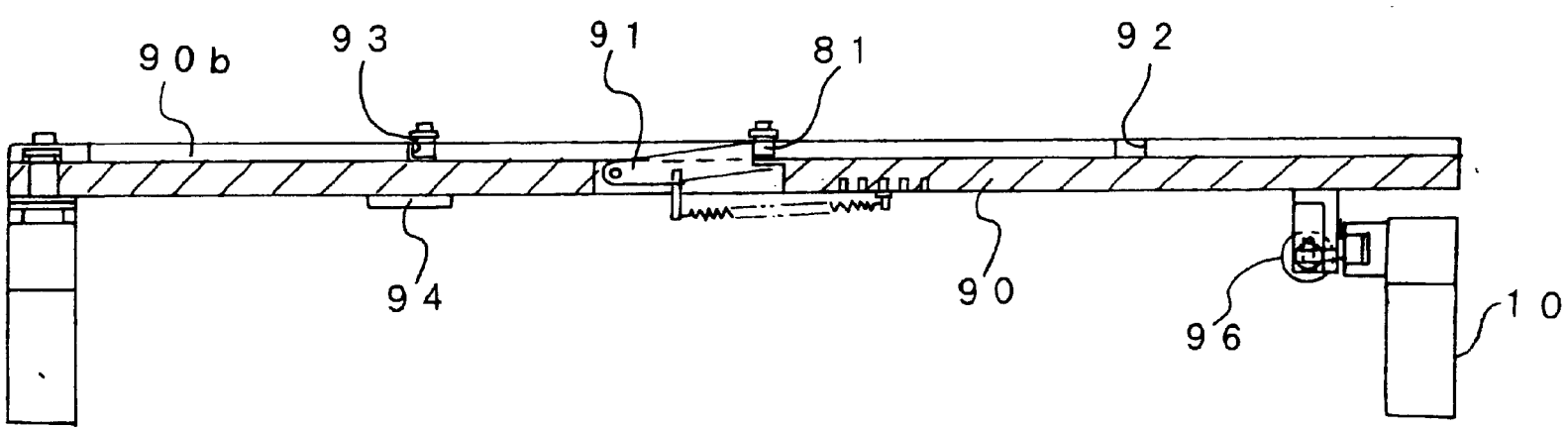

The guide rail 90 as shown in FIGS. 2, 7 and 8 is installed above a needle 210 of the sewing device 200, in which are provided a stopper 91 which restricts a roller 81, an outlet 92 which expels a guide roller 81 at a time from the guide channel 90*b*, and an inlet 93 which introduces a guide roller 81 at a time into the guide channel 90*b*.

Figure 13:
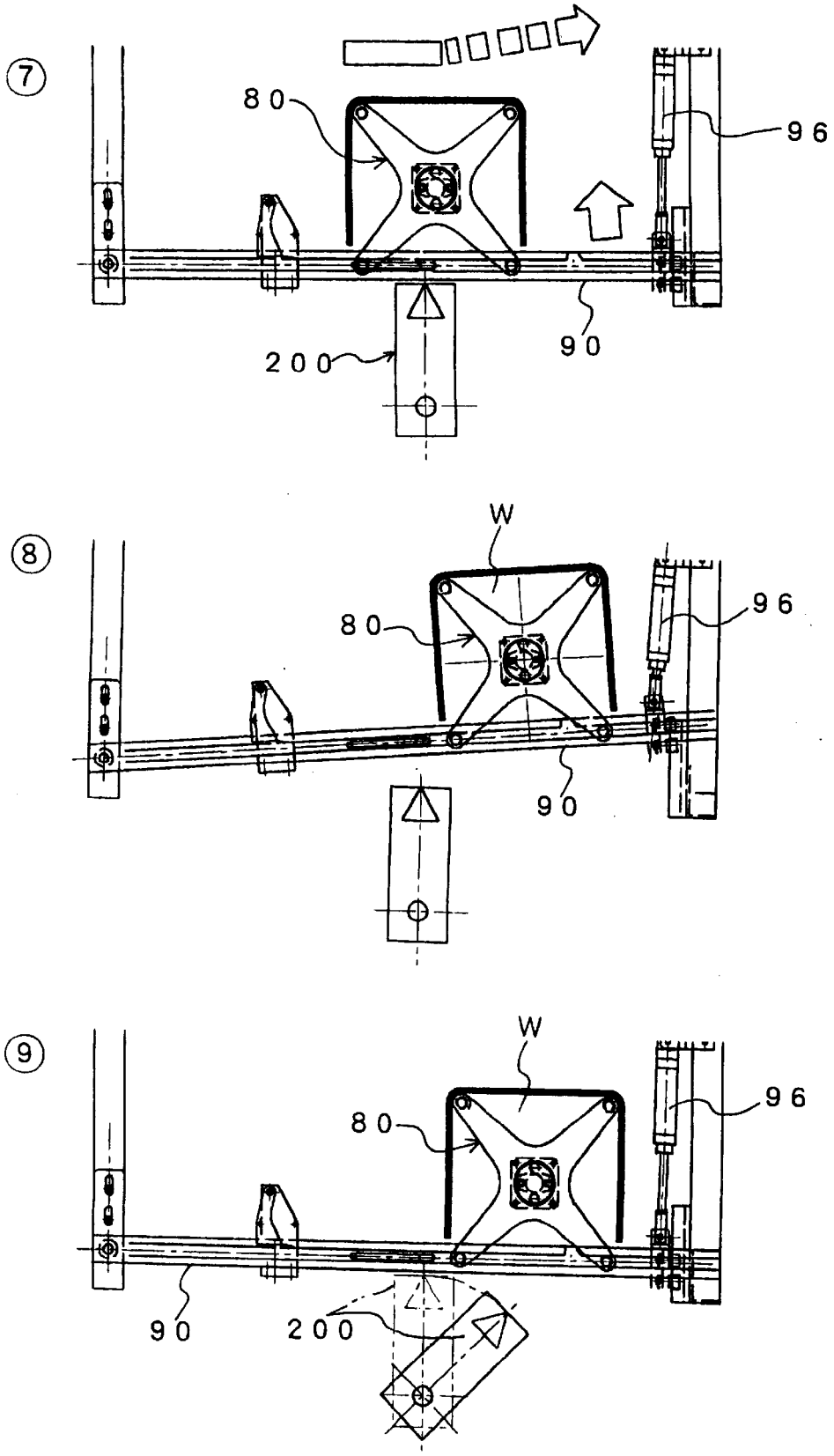
Figure 14:
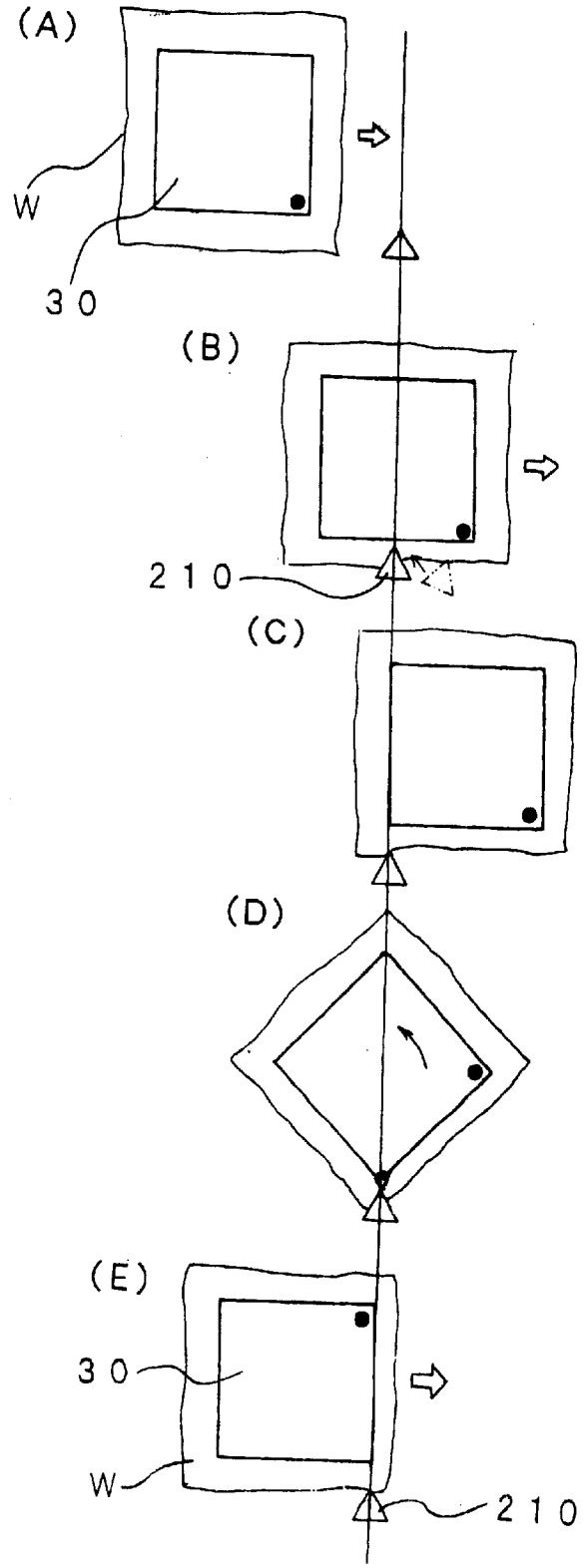

The guide rail 90 is mounted on the frame 10 turnably as shown in FIGS. 2 and 7. The right end of the guide rail 90 is connected to the piston rod of a piston device 96 mounted on the frame 10 (FIG. 7). The guide rail 90 can turn horizontally as shown in FIG. 13-8 and FIG. 13-9.

Embodiment 2

Figure 15:
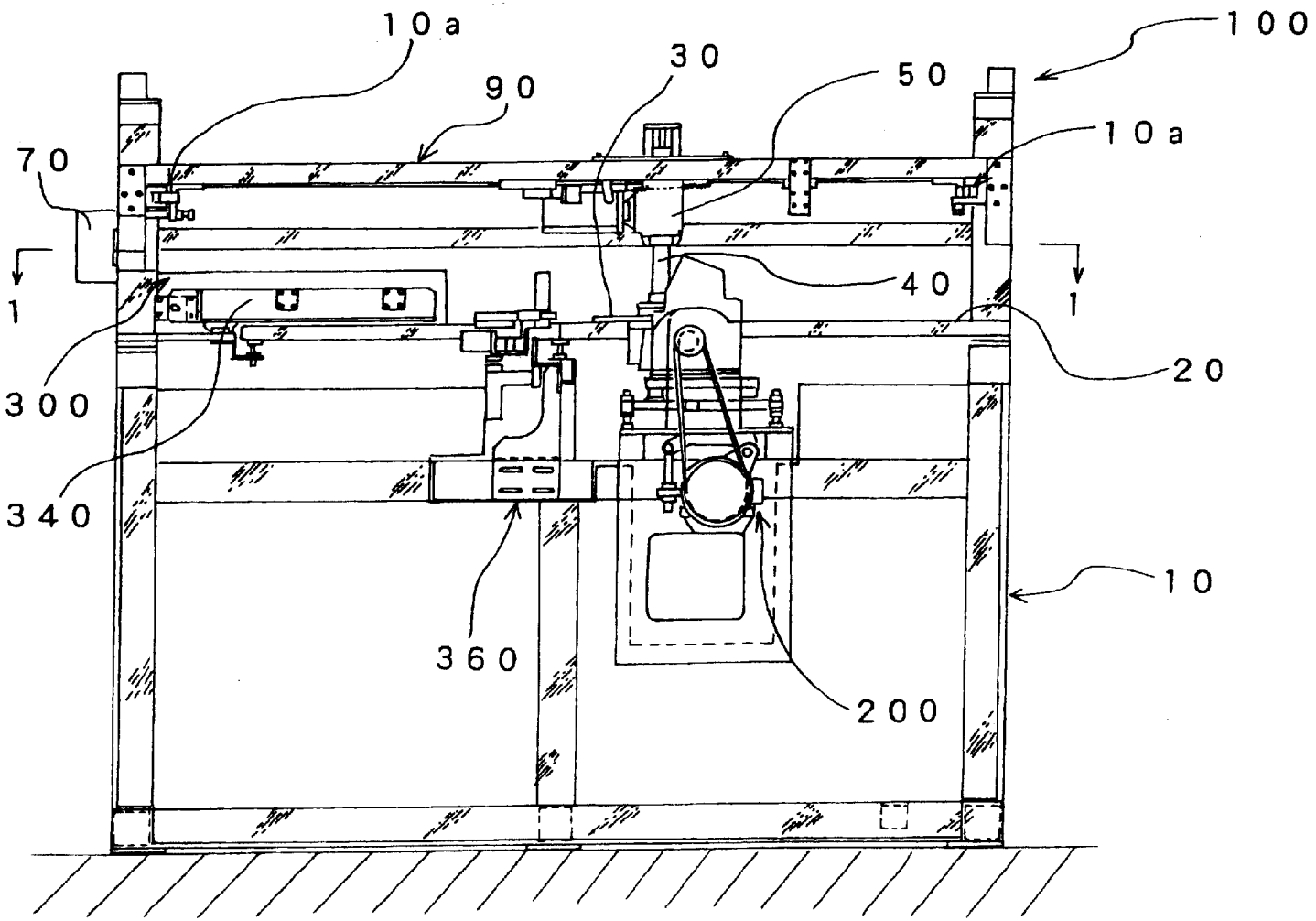
Figure 16:
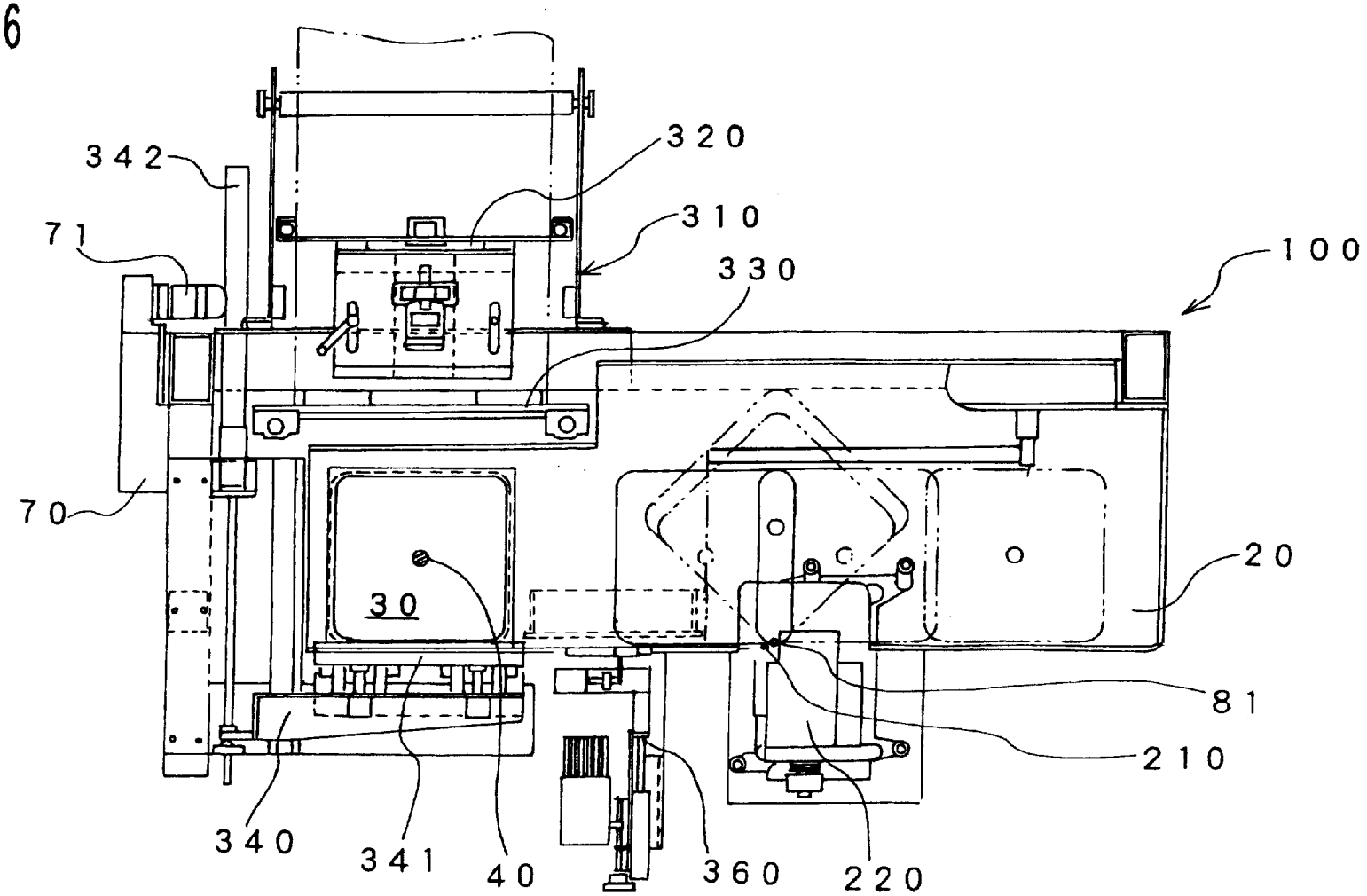
Figure 17:
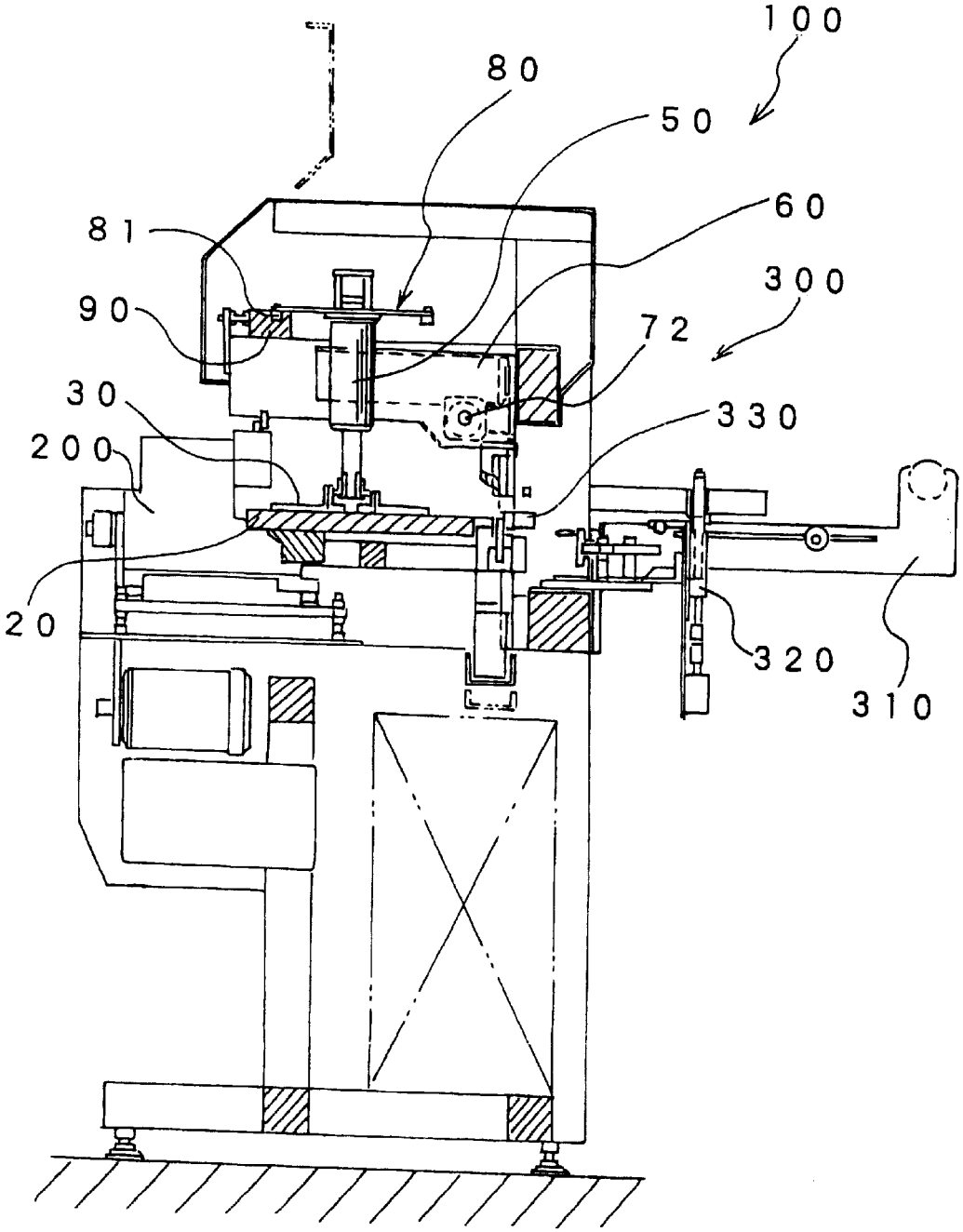

Another hemstitching apparatus 100 is shown in FIGS. 15–25. This apparatus 100 includes, as shown in FIGS. 15 and 17, a work table 20, a press plate 30, and a sewing device 200. A fabric W is carried onto the work table 20 by a cutter device 300 from the left side and sent out from the right side after its hem treatment with a needle 210 of the sewing device 200 and a cutter device (not shown).

Each end of the guide rail 90 is attached to the frame 10 through a safety device 10*a* as shown in FIG. 15, which copes with accidental physical shocks between elements of the apparatus 100. The guide rail 90 is provided with a length which substantially covers the distance between the cutter device 300 and the fabric outing position.

Figure 19:
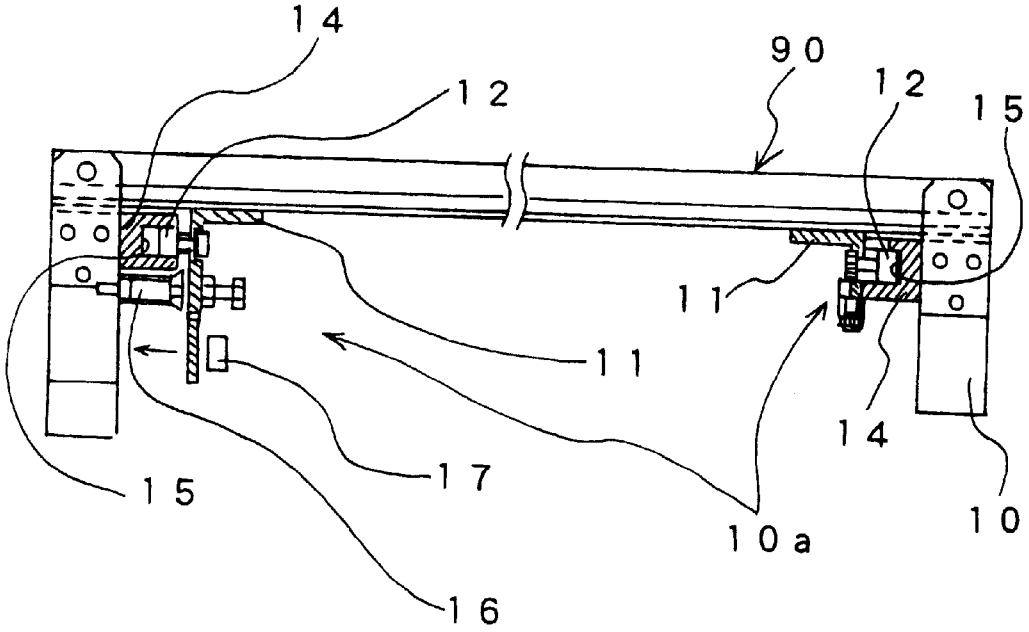

Each safety device 10*a* has a stopper mount 11 attached under the guide rail 90, a cushion stopper 12 attached to the stopper mount 11, and a stopper guide 14, as shown in FIG. 19. In the hemstitching apparatus 100, the guide rail 90 can escape to the left in FIG. 19 when the press plate 30 and/or the turn device 80 malfunctions. The stopper guide 14 on the left has a recess 15 for the cushion stopper 12 to retreat thereinto, while the stopper guide 14 of the safety device 10*a* on the right in FIG. 19 has a recess 15 for the purpose of supporting the cushion stopper 12.

In the safety device 10*a* on the left in FIG. 19, a press spring 16 is provided to absorb shock from the stopper mount 11 when the stopper mount 11 accidentally collides with the press spring 16. A switch 17 is also provided over the stopper mount 11 with a predetermined distance apart to provide a signal when the stopper mount 11 moves off for a predetermined distance therefrom. In response to the signal, the hemstitching apparatus 100 immediately stops all its function.

The sewing device 200 mounted on the work table 20 is provided with a cutter means (not shown) close to the needle 210. The sewing device 200 may also have a tape supply device (not shown) which supplies edge tapes to be sewn onto edges of fabric products.

A label or tag device 360 to supply labels or tags to be attached on edges of fabric products W may also be provided between the cutter device 300 and the sewing device 200 as shown in FIGS. 15–17. Such labels may provide a product name and producer name. The press plate 30 will be lifted from a fabric W such that a label can be inserted and attached on an edge of a fabric W. The label supplied on an edge of the fabric W is sewn thereto at the same time the edge is treated by the sewing device 200.

As repeatedly described, the press plate 30 is made smaller than a fabric product W so that the protruding portions of the fabric W can be treated as shown in FIG. 15. The press plate 30 shown in FIG. 24 has square corners for square-cornered fabrics and the press plate 30 of FIG. 16 has round corners for round-cornered fabrics.

Figure 18:
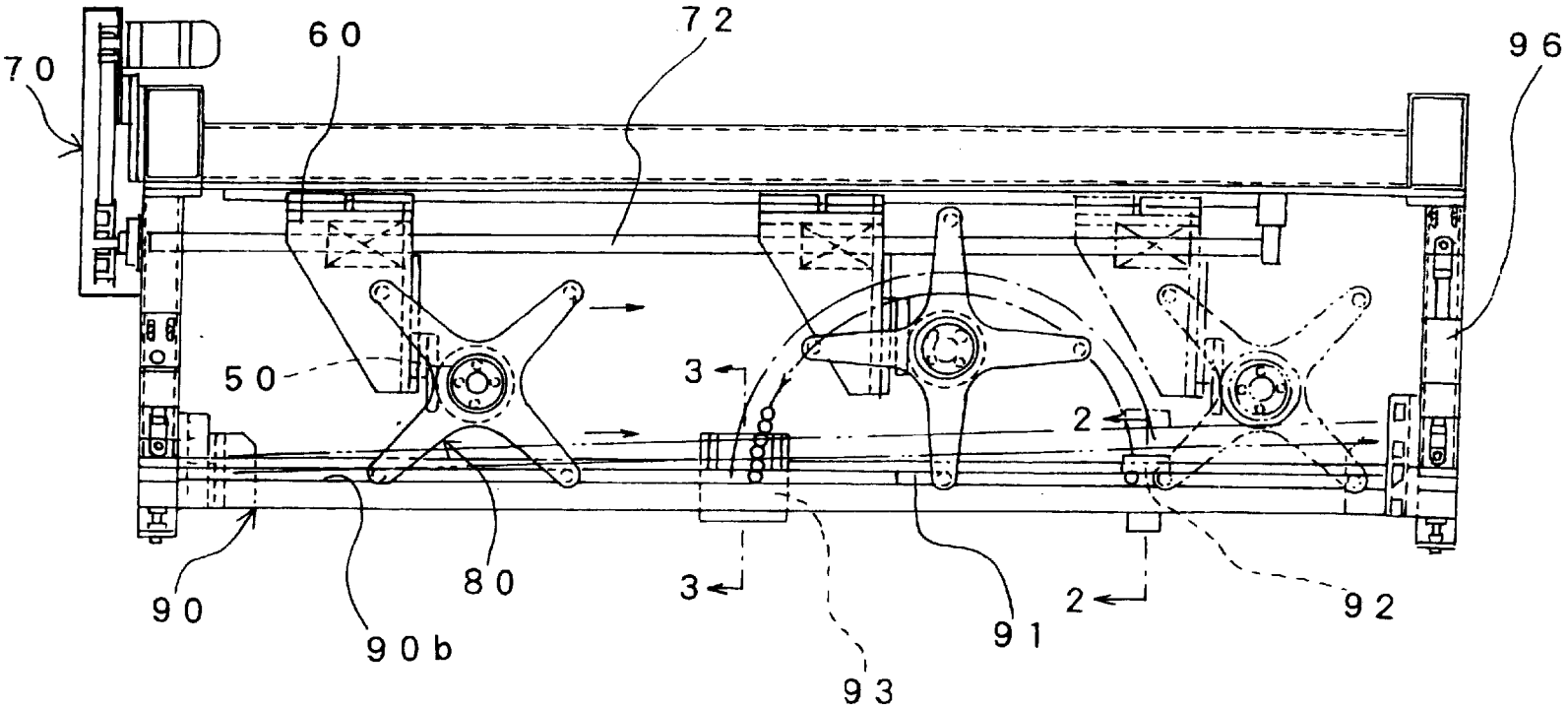
Figure 20:
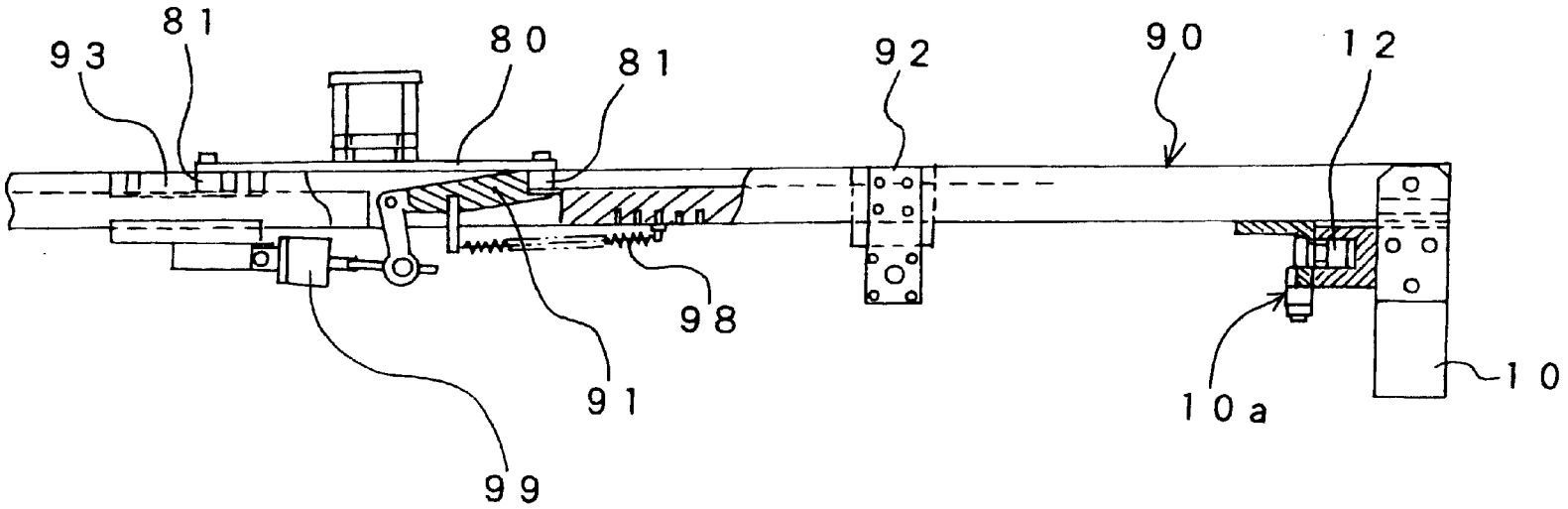
Figure 22:
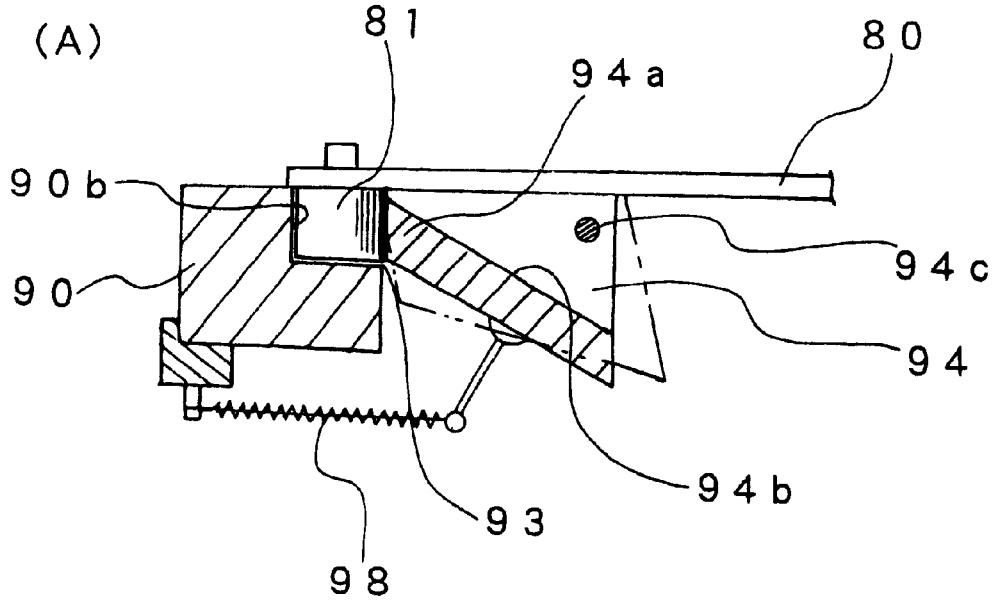
Figure 22:
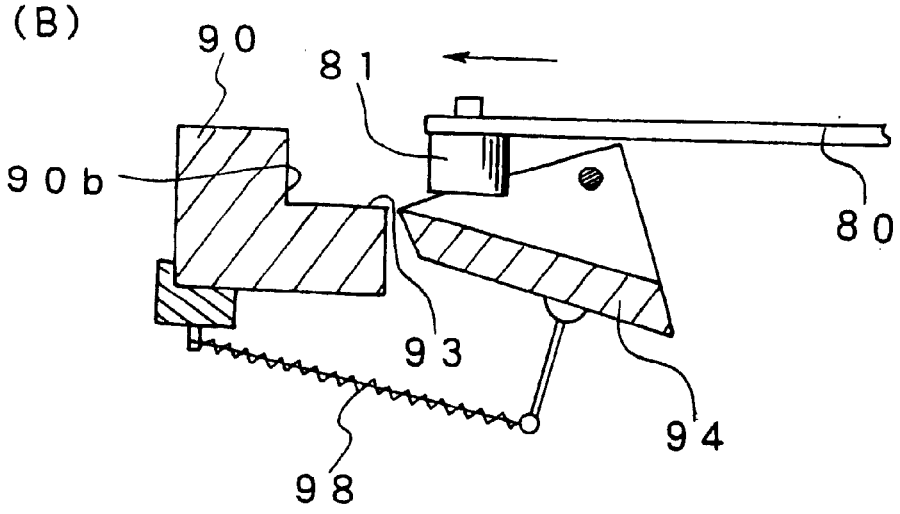
Figure 23:
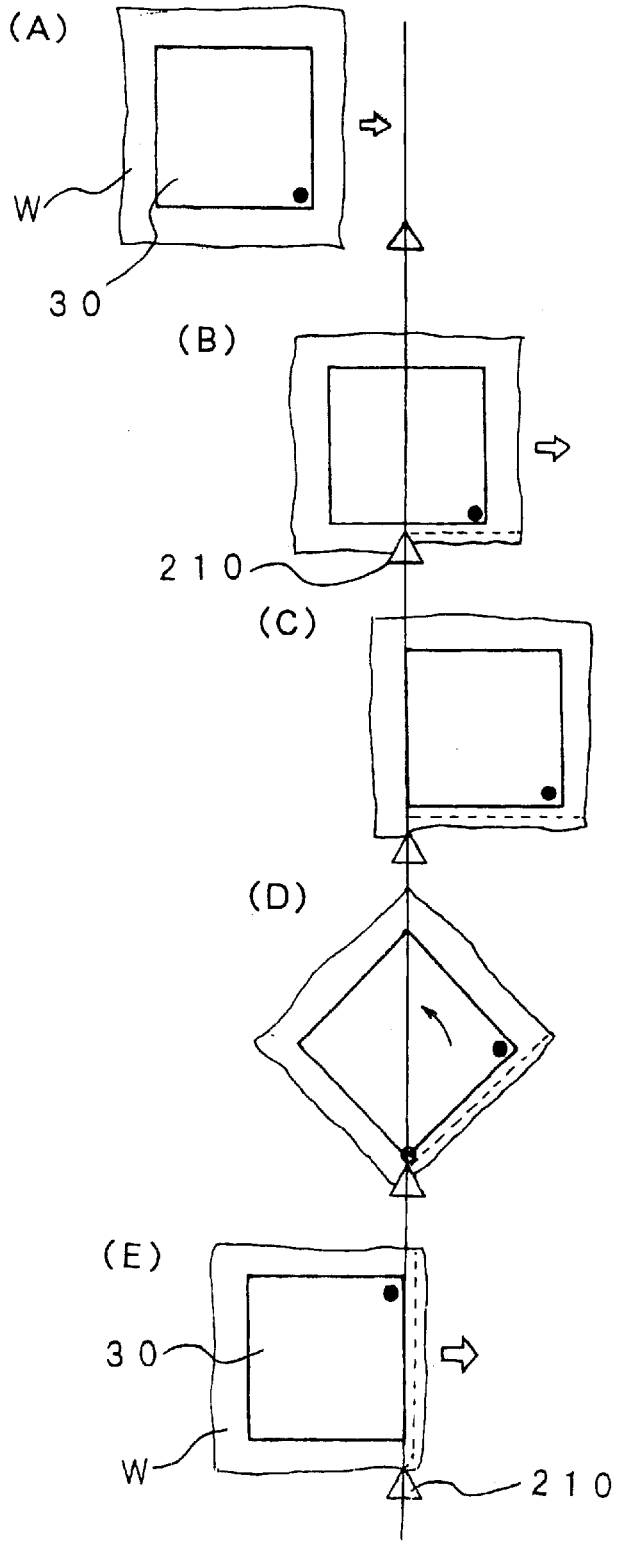
Figure 24:
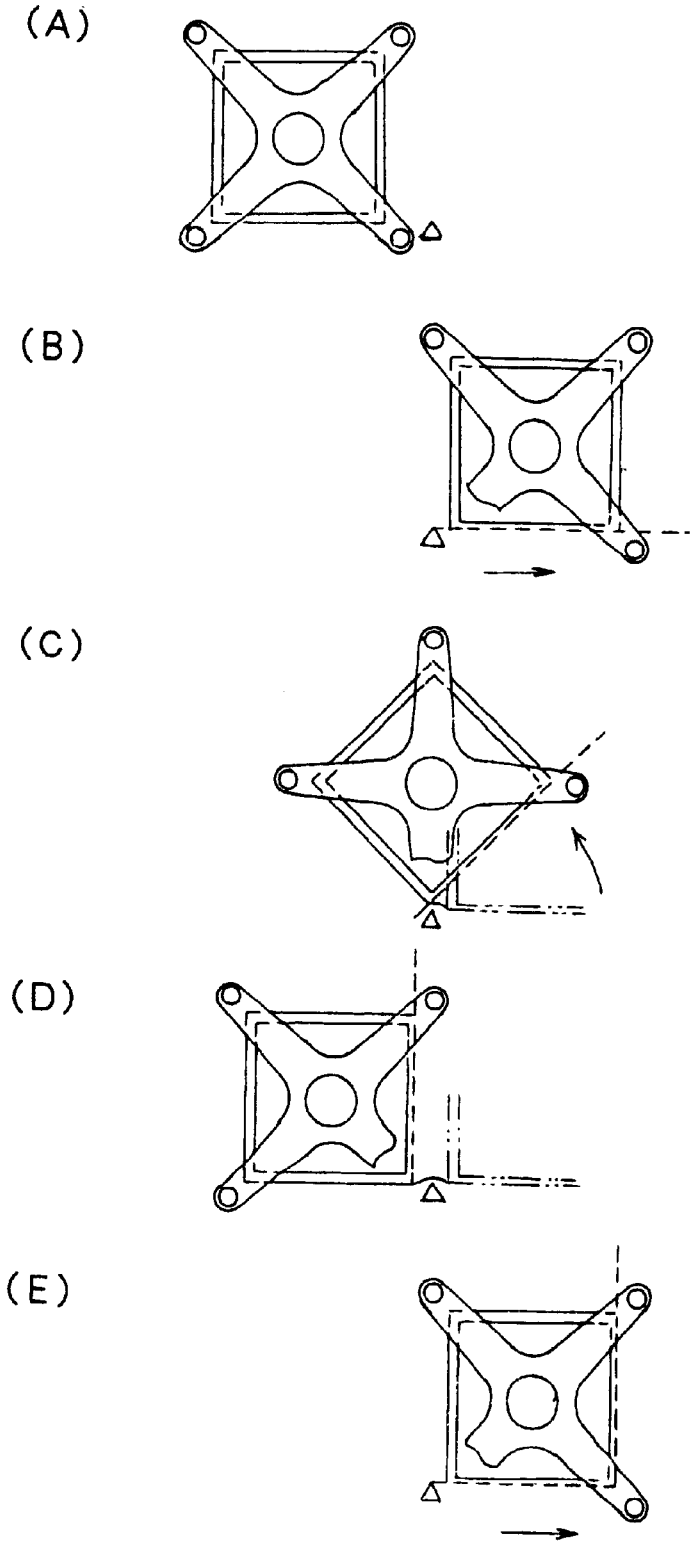
Figure 25:
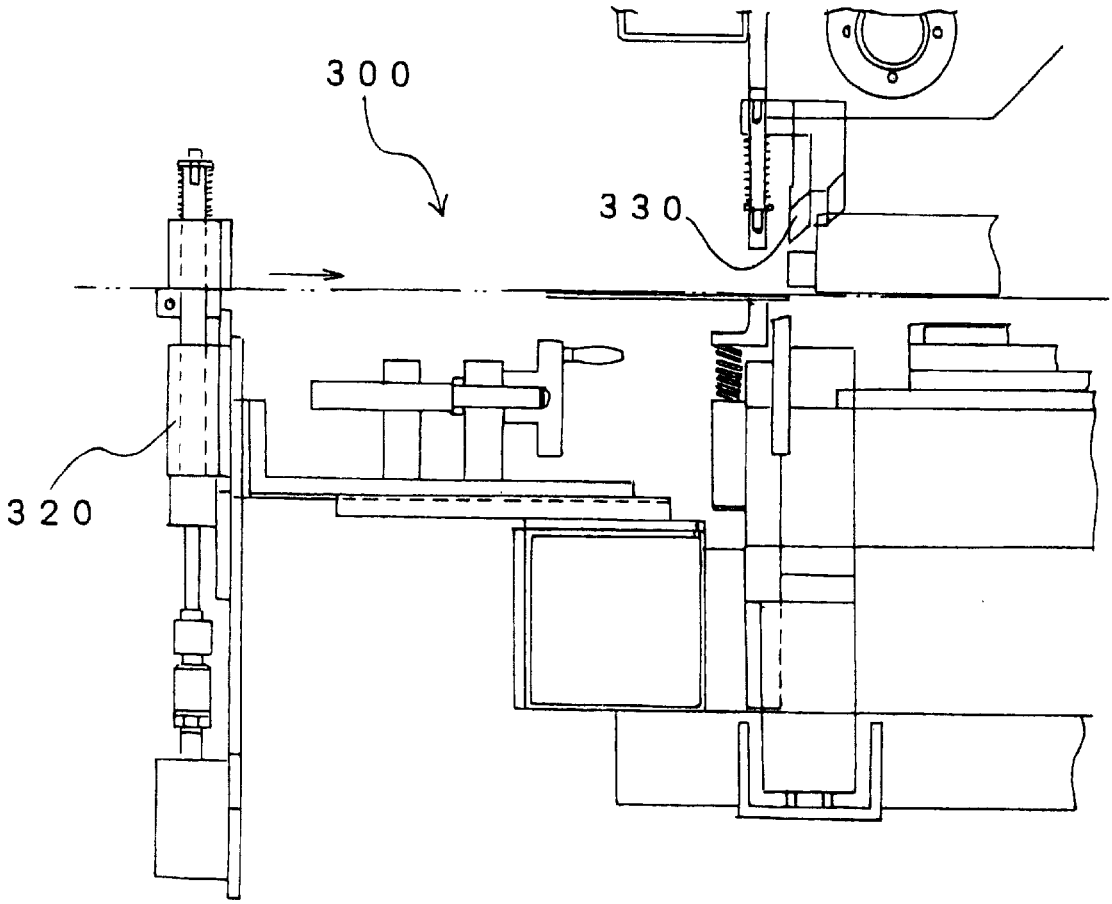

The guide rail 90 has a length and configuration as shown in FIG. 18. As shown in FIG. 20, the guide rail 90 has a stopper 91, an outlet 92 and an inlet 93 as well as a guide member 94 which guides a guide roller 81 at a time (FIG. 22). The right end of the guide rail 90 is connected to the piston rod of a piston device 96.

Figure 21:
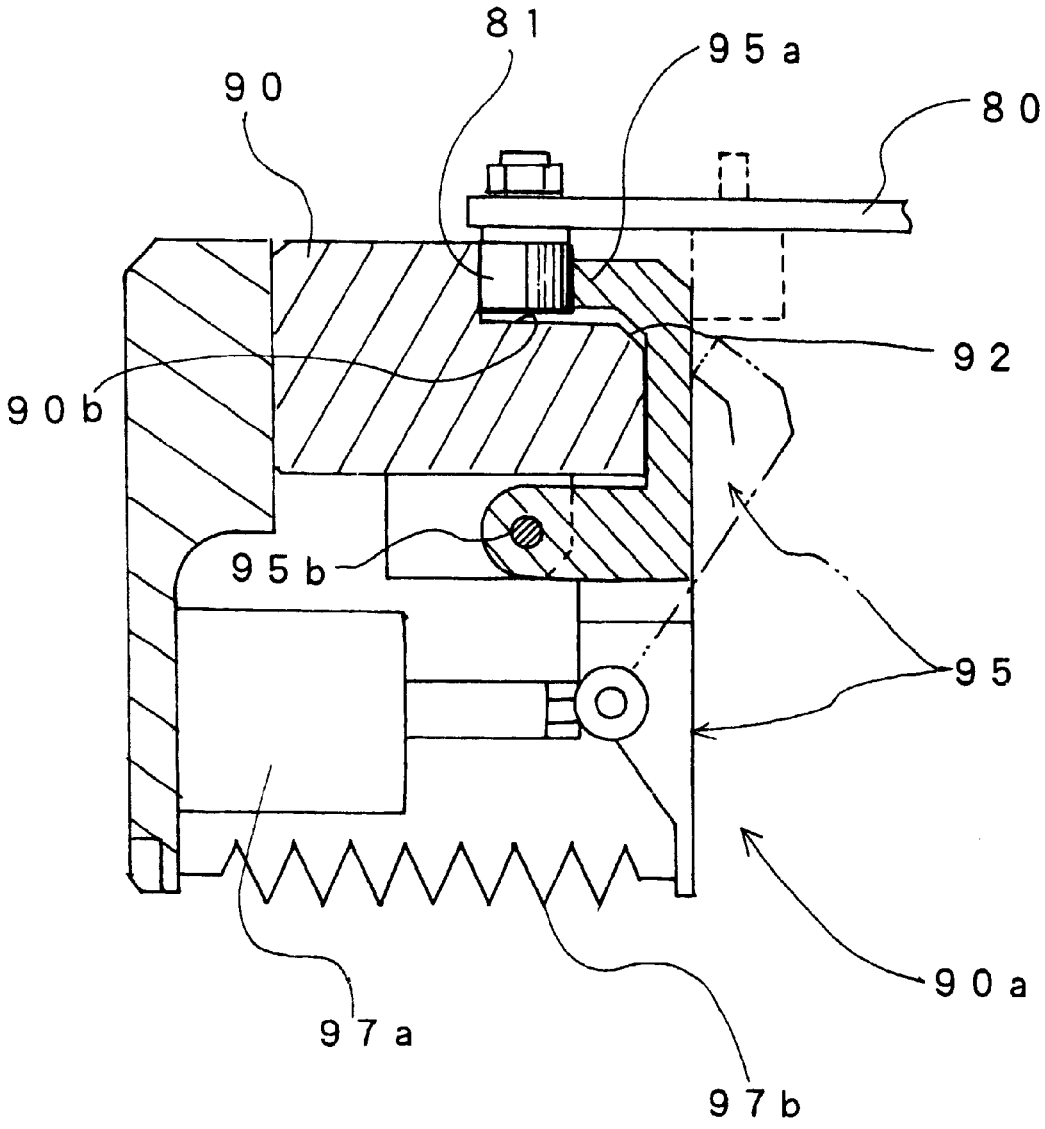

As shown in FIGS. 20 and 21, the outlet 92 is covered with a gate member 95*a* of a gate device 95. The gate device 95 comprises a gate member 95 turnably supported by a support spindle 95*b*, a piston 97*a*, and a push spring 97*b* which presses the gate member 95*a* toward the guide rail 90.

In the guide rail 90, as shown in FIG. 22, the outlet 93 is covered with the front portion 94*a* of the guide member 94. The front portion 94*a* is biased with a pull spring 98.

The cutter device 300 is provided in the hemstitching apparatus 100 as shown in FIGS. 15 and 16. The cutter device 300 has a material feeder 310 as shown in FIGS. 15–17 and 25 to feed an elongated fabric material to the cutter device 300. The material feeder 310 has a fabric holder 320. If an elongated fabric material is provided for producing towels, the fabric material is usually provided with flat portions and piled portions separately. The fabric holder 320 nips those flat portions and prevents those piled portions from continuously running forward, thus controlling the feeding of the material.

The feeding of a fabric material from the fabric holder 320 onto the work table 20 is provided by a transporter 340 as shown in FIG. 15. The fabric material must be cut in a predetermined size with a cutter member 330. The transporter 340 is provided with a fabric nipper 341 which pinches an end portion of the fabric piece and draws the fabric piece under the needle 210. The transporter 340 is reciprocated by a piston cylinder 342 shown in FIG. 15.

This hemstitching apparatus 100 additionally has a label device 360 between the cutter device 300 and the sewing device 200. The label device 360 provides labels onto edge portions of fabric pieces W under the press plate 30. The press plate 30 is lifted slightly while labels are provided. The labels will be sewn onto fabric edges at the same time the fabrics W are treated with the sewing device 200.

During round corner treatment, undesirable wrinkles are often generated on fabrics. To provide a neat treatment of round corners, the following two steps are taken.

The first step is to lift the press metal of the sewing device 200 slightly immediately before turning a fabric W. The second step is to appropriately blow air onto the fabric W in the fabric turning direction to stretch such wrinkles.

Embodiment 3

Figure 27:
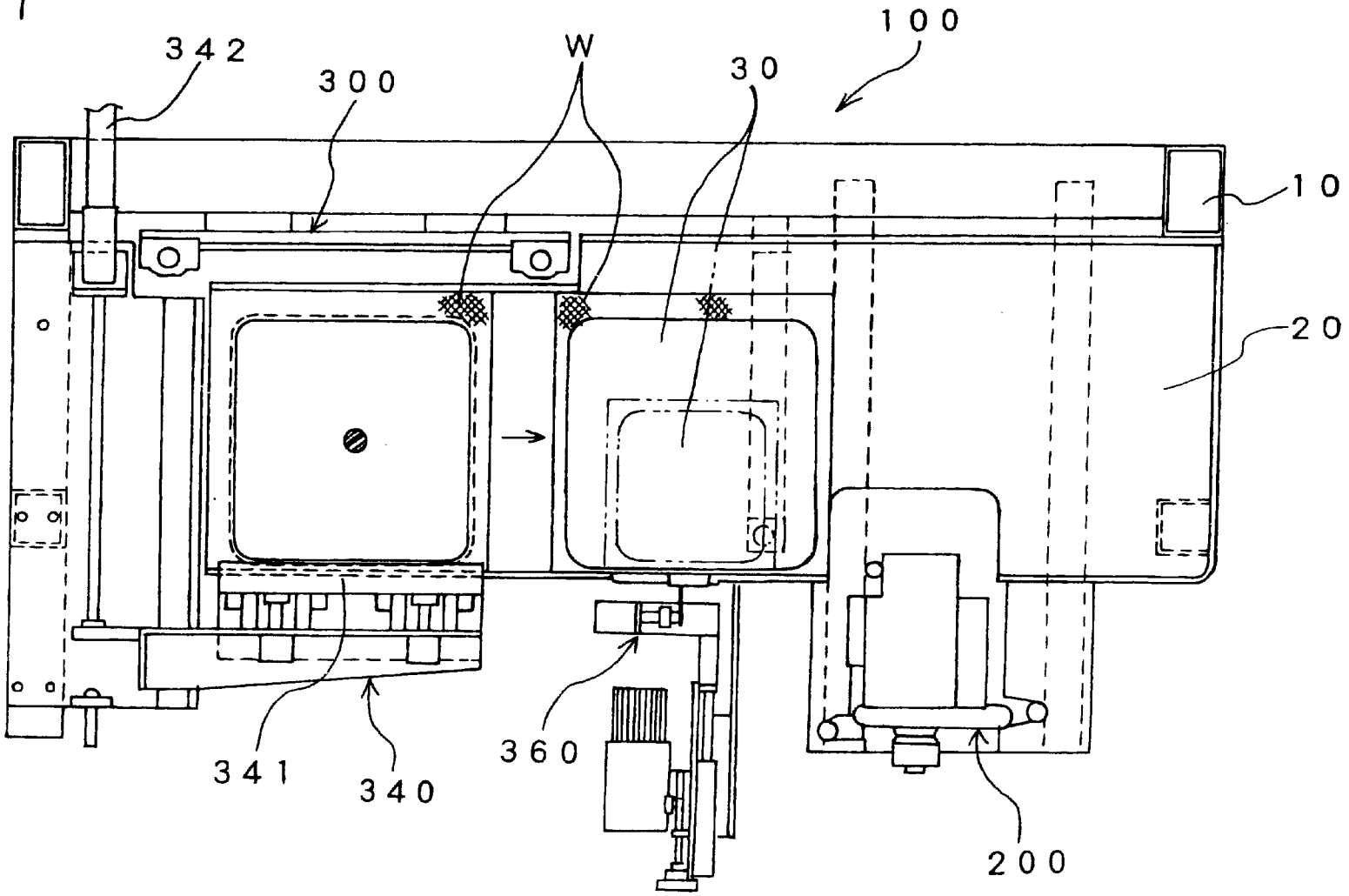
Figure 28:
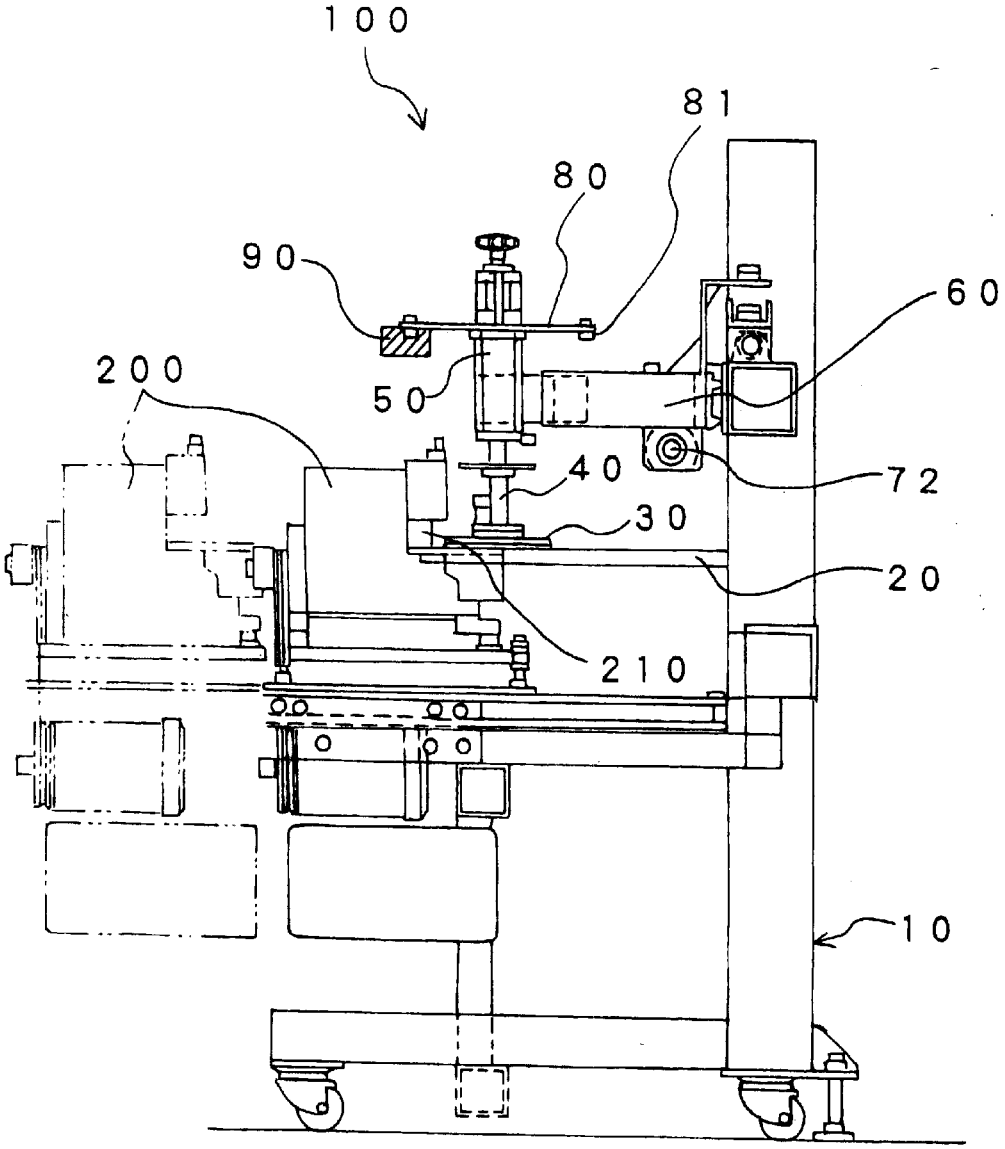
Figure 29:
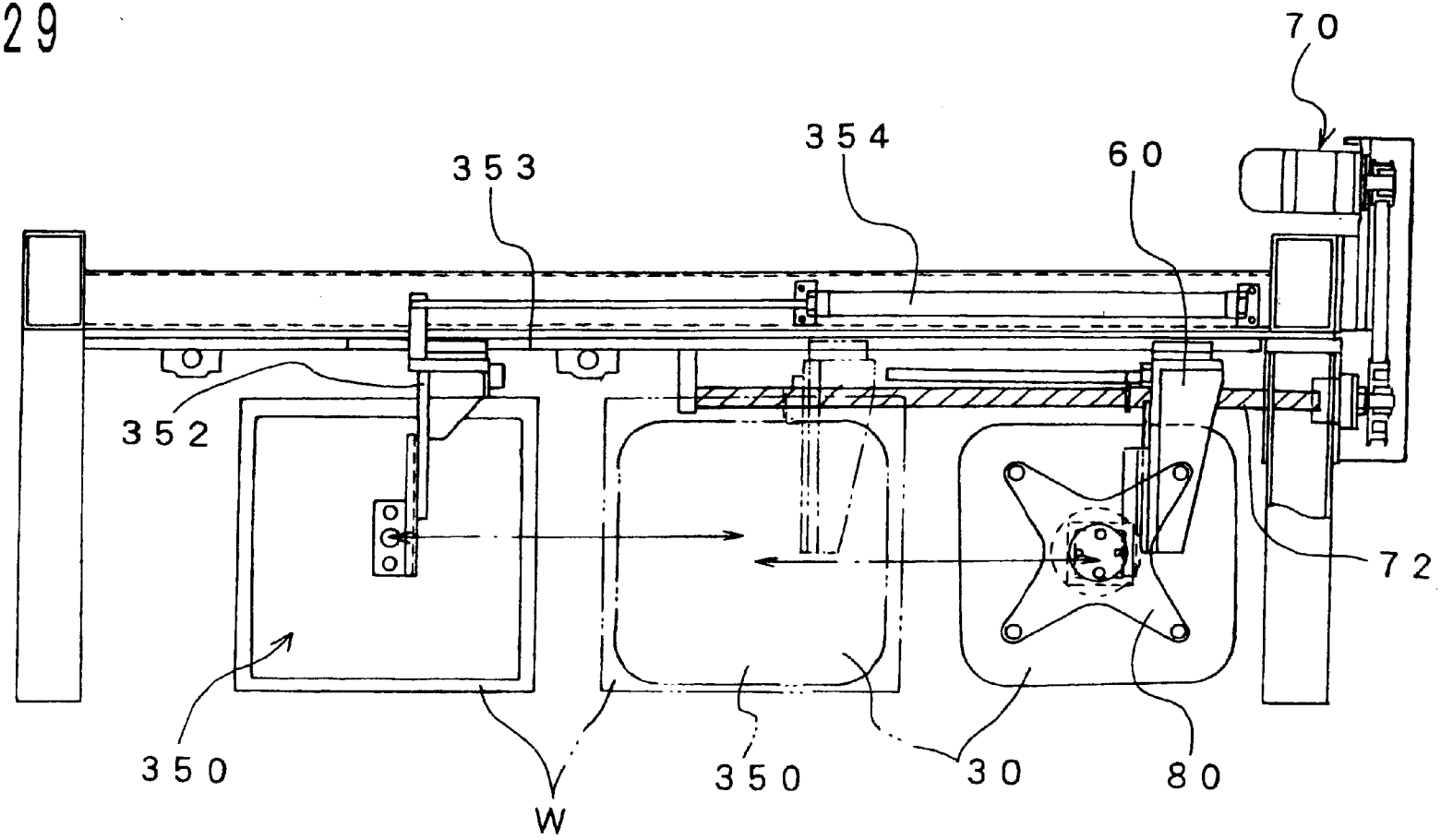
Figure 30:
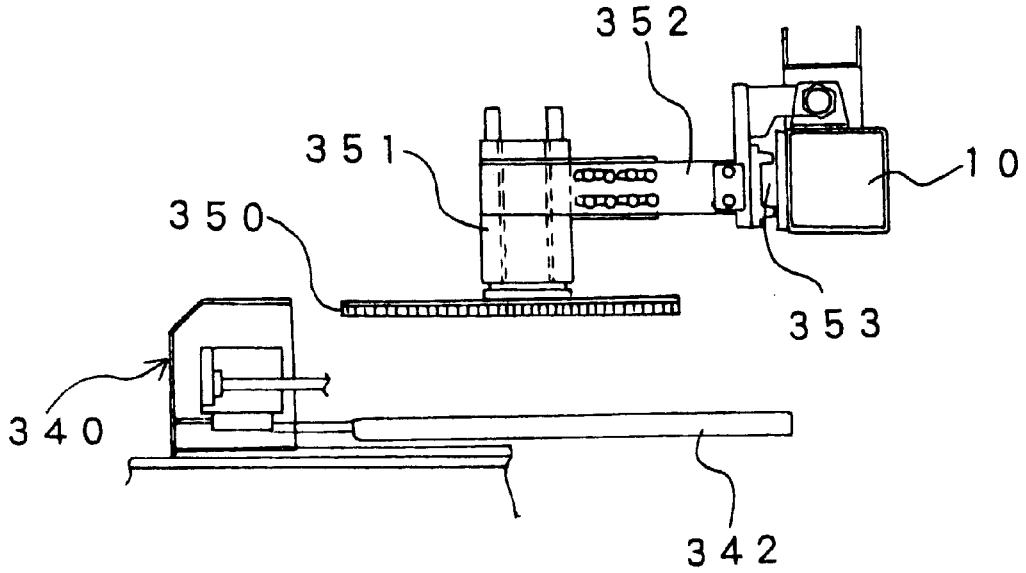

Another hemstitching apparatus 100 is provided as shown in FIGS. 26–29. A cutter device 300 is installed in the apparatus 100 as shown in FIGS. 26, 27, 29 and 30. A fabric material is fed onto a work table 20 after the cutter device 300 cuts the fabric material in a predetermined size, which is sent by a transporter 350 as shown in FIG. 29. After the transporter 350 moves to a center position of FIG. 29, a fabric piece W is released as shown in FIG. 30. Then the transporter 350 returns to its original position.

Figure 26:
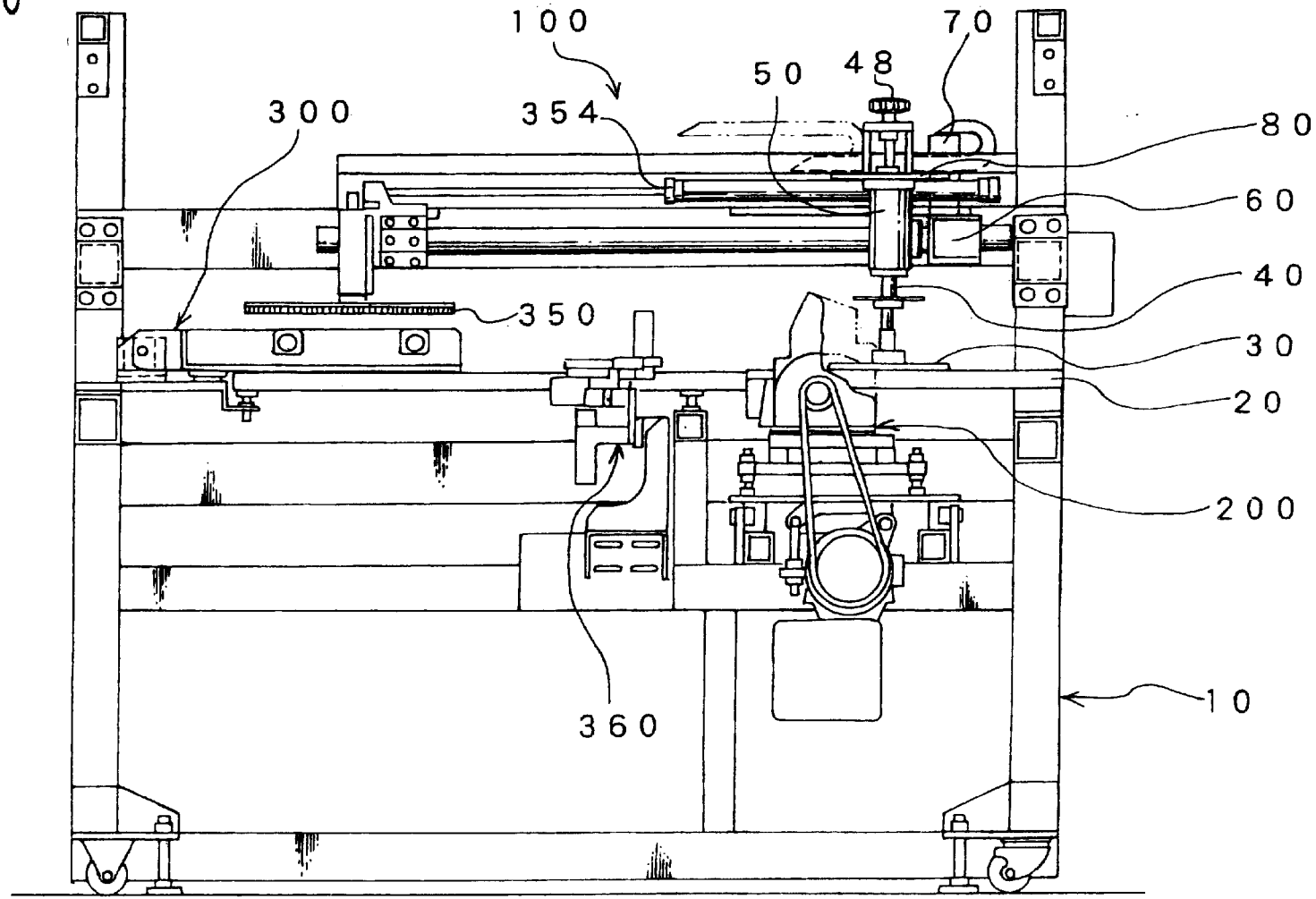
Figure 32:
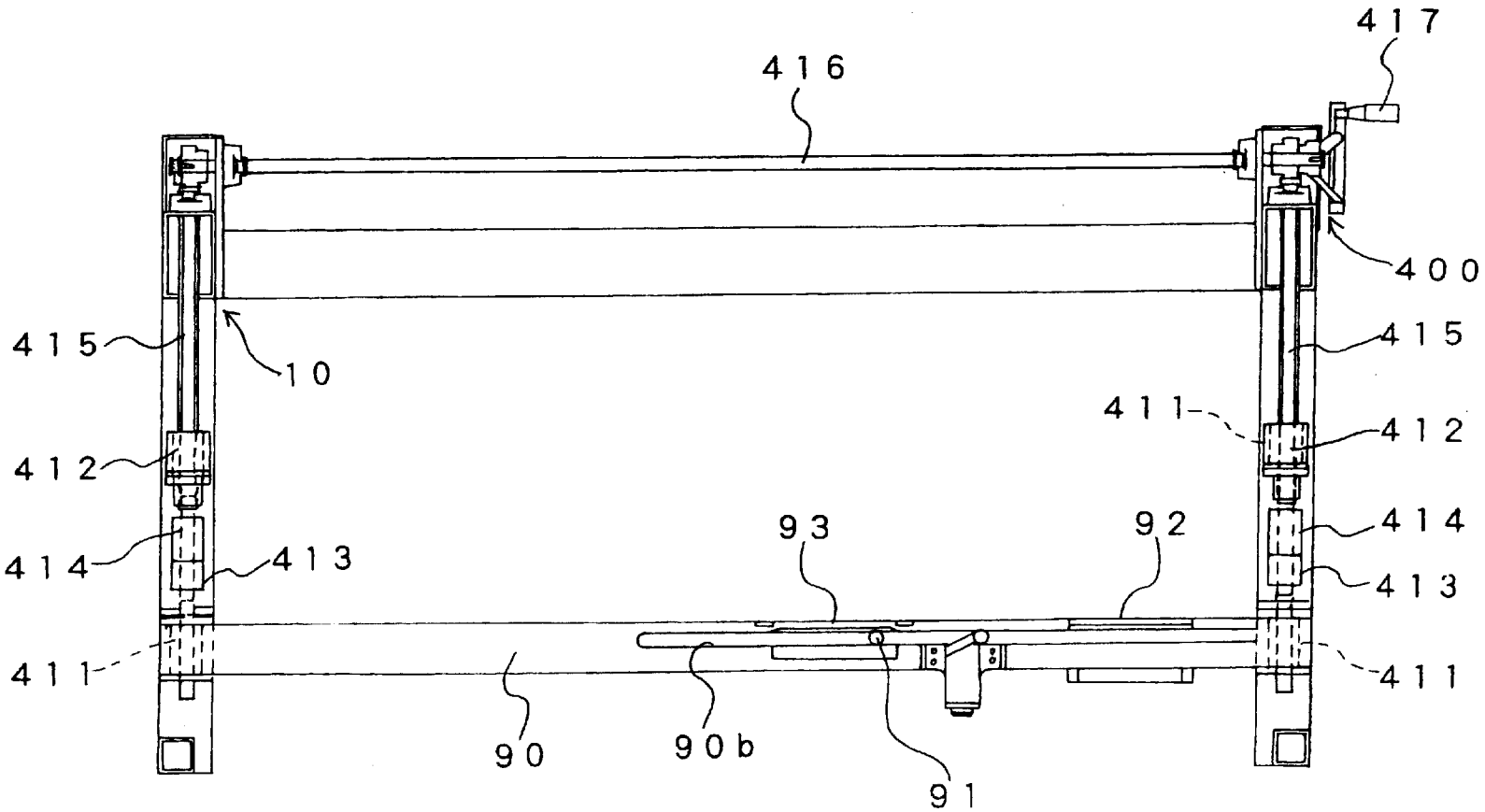

A press plate 30 receives and presses the fabric W at a center of the work table 20. A guide channel 90*b* provided on a guide rail 90 can be provided only in the right portion of the guide rail 90 as shown in FIG. 32, if desired. The work table 20 is mounted on a machine frame 10 as shown in FIGS. 26 and 28. The work table 20 mounts a sewing device 200 and a label device 360 as shown in FIG. 26.

The press plate 30 may be one shown in FIG. 27. Alternatively, the press plate 30 may take configurations shown in FIGS. 40 and 51. The press plate 30 is attached at the lower end of a shaft 40 as shown in FIGS. 26 and 28. The shaft 40 is mounted on a guide beam 60 by means of a support device 50.

The shaft 40 has a press plate connector 45 on its lower end which holds the press plate 30 detachably, and has on its upper end a coupling guide 43 having two grooves 43*a* in this embodiment. On a central portion of the shaft 40 is provided a piston portion 42. When the support device 50 is provided with a cylinder device, the shaft 40 functions as a piston within the cylinder device.

Figure 37:
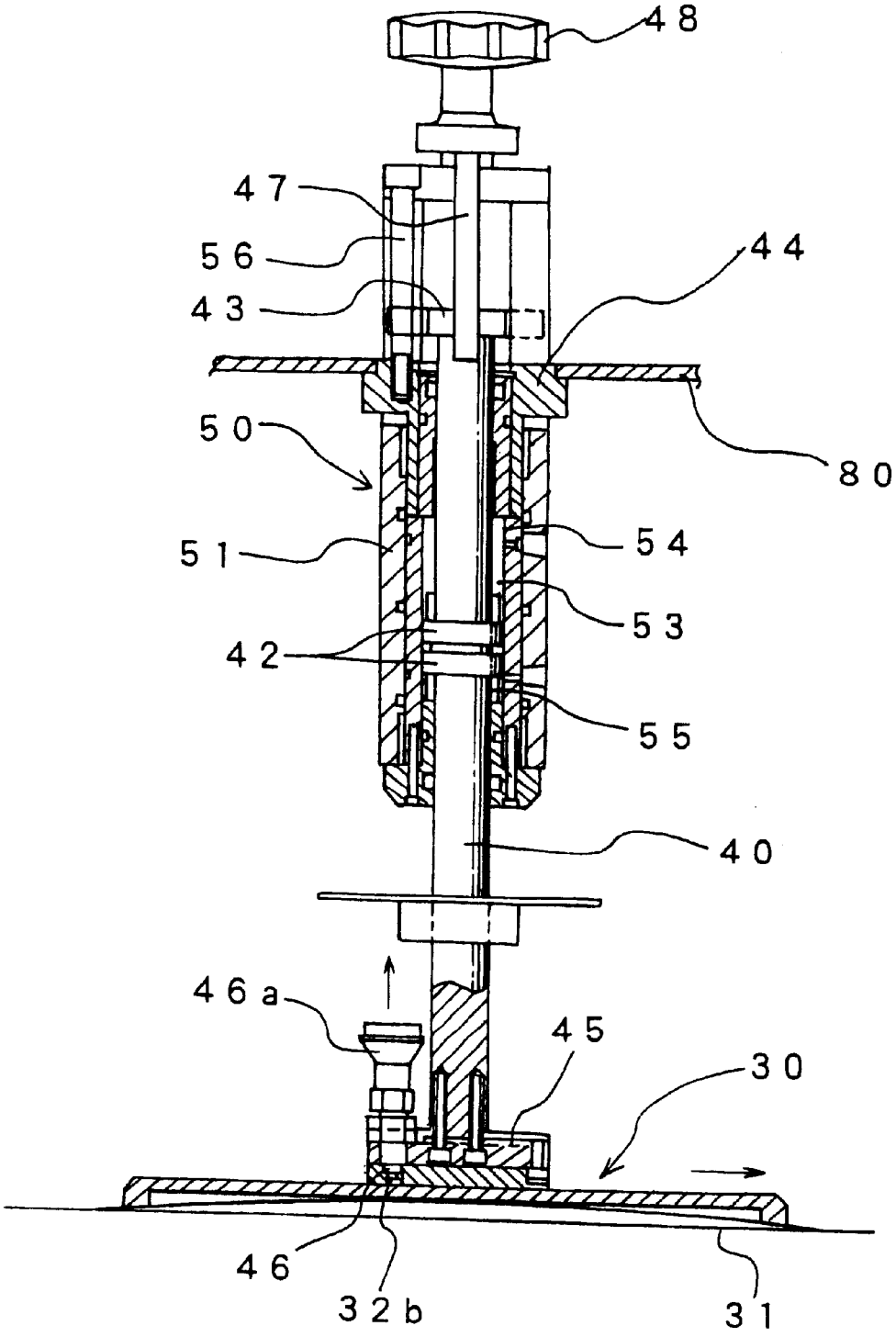
Figure 38:
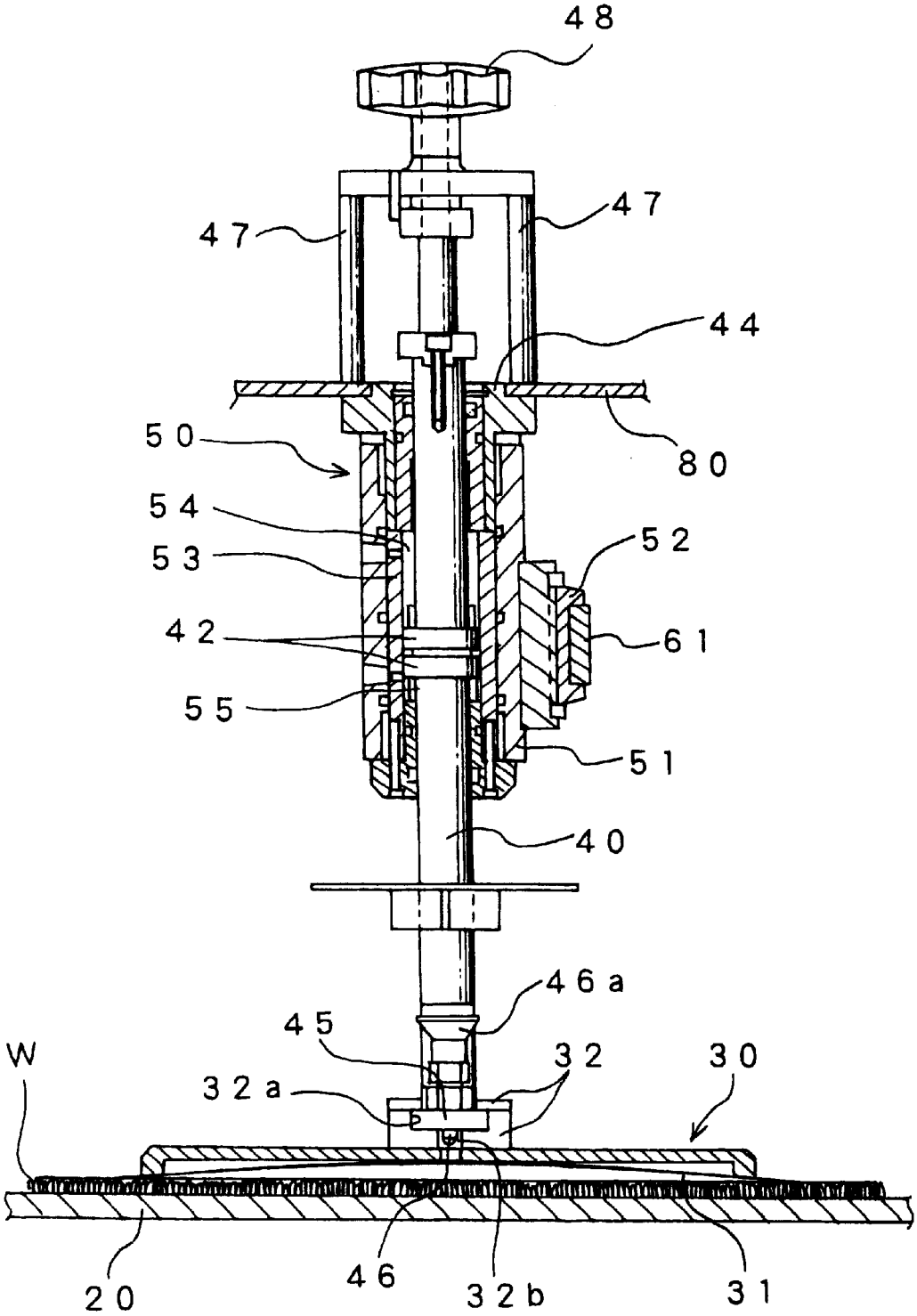
Figure 39:
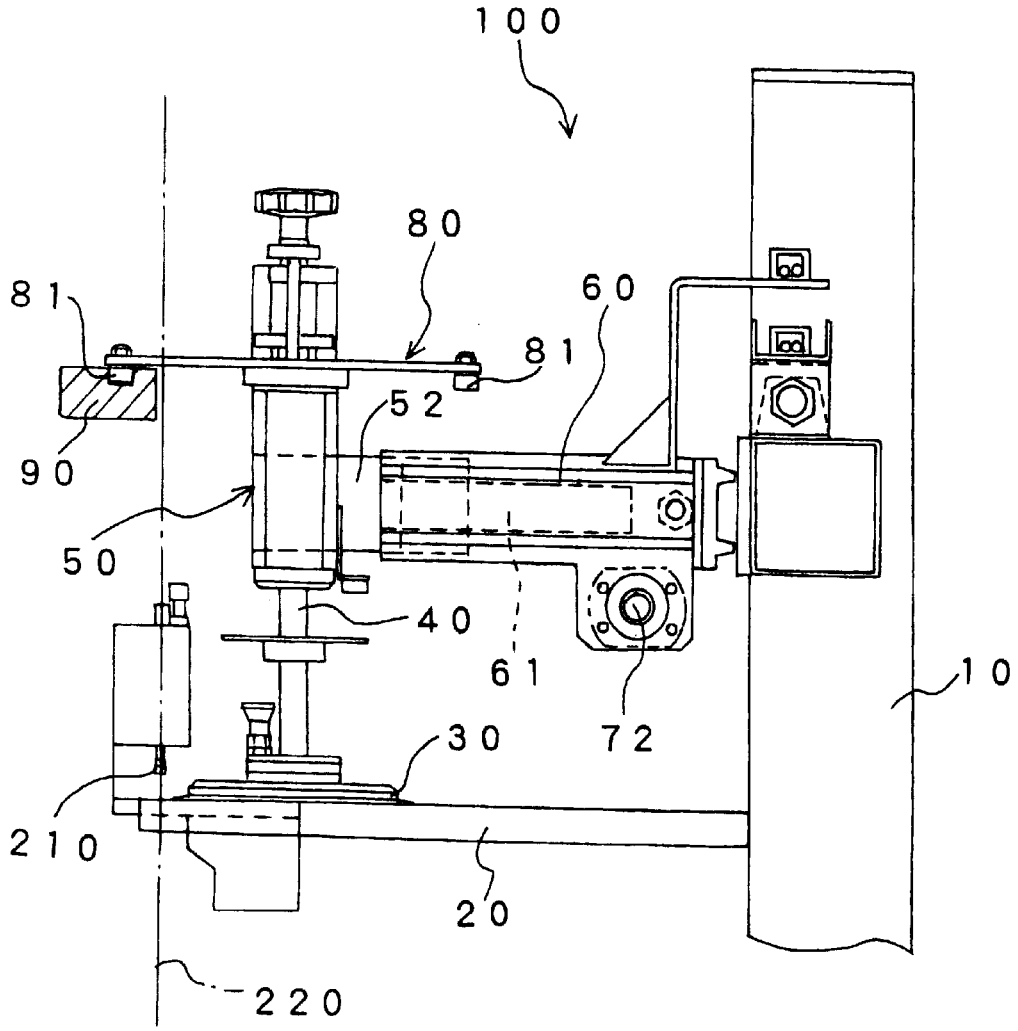
Figure 40:
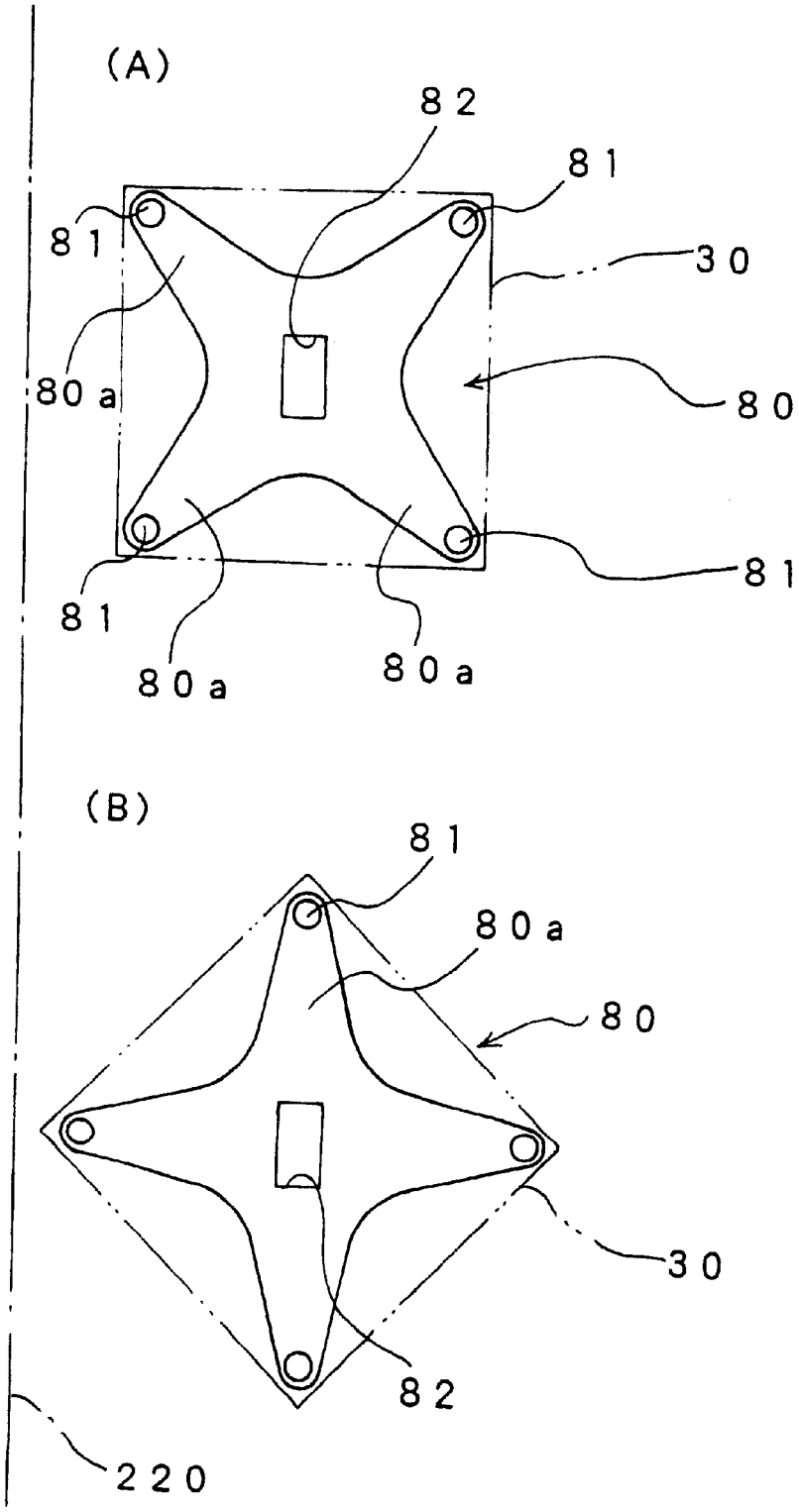
Figure 41:
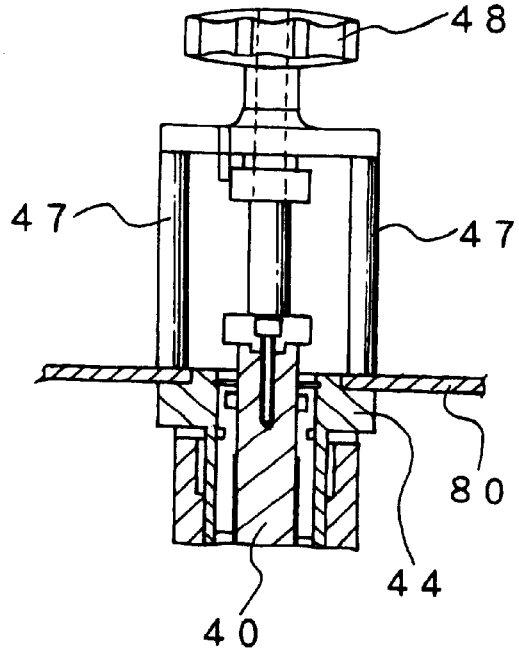
Figure 41:
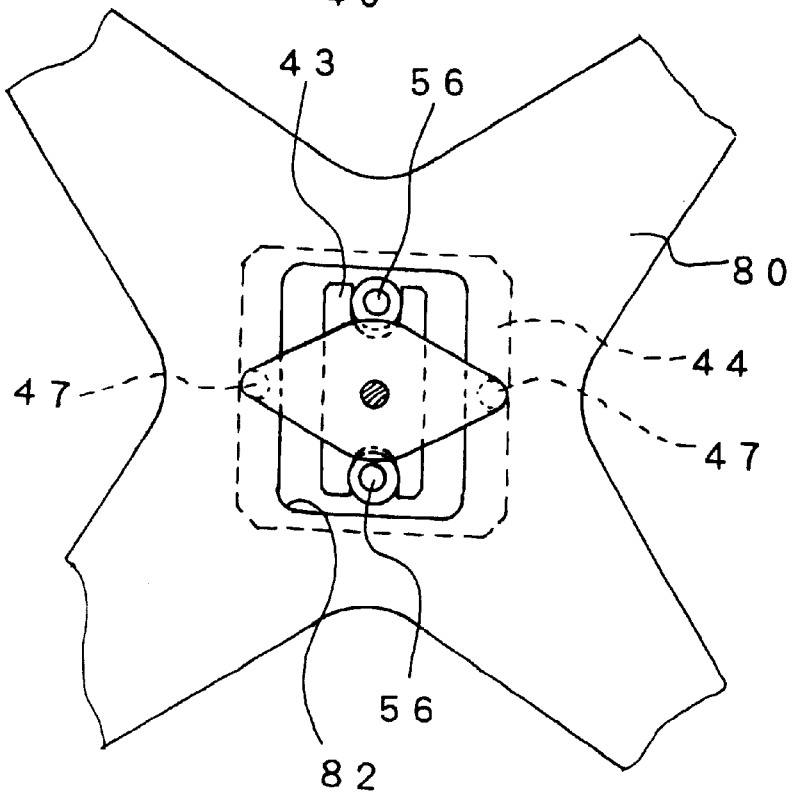
Figure 42:
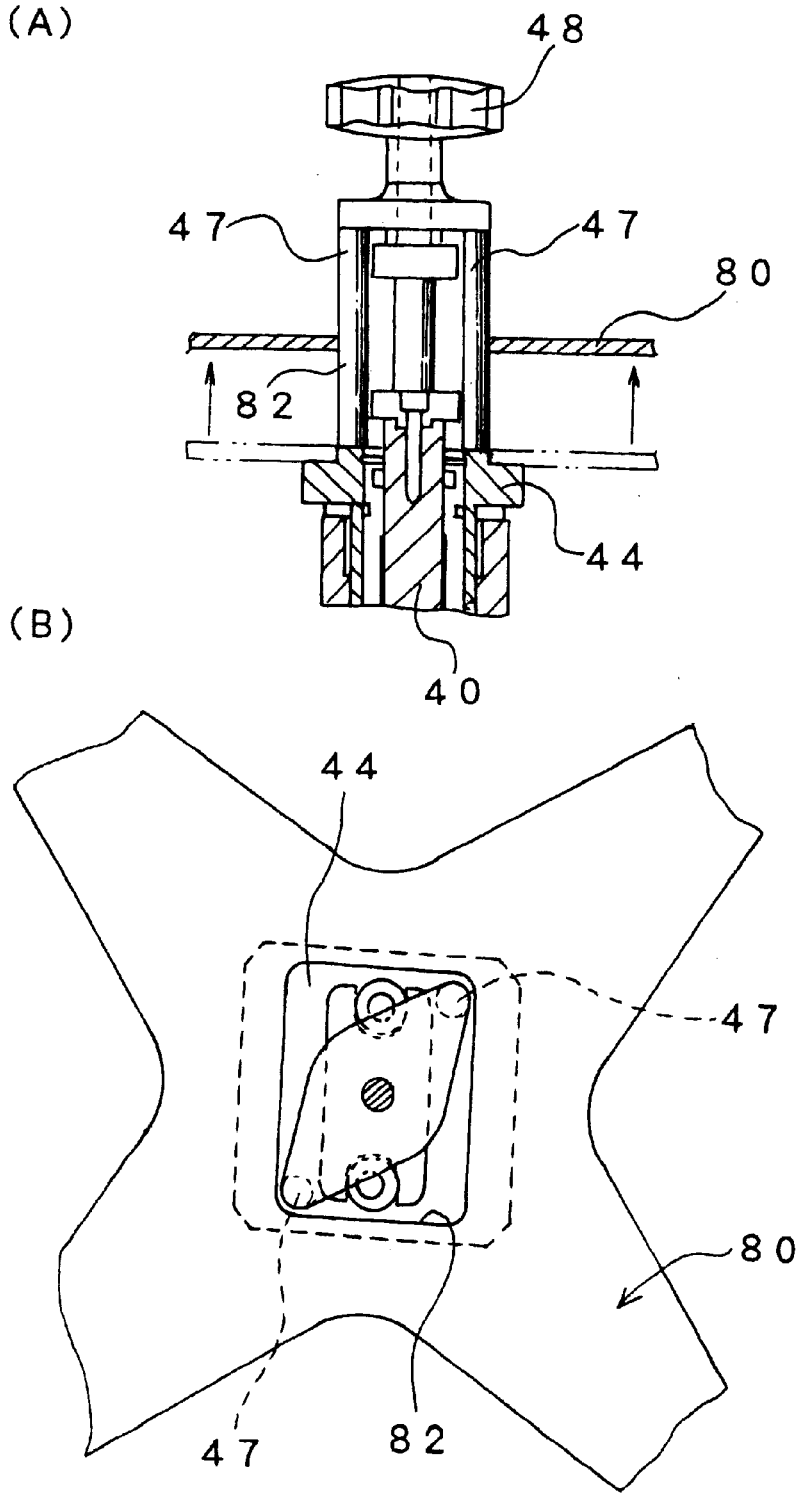

A turn device support 44 is mounted on the support device 50 to detachably mount a turn device 80 as shown in FIGS. 37 and 38. The coupling guide 43 is mounted on the shaft 40. The turn device support 44 engages with an attachment opening 82 formed in a central portion of the turn device 80 and supports the bottom of the turn device 80 as shown in FIGS. 41 and 42.

The press plate connector 45 is a rectangular plate attached to the lower end of the shaft 40 as shown in FIGS. 37 and 38. The press plate connector 45 is inserted into a dovetail 32*a* formed in the coupling member 32 from the left side in FIG. 37. The press plate connector 45 has a stopper member 46, which is lifted by a stopper controller 46*a* as shown in FIG. 37. The stopper member 46 is biased by a spring (not shown) toward a receiver hole 32*b*.

Such press plates 30 to be engaged with the press plate connector 45 at the lower end of the shaft 40 are each provided with an identical coupling member 32. The coupling member 32 has a dovetail 32*a* which encloses the press plate connector 45 as shown in FIG. 38, a portion of which is provided with a receiver hole 32*b* to be engaged with a lower portion of the stopper member 46 as shown in FIG. 37.

The turn device 80 is horizontally mounted on the upper end of the cylinder member 53 as shown in FIG. 37. The top end of the cylinder member 53 has a plurality of guide columns 56 which correspondingly engage with the grooves 43*a* formed on the coupling device 43. The guide columns 56 together hold the shaft 40 horizontally steady but allow a vertical movement of the shaft 40 relative to the cylinder member 53.

Figure 31:
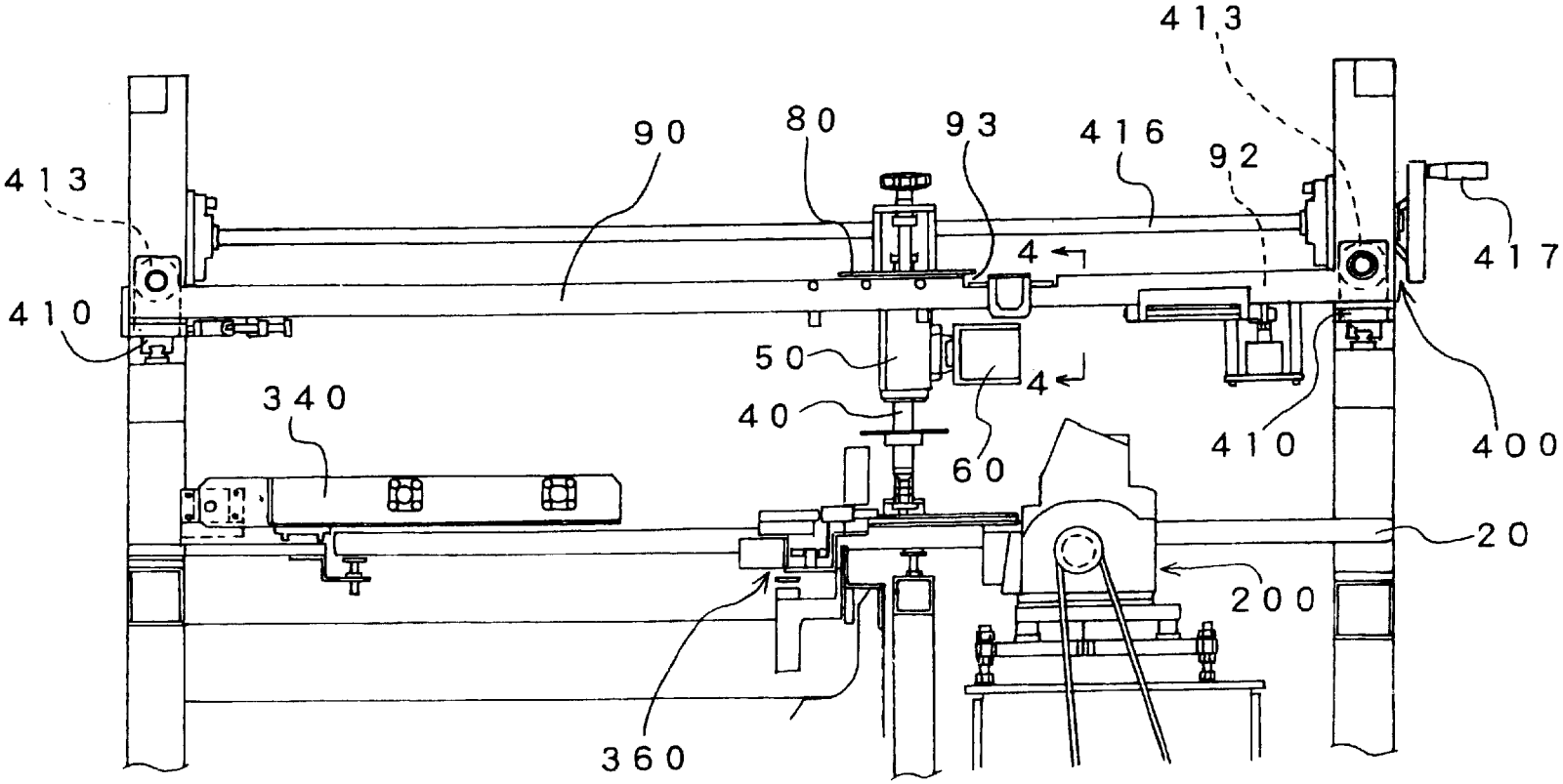

The guide rail 90 is mounted on the frame 10 shiftably relative to the frame 10 by means of a rail driver 400 as shown in FIGS. 31 and 32. The guide rail 90 is moved relative to the frame 10 under control to adjust positioning of the press plate 30 relative to the sewing device 200 in accordance with desired treatment, either a round corner treatment or a square corner treatment.

Figure 34:
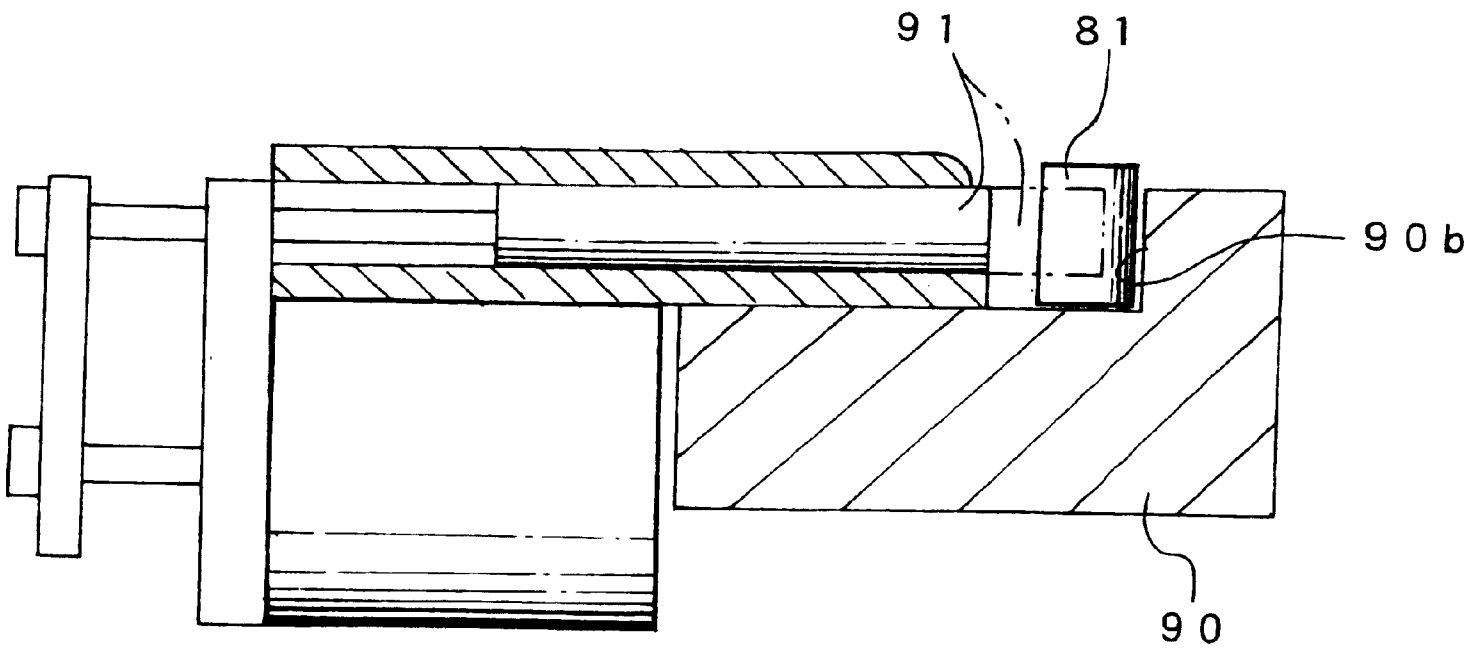
Figure 35:
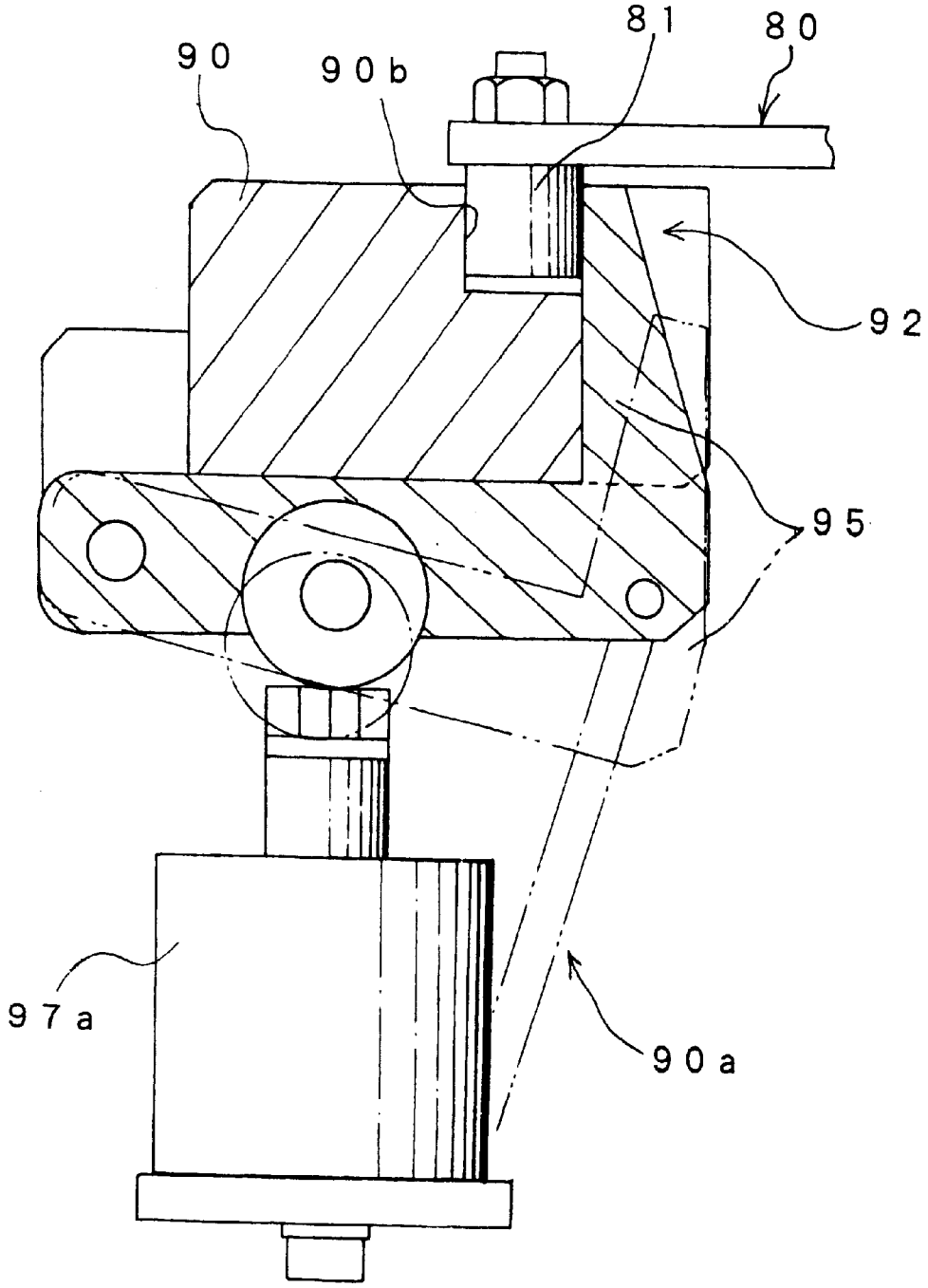
Figure 36:
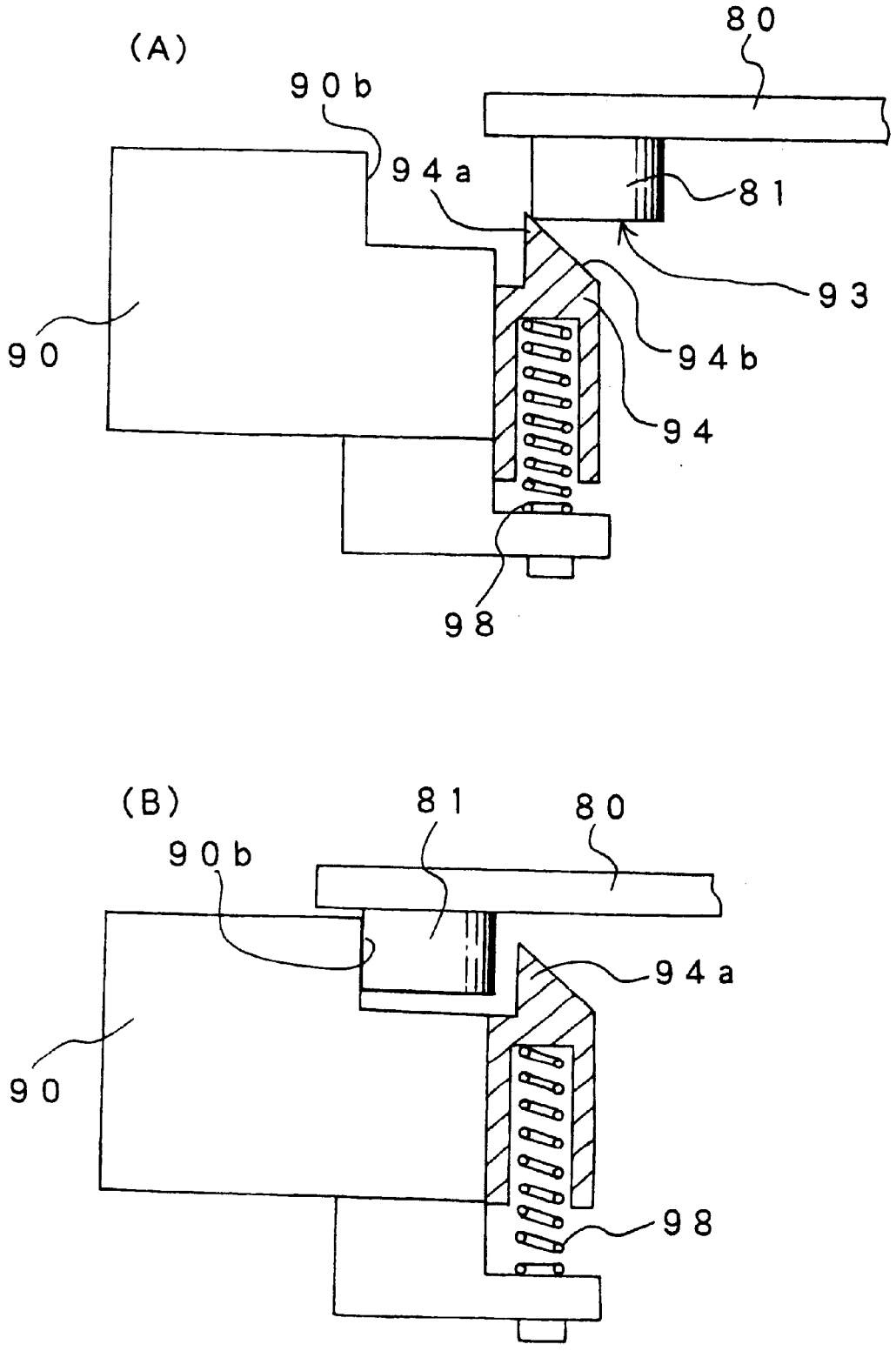

In the guide rail 90, a stopper 91 is provided in the guide channel 90*b* as shown in FIG. 34. The stopper 91 selectively restricts the guide rollers 81 within the guide channel 90*b*. The guide rail 90 has an outlet 92 covered with a gate device 95 of a door device 90*a* and an inlet 93 as shown in FIG. 35. There is also provided a piston 97*a*. The inlet 93 is covered with the front portion 94*a* of a guide member 94. The front portion 94*a* is biased with a pull spring 98.

Figure 45:
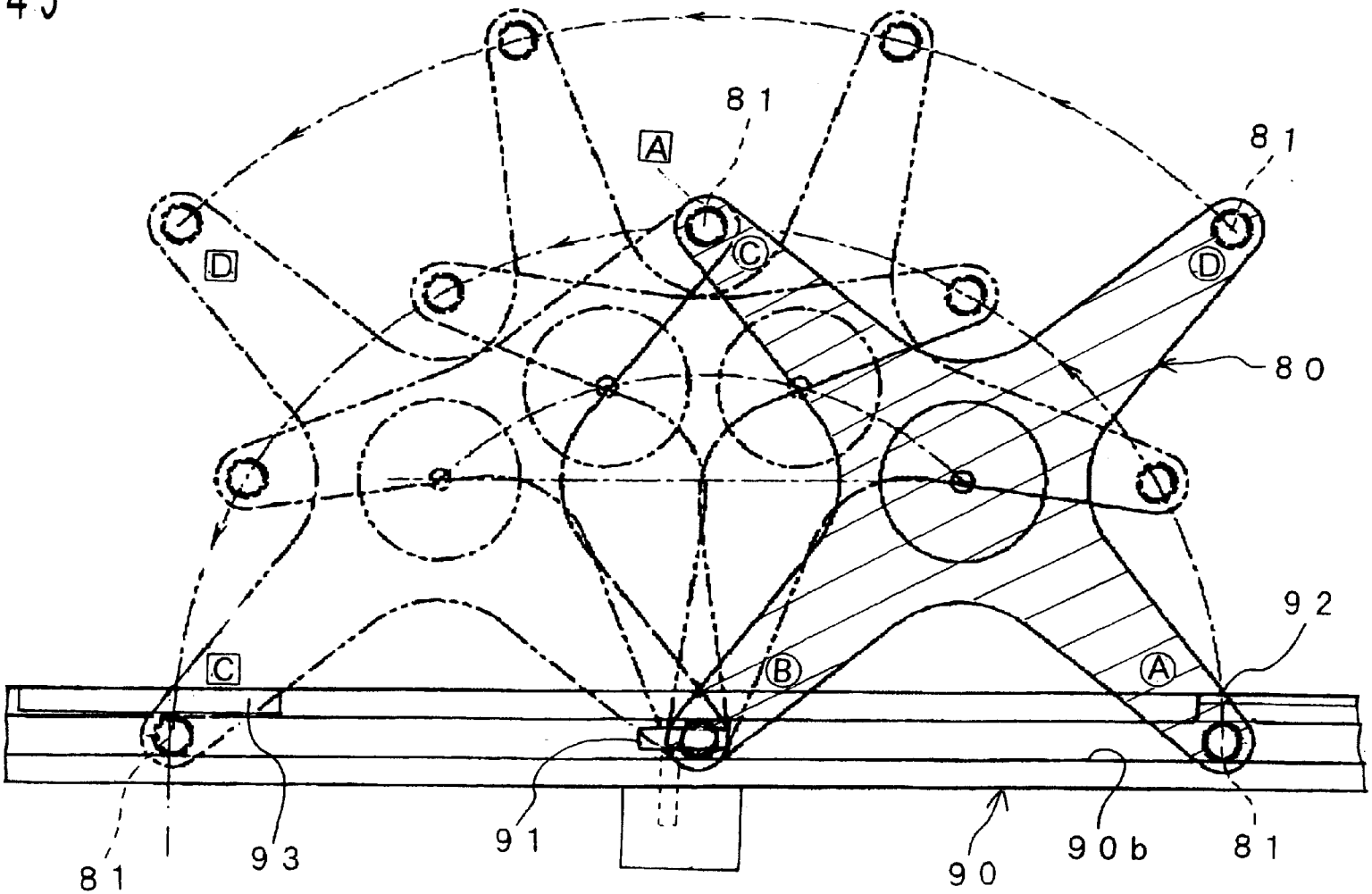
Figure 46:
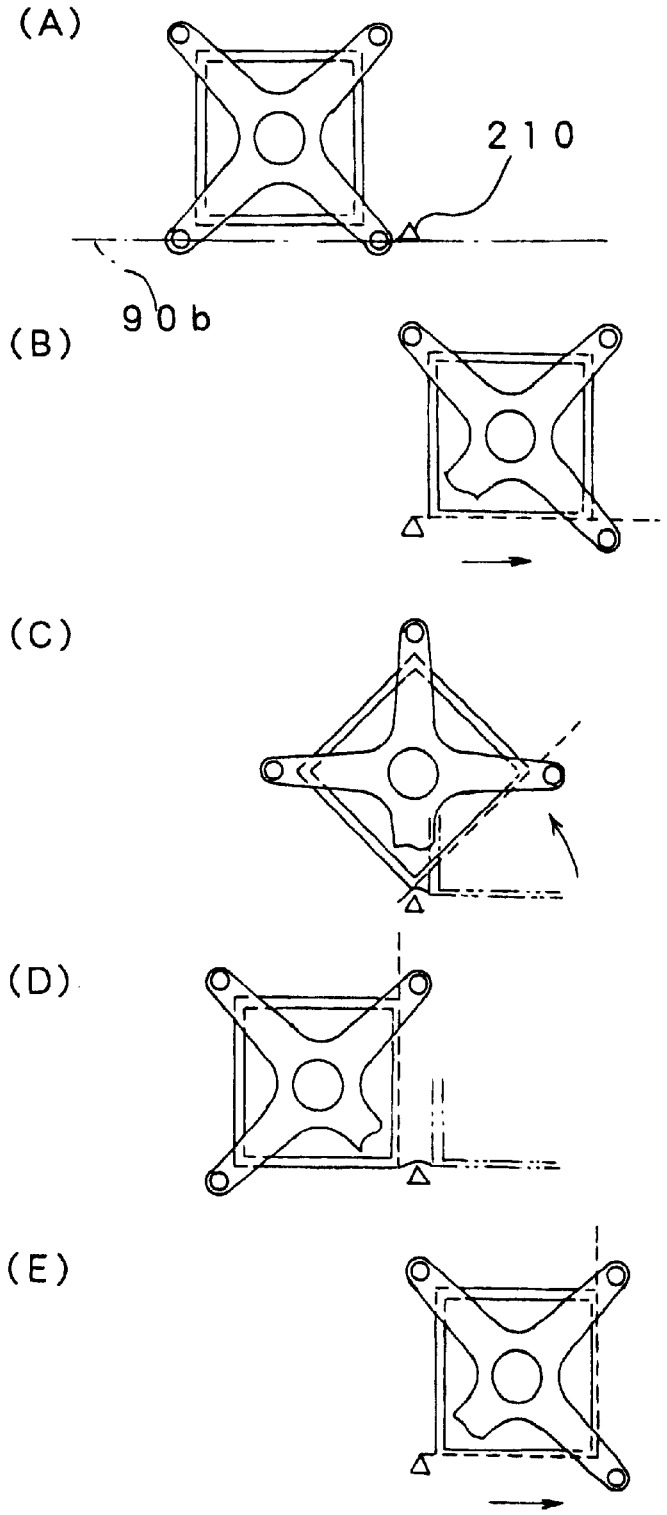
Figure 47:
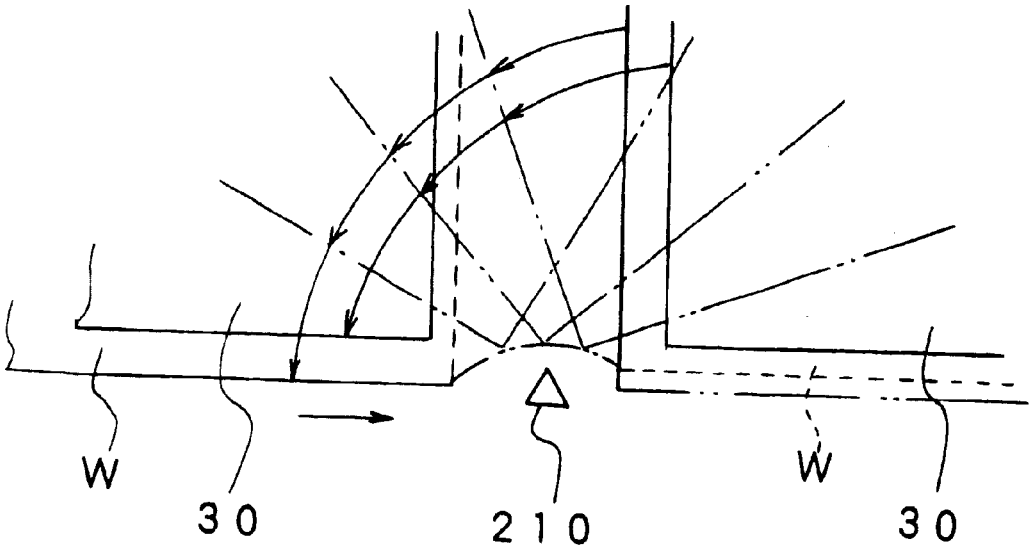
Figure 48:
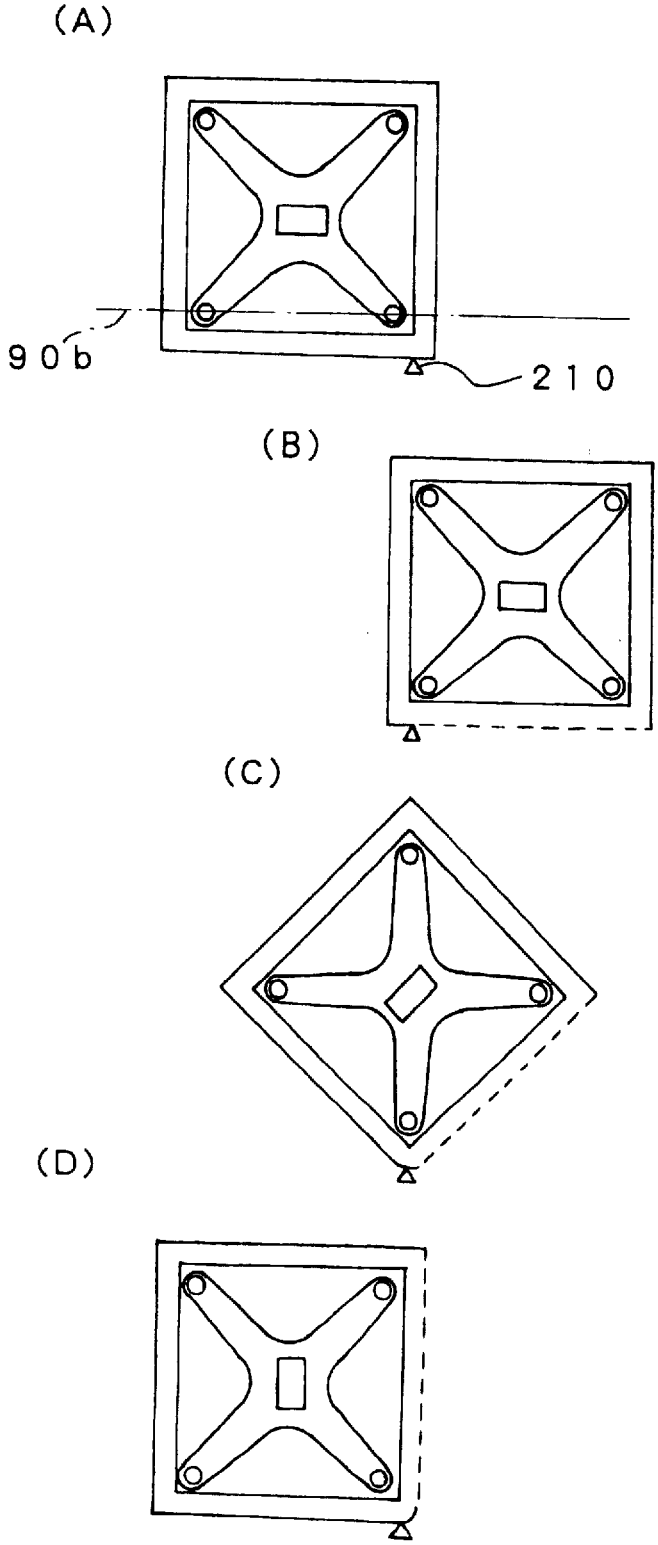
Figure 49:
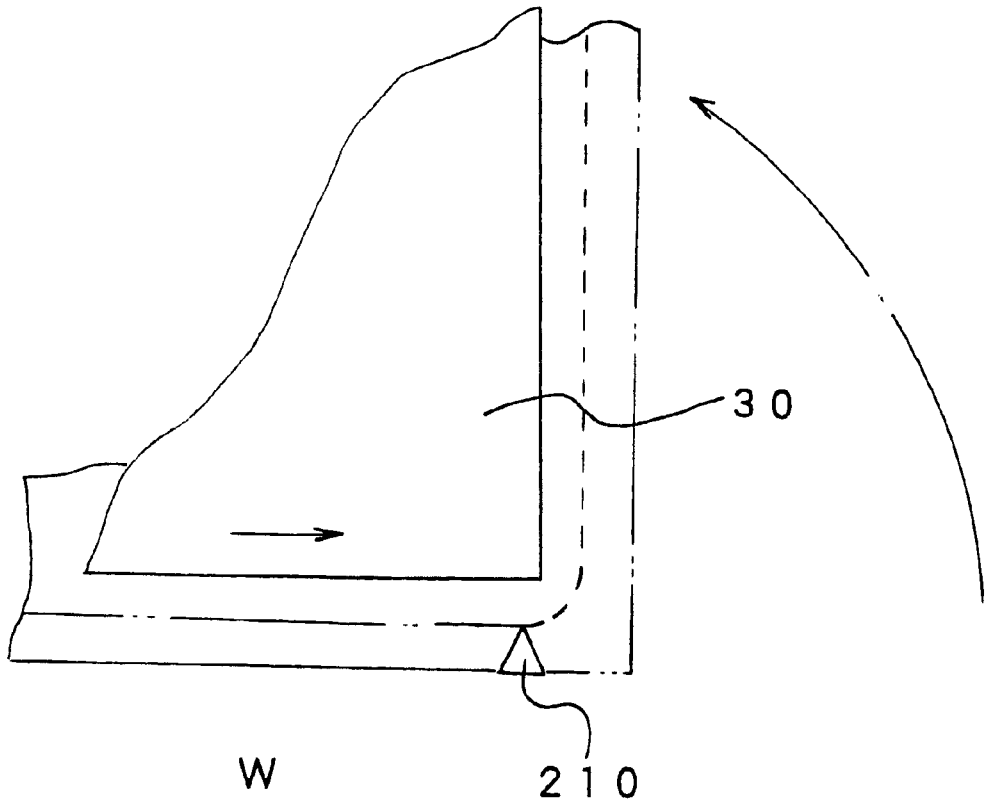
Figure 50:
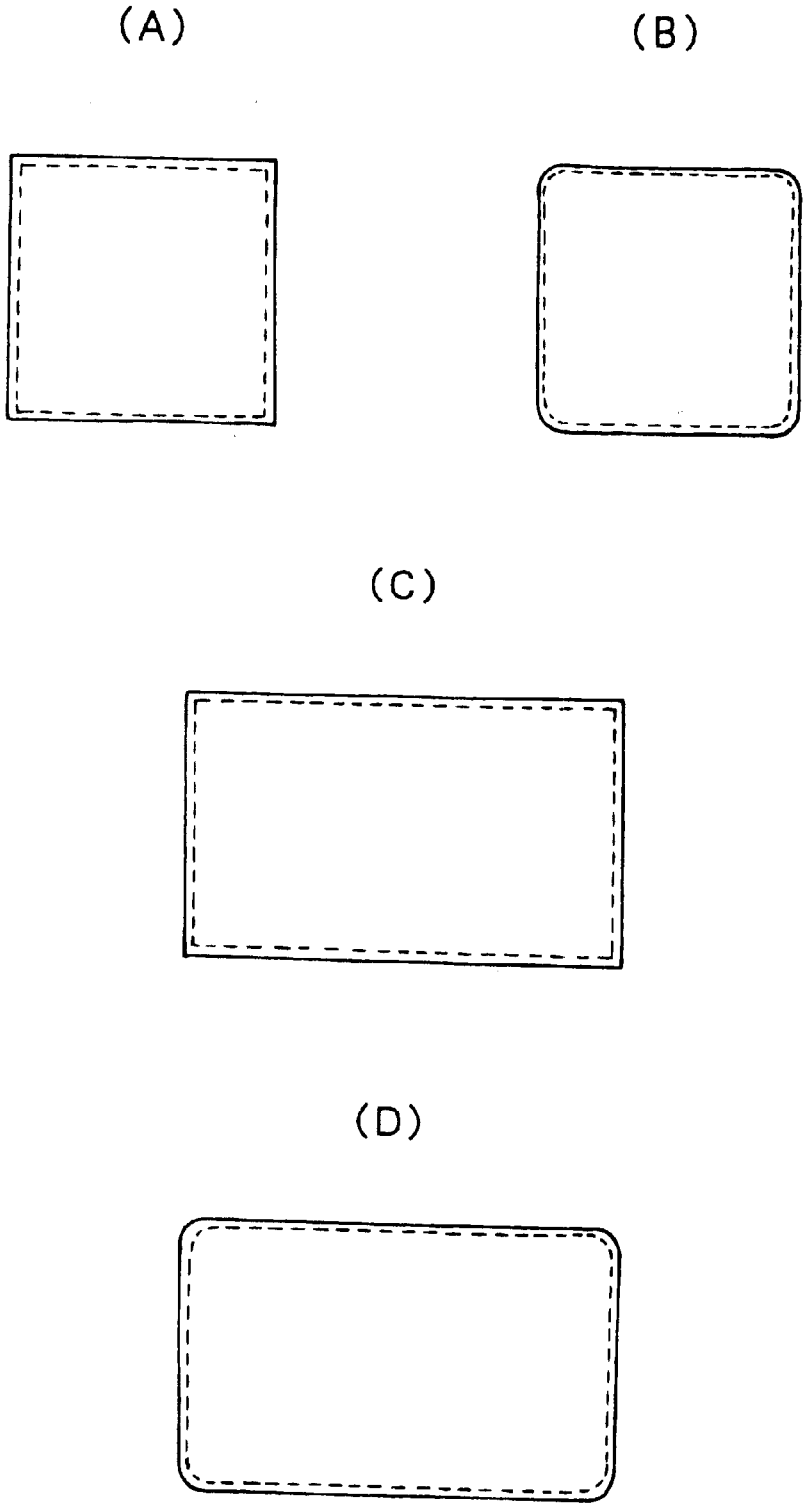

The outlet 92 and the inlet 93 are provided with a substantial length along the guide channel 90*b* as shown in FIGS. 32 and 45. The respective lengths of the outlet 92 and the inlet 93 are provided considering the distance between two guide rollers 81 of all utilizable turn devices 80 so that the guide rollers 81 of any turn device 80 can be smoothly engaged with the inlet 93 and outlet 92. Thus the introduction of guide rollers 81 into the guide channel 90*b* as well as expelling the guide rollers 81 from the guide channel 90*b* can both be smoothly provided.

In the hemstitching apparatus 100, a cutter device 300 is additionally provided as shown in FIGS. 26 and 27. The cutter device 300 has a material feeder, which feeds an elongated fabric material to the cutter device 300. The material feeder has a nipper means to hold a portion of the fabric material to be cut, thus providing a control over the feeding of the fabric material.

The fabric material to be cut in a predetermined size is carried onto the work table 20 by a transporter 340 as shown in FIG. 26 and cut by the cutter device 300. The transporter 340 has a nipper which nips a portion of the fabric material and draws the fabric material onto the work table 20. This transporter 340 is shuttled by a piston cylinder 342 as shown in FIG. 26.

The fabric piece W cut in a predetermined size by the cutter device 300 is received by a transport plate 350 which presses the fabric piece W on the work table 20. The transport plate 350 is supported on a plate elevator 351 which can be controlled vertically.

A support bar 352 supporting the transport plate 350 is supported by a guide bar 353 installed in parallel with the guide rail 90 as shown in FIG. 29. The support bar 352 is connected to the piston rod of a bar cylinder 354, which is fixed to the frame 10 and controlled by a controller means (not shown).

The transport plate 350 shuttles between its initial position and the central position shown in FIG. 29. At each terminal, the transport plate 350 is vertically moved by the plate elevator 351. The transport plate 350 presses the fabric piece W cut by the cutter device 300 on the work table 20. The fabric W is fed from the left side by the bar cylinder 354 as shown in FIG. 29. The plate elevator 351 elevates the transport plate 350 to release the fabric W onto the work table 20. Then the transport plate 350 returns to its initial position.

Figure 33:
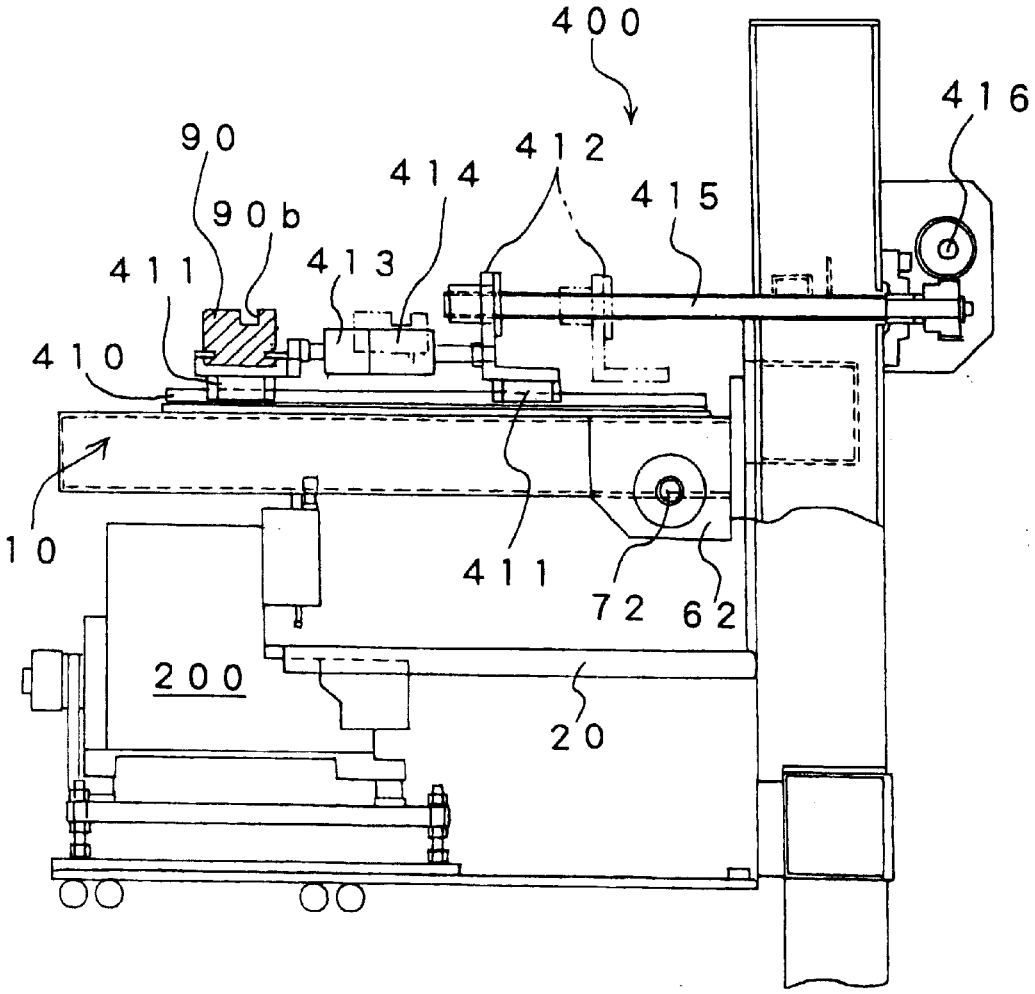

As described, the guide rail 90 can move relative to the frame 10 by means of the rail driver 400. The rail driver 400 has two rail members 410 as shown in FIG. 31. On each rail member 410 is provided a rail base 411 as shown in FIGS. 32 and 33, which can move upward in FIG. 32.

To each rail base 411 are connected a thread cylinder 413 and a retreat cylinder 414. Each retreat cylinder 414 is connected to a base plate 412 fixed on the corresponding rail base 411. A square-round control shaft 415 is engaged with each base plate 412. Controlled by the square-round control shafts 415, the base plates 412 move on the rail members 410 respectively. The square-round control shafts 415 are provided respectively on the right portion and the left portion of the frame 10 as shown in FIG. 32. The turning of these square-round control shafts 415 is synchronized by a synchro-axis 416 provided between those shafts 415. Accordingly, the base plates 412 move synchronously on the rails members 410 under control of an axis handle 417 provided on the rail driver 400. In such a way, the guide rail 90 can move relative to the frame 10.

In this embodiment, the synchro-axis 416 is turned by means of a single axis handle 417, which is to provide an easily adjustment of the hemstitching apparatus 100 by visually confirming relative positions of the turn device 80 and the needle 210 for either a round corner treatment or a square corner treatment. The synchro-axis 416 may be controlled by an NC motor.

Positioning adjustment of the guide rail 90 by the axial handle 417 is made independent of the thread cylinders 413 and the retreat cylinders 414. The thread cylinders 413 and the retreat cylinders 414 function as follows. The thread cylinders 413 provide a finishing treatment of a thread when the edge treatment of a fabric product W is over by means of drawing the guide rail 90 to the right in FIG. 33. This is to separate the fabric W and the needle 210 to give room for a finishing thread treatment.

The retreat cylinders 414 function when the press plate 30 moves back to receive the next fabric piece W. The retreat cylinders 414 draw the guide rail 90 from the thread cylinders 413 so that the press plate 30 will not contact the sewing device 200 as a safety measure to the apparatus 100.

Figure 43:
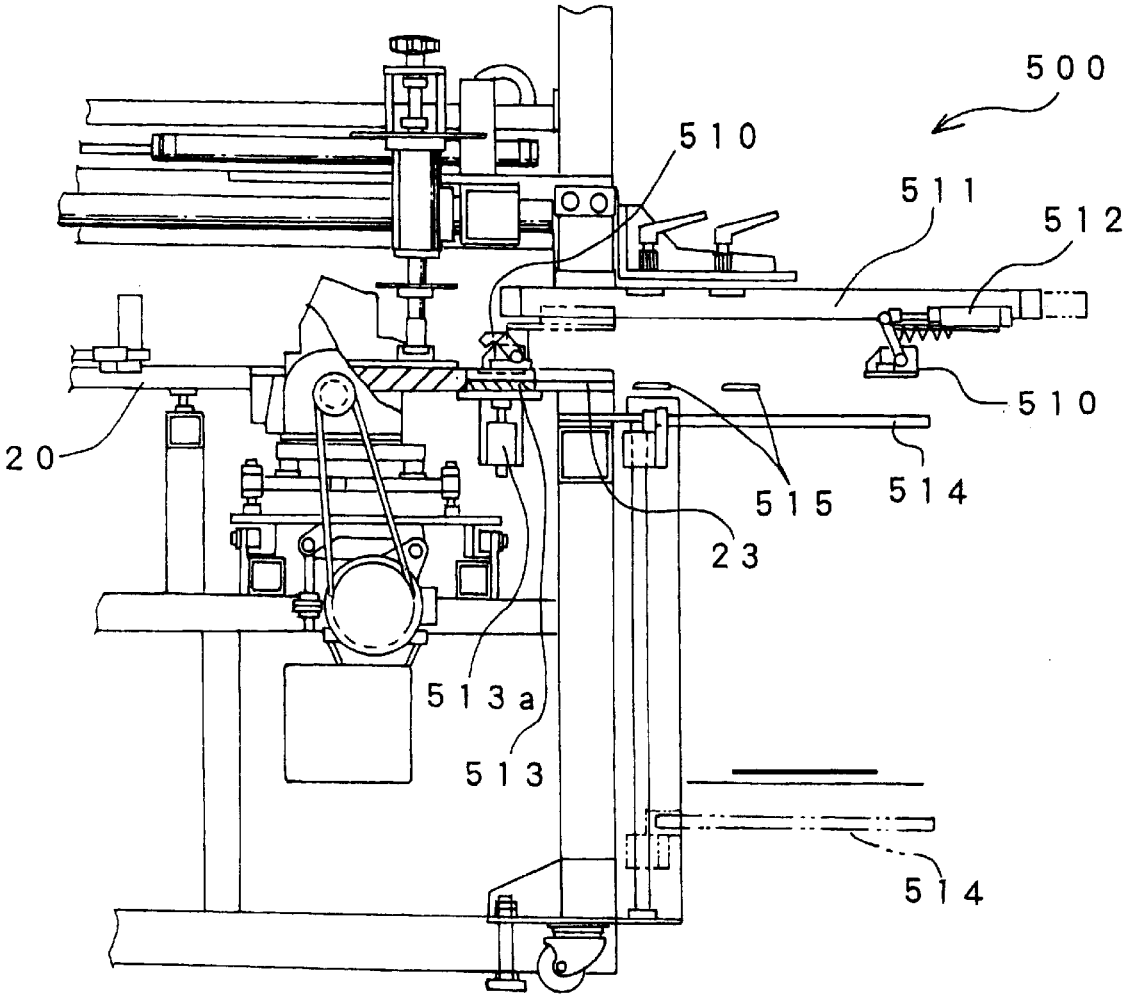
Figure 44:
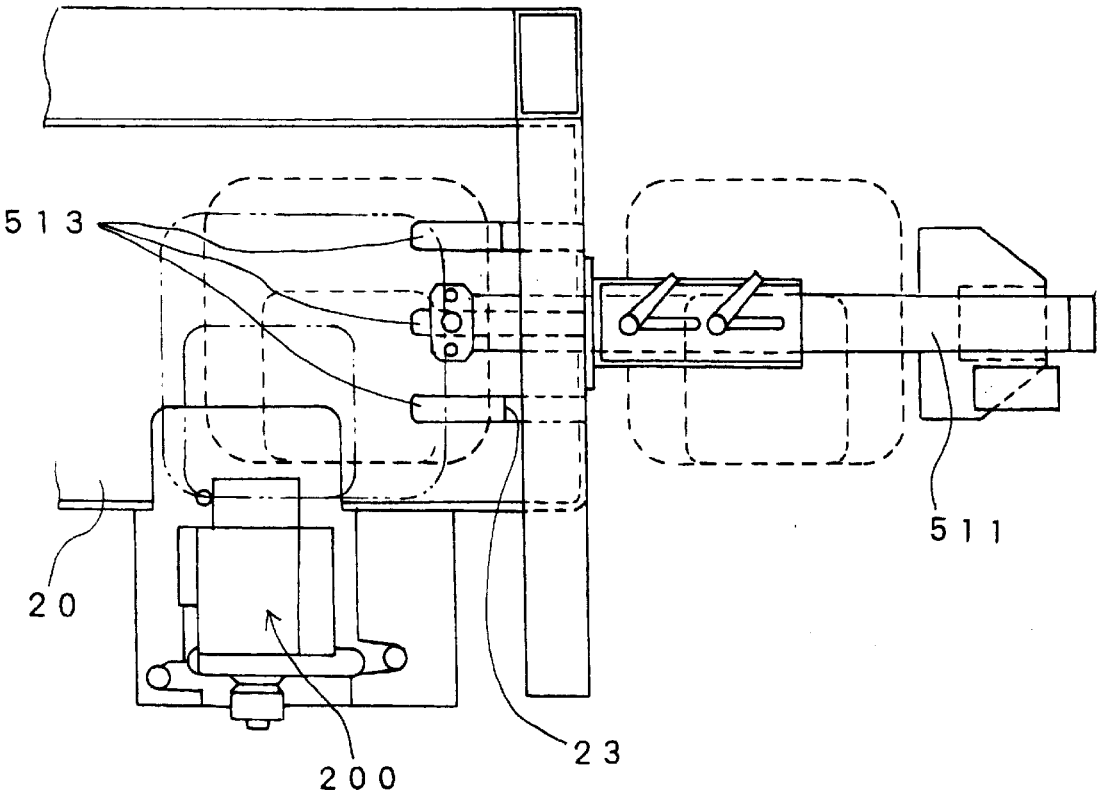

A product carrier 500 is provided in this embodiment to carry out fabric products as shown in FIGS. 43 and 44. The carrier 500 has a gripper 510 which is shuttled by a reciprodevice 511. The gripper 510 grips an end portion of finished products and piles them neatly on a product receiver 514.

The work table 20 is additionally provided with insertion grooves 23 for the gripper 510 such that the gripper 510 can be guided to grasp finished products. As shown in FIG. 44, such grooves 23 are provided on a right portion of the work table 20. The left ends of these grooves 23 are introduced in the working area of the press plate 30.

However, when the grooves 23 have portions in the working area of the press plate 30, noises may be generated as the press plate 30 moves over the grooves 23, particularly when large sized fabric pieces are to be treated. In order to cope with this problem, a plate member 513 is provided, which is elevated by means of a vertical cylinder 513*a* as necessary. The plate member 513 and the work table 20 become coplanar and the press plate 30 can smoothly turn on the grooves 23. The gripper 510 is moved by means of a gripper device 512 as shown in FIG. 43.

As described, finished products are piled on the product receiver 514 by means of the gripper 510. To avoid slippage of the piled products, oncoming products are temporarily positioned on an assistant plate means 515 shown in FIG. 43. The plate means 515 is provided not to interfere with the movement of the gripper 510.

The product receiver 514 is depressable downward as the weight of the piled products thereon increases. Accordingly, the top surface of the piled products is always at a constant level.

INDUSTRIAL UTILITY OF THE INVENTION

A hemstitching apparatus 100 of the present invention can basically be operated by movement of a press plate 30, which is basically facilitated by means of reciprocal movements of a guide beam 60 provided by means of a drive device 70. Even a round corner treatment can be provided quickly and easily, thus at a low cost, with a hemstitching apparatus of the present invention.

Various configurations of fabric products can be efficiently dealt with by a hemstitching apparatus of the present invention, quickly and easily, thus economically.

In addition, change of the parts can be done simply. And the cut device 300 can provide an automated cutting of fabric materials. Damages to the device 100 can be efficiently avoided as well.

A support device 50 according to the present invention, comprising: a support cylinder 51 to be horizontally moved along a guide beam 60; a cylinder member 53 turnably enclosed within the support cylinder 51 to vertically guide a shaft 40; two pressure chambers 54 and 55 formed between the cylinder member 53 and the shaft 40; and two fluid ports 51*a* and two port paths 53*a* in communication with the chambers 54 and 55, is capable of providing easy setting of member elements of a hemstitching apparatus 100 in addition to the foregoing advantages.

A cutter device 300 according to the present invention will automatically cut and feed an elongated fabric material, contributing to shortening of overall operation time.

A detachable turn device 80 is provided on a shaft 40. Such a turn device 80 has an attachment opening 82 in its center for engagement with a turn device support 44 formed on the shaft 40. Use of such easily removable turn devices 80 and common attachment means prepared according to the present invention provide an excellent efficiency in production of single-fabric products.

Means to safeguard the apparatus 100 in case of malfunctioning is additionally provided on the apparatus 100.

What is claimed is:

1. A hemstitching apparatus for single-fabric products, comprising:

a press plate to press a fabric piece on a work table held by a machine frame;

a guide beam provided integrally with said press plate to hold and move a vertically installed shaft in the cross-machine direction;

a drive device to move said beam in the machine direction;

a turn device provided integrally on the upper end of said shaft;

a guide rail mounted on said machine frame to guide a plurality of guide rollers provided on said turn device; and a sewing device to hem stitch said fabric piece pressed under said press plate, wherein the reciprocal movement and turning of said press plate pressing said fabric piece and said turn device provided integrally with said press plate are to be provided solely by said guide beam as moved reciprocally by said drive device.

2. A hemstitching apparatus according to claim 1, wherein said guide rail comprises:

a guide channel which guides said guide rollers therein;

a stopper provided in said guide channel to hold a guide roller above a needle of said sewing device;

an outlet to expel a guide roller held within said stopper from said guide rail; and an inlet to introduce a guide roller held within said stopper into said guide rail.

3. A hemstitching apparatus according to claim 1, further comprising a support device to hold said shaft, comprising:

a support cylinder to be moved in the cross-machine direction on said guide beam;

a cylinder member turnably mounted in said support cylinder to vertically guide said shaft therein; a pair of vertically arranged pressure chambers and formed between said cylinder member and said shaft; and a pair of fluid ports and port paths provided in said support cylinder to control the pressure in said pressure chambers.

4. A hemstitching apparatus according to claim 1, wherein each end of said guide rail is retreatably mounted on said machine frame by means of a safety device.

5. A hemstitching apparatus according to claim 1, wherein said outlet is covered with a door device comprising:

a gate device turnably held on a side of said guide rail by means of a support spindle;

a piston means provided outwardly from said support spindle of said gate device; and a pushspring provided outwardly from said piston means to bias said gate device toward said guide rail, said inlet being covered with a front portion of a guide member held thereon by means of a pull spring.

6. A hemstitching apparatus according to claim 1, wherein said guide rail is to be positioned outside the position of a needle of said sewing device to provide a square corner treatment on said fabric piece, and is to be positioned inside the position of said needle to provide a round corner treatment on said fabric piece by means of mounting said guide rail on said machine frame movably in parallel therewith, said press plate being capable of retreating from said sewing device when said guide rail returns to its original position together with said turn device, wherein said outlet and said inlet of said guide rail (90) are large enough to respectively guide each said guide roller from and into a guide channel in accordance with the change in distance between the guide roller held by said stopper in said guide rail and an adjacent guide roller, said turn device and said press plate being replaceably provided on said shaft.

7. A hemstitching apparatus according to claim 1, wherein said turn device and said press plate are to be mounted on a side of said shaft in a single direction by means of replaceably mounting said press plate on the lower end of said shaft in the horizontal direction, providing a turn device support on an upper portion of said shaft inserting through said turn device support an attachment opening formed in the center of said turn device, and pressing and fixing said turn device on said turn device support.

8. A hemstitching apparatus according to claim 1, further providing a cutter device in front of said sewing device to draw a portion of an elongated fabric material and cut said material to provide a fabric piece having a predetermined dimension.

9. A hemstitching apparatus according to claim 1, further providing a label device between a cutter device and said sewing device to provide a label on a fabric piece on said work table.

10. A hemstitching apparatus according to claim 1, further providing a product carrier on said machine frame to receive fabric products.

* * * * *